US007657965B2

(12) United States Patent
Scott et al.

(10) Patent No.: US 7,657,965 B2
(45) Date of Patent: Feb. 9, 2010

(54) SURFACE CLEANING WITH CLEANING FLUID SUPPLY SHAPE MEMORY ALLOY ACTUATOR

(75) Inventors: Allen W. Scott, Fort Wayne, IN (US); Kurt E. Ashbaugh, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 12/346,233

(22) Filed: Dec. 30, 2008

(65) Prior Publication Data

US 2009/0113658 A1 May 7, 2009

Related U.S. Application Data

(62) Division of application No. 11/276,167, filed on Feb. 16, 2006.

(60) Provisional application No. 60/593,829, filed on Feb. 17, 2005, provisional application No. 60/743,153, filed on Jan. 20, 2006.

(51) Int. Cl.
*A47L 7/00* (2006.01)

(52) U.S. Cl. ..... 15/320

(58) Field of Classification Search ..... 15/320–322; *A47L 7/00*

See application file for complete search history.

*Primary Examiner*—David A Redding
(74) *Attorney, Agent, or Firm*—McGarry Bair PC

(57) ABSTRACT

A surface cleaning apparatus comprises a fluid delivery system including a supply of cleaning fluid and a fluid recovery system for drawing dirty cleaning fluid from the surface to be cleaned. The apparatus can comprise a passageway that passes heated motor cooling air in heat exchange with the cleaning fluid to heat the cleaning fluid. The apparatus can further comprise a mixing manifold that mixes first and second cleaning fluids at different concentrations for different cleaning modes. The apparatus can further comprise a fluid valve having a shape memory alloy actuator.

7 Claims, 68 Drawing Sheets

SURFACE CLEANING WITH CLEANING FLUID SUPPLY SHAPE MEMORY ALLOY ACTUATOR

CROSS-REFERENCE TO RELATED APPLICATIONS

This application is a divisional of 11/276,167, filed Feb. 16, 2006, which claims the benefit of U.S. Provisional Patent Application No. 60/593,829, filed Feb. 17, 2005, and U.S. Provisional Patent Application No. 60/743,153, filed Jan. 20, 2006, both of which are incorporated herein by reference in their entirety.

BACKGROUND OF THE INVENTION

1. Field of the Invention

The invention relates to a surface cleaning apparatus that delivers cleaning fluid to a surface to be cleaned. In one of its aspects, the invention relates to a surface cleaning apparatus with a fluid delivery system having a flow control valve that is actuated by electrical current to an electrical element that changes shape when electrical current passes through it.

2. Description of the Related Art

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. An example of an extractor is disclosed in commonly assigned U.S. Pat. No. 6,131,237 to Kasper et al., which is incorporated herein by reference in its entirety.

SUMMARY OF THE INVENTION

According to the invention, a surface cleaning apparatus comprises a housing; a fluid delivery system mounted to the housing and including a fluid supply tank for holding a supply of cleaning fluid, a fluid dispenser for applying cleaning fluid from the fluid supply chamber to the surface to be cleaned, and a fluid conduit between the fluid supply tank and the fluid dispenser; a fluid recovery system mounted to the housing and comprising a suction nozzle and a vacuum source in fluid communication with the suction nozzle to draw fluid from the surface to be cleaned through the suction nozzle; and a dispensing valve in the fluid conduit for controlling the flow of the cleaning fluid from the fluid supply tank to the fluid dispenser. An actuator that includes a shape memory alloy part is coupled to the dispensing valve to control the flow of fluid from the fluid supply tank to the fluid dispenser.

An electrical circuit that includes the shape memory alloy part and a switch that controls the flow of current through the electrical circuit can selectively actuate opening and closing of the dispensing valve.

Typically, the dispensing valve comprises a housing having a fluid inlet, a fluid outlet and a valve member movable relative to a valve seat to open and close the valve.

In one embodiment, the shape memory alloy part comprises a shape memory alloy wire. The valve member can be suspended from the shape memory alloy wire whereby contraction of the wire when the switch is closed lifts the valve member from the valve seat. The housing can form an internal chamber that receives the shape memory alloy wire and holds the cleaning fluid to facilitate a temperature decrease of the shape memory alloy wire for reversing the contraction of the shape memory alloy wire when the switch is open.

According to one embodiment, the shape memory alloy part is made of a nickel-titanium alloy.

DESCRIPTION OF THE PREFERRED EMBODIMENT

Figure 1:
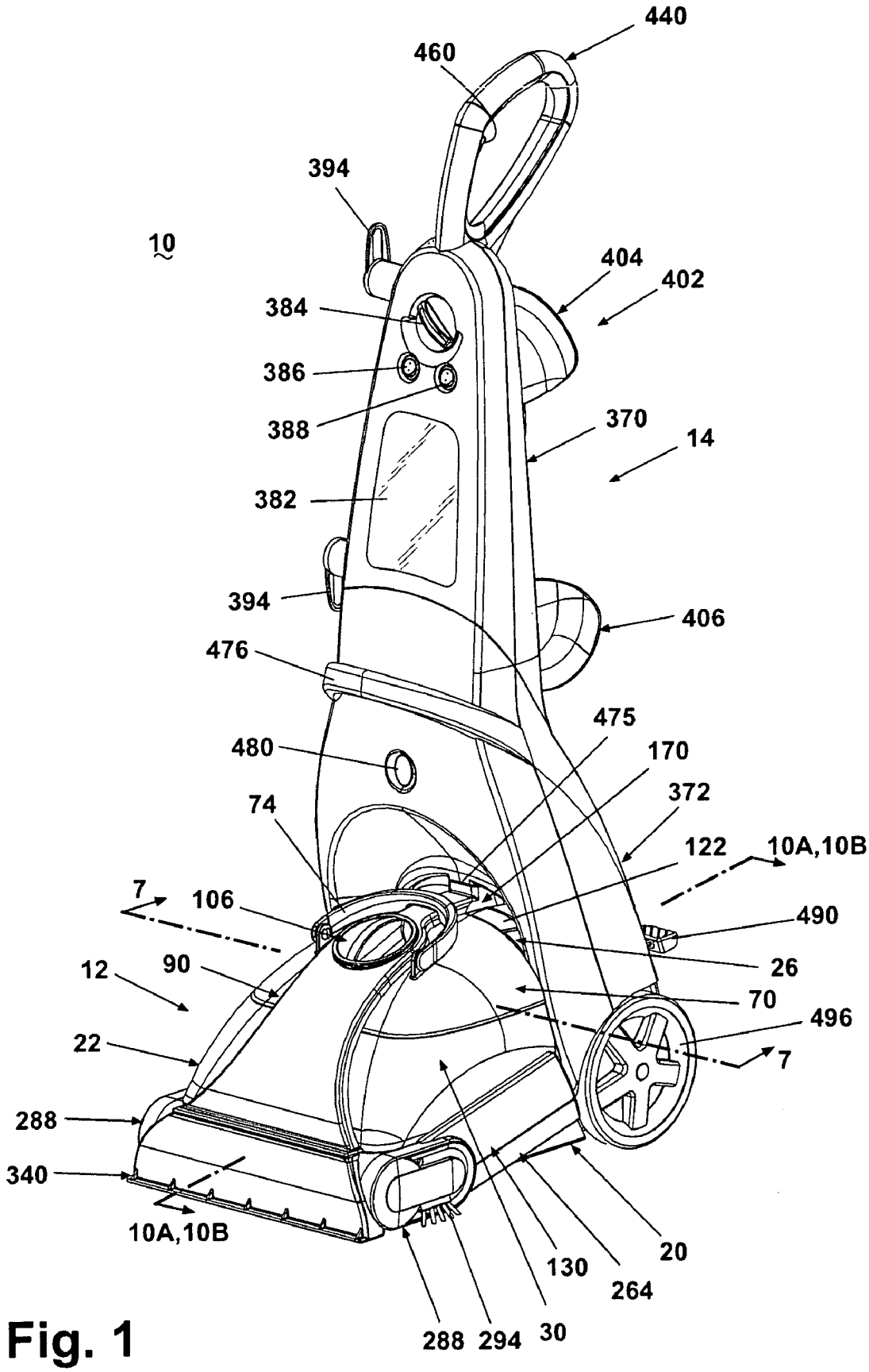
FIG. 1 is a front, right perspective view of an extractor according to the invention with a handle assembly pivotally mounted to a foot assembly.
Figure 2:
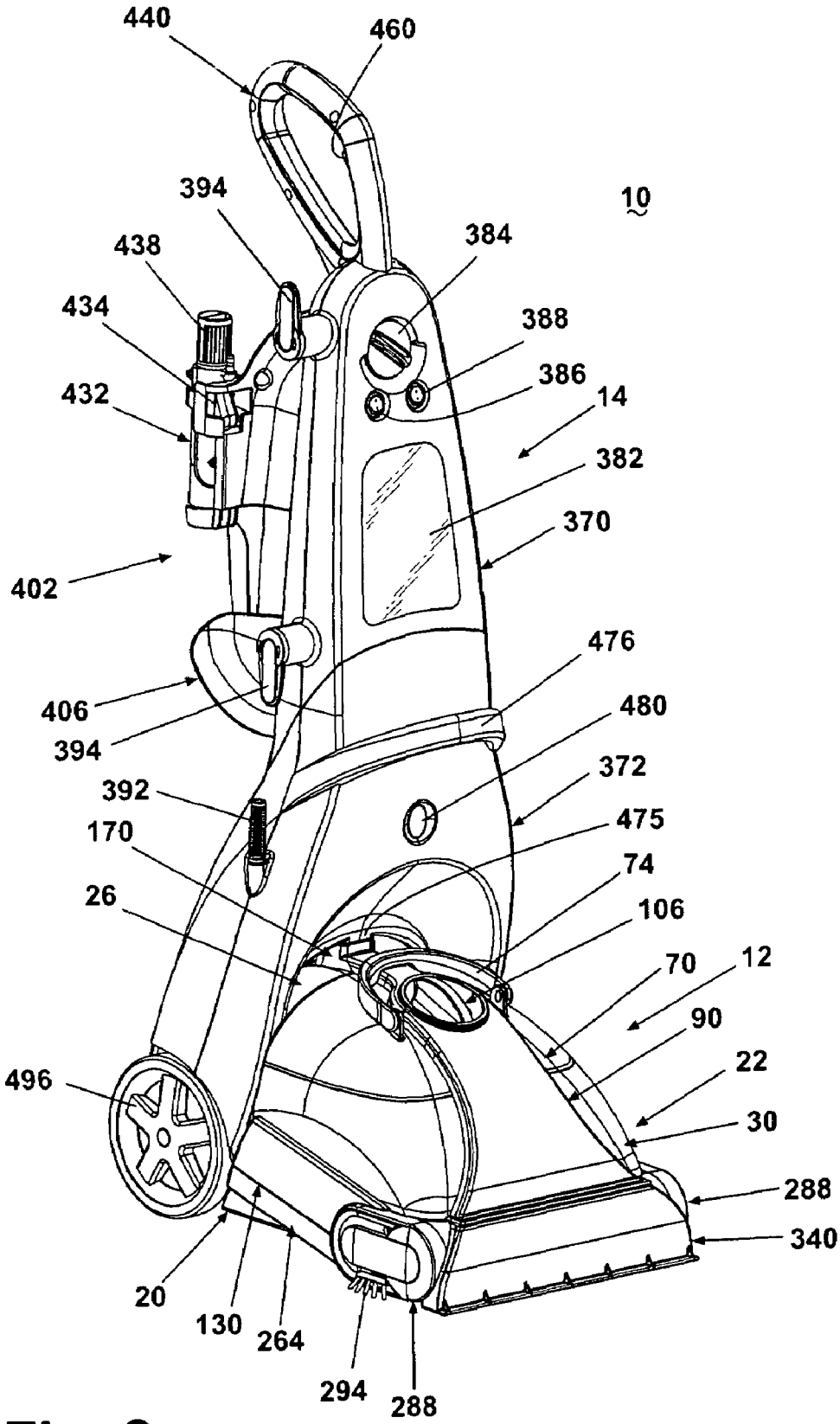
FIG. 2 is a front, left perspective view of the extractor of FIG. 1.
Figure 3:
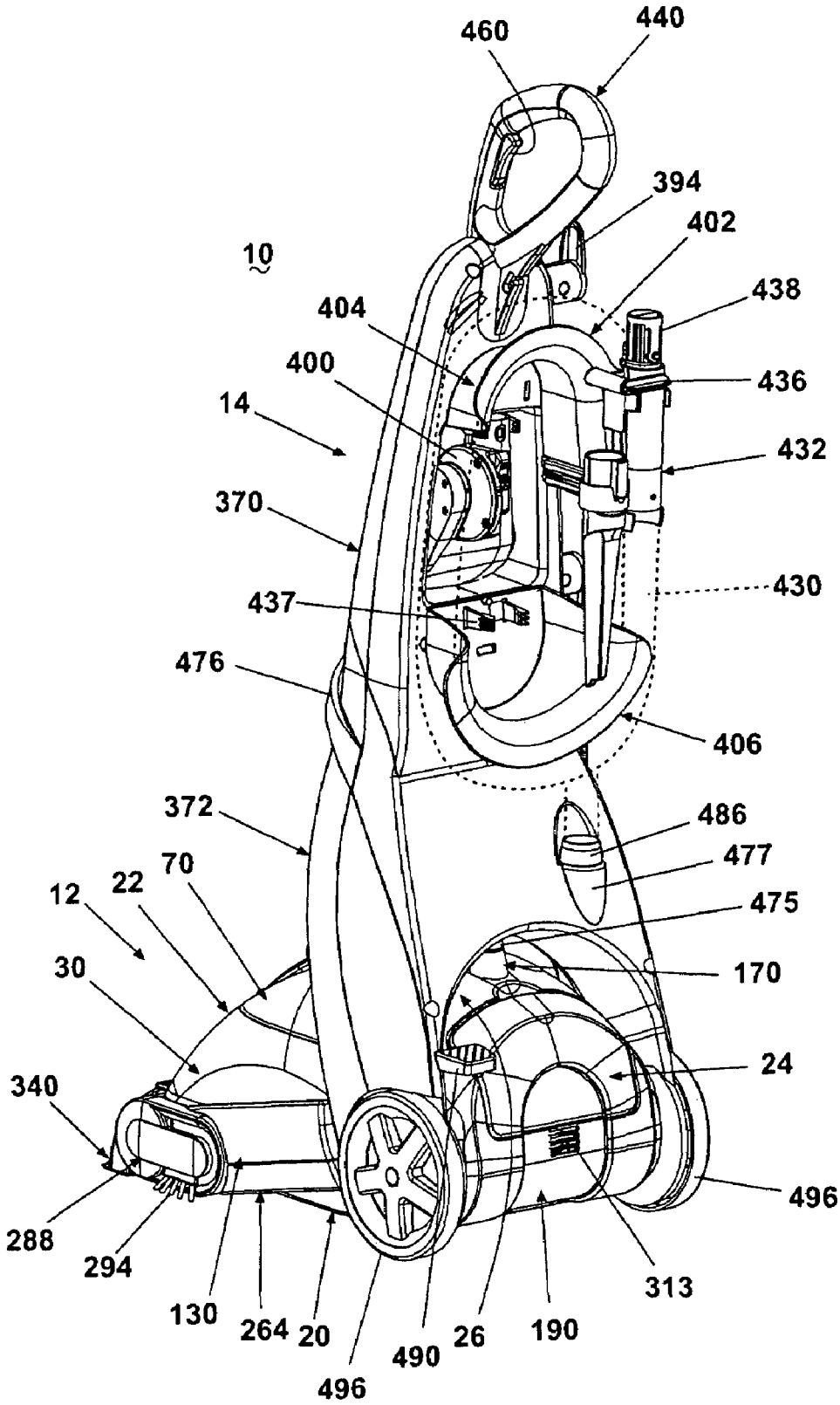
FIG. 3 is a rear, right perspective view of the extractor of FIG. 1.
Figure 4:
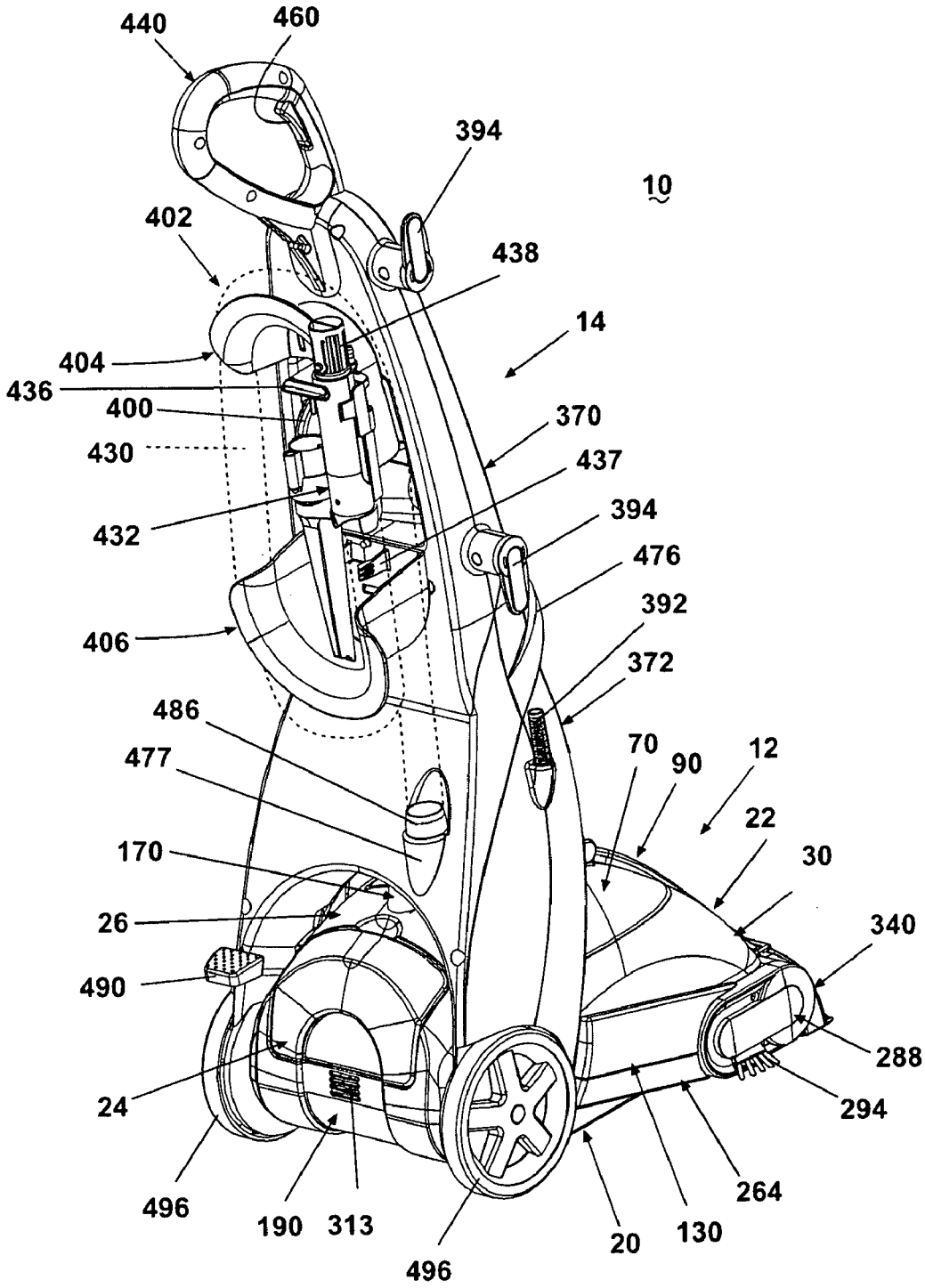
FIG. 4 is a rear, left perspective view of the extractor of FIG. 1.

Referring now to the drawings and particularly to FIGS. 1-5, an upright extractor 10 according to the invention comprises a housing having a foot assembly 12 for movement across a surface to be cleaned and a handle assembly 14 pivotally mounted to a rearward portion of the foot assembly 12 for directing the foot assembly 12 across the surface to be cleaned. The extractor 10 includes a fluid delivery system for storing cleaning fluid and delivering the cleaning fluid to the surface to be cleaned and a fluid recovery system for removing the spent cleaning fluid and dirt from the surface to be cleaned and storing the spent cleaning fluid and dirt. The components of the fluid delivery system and the fluid recovery system are supported by at least one of the foot assembly 12 and the handle assembly 14.

Figure 5:
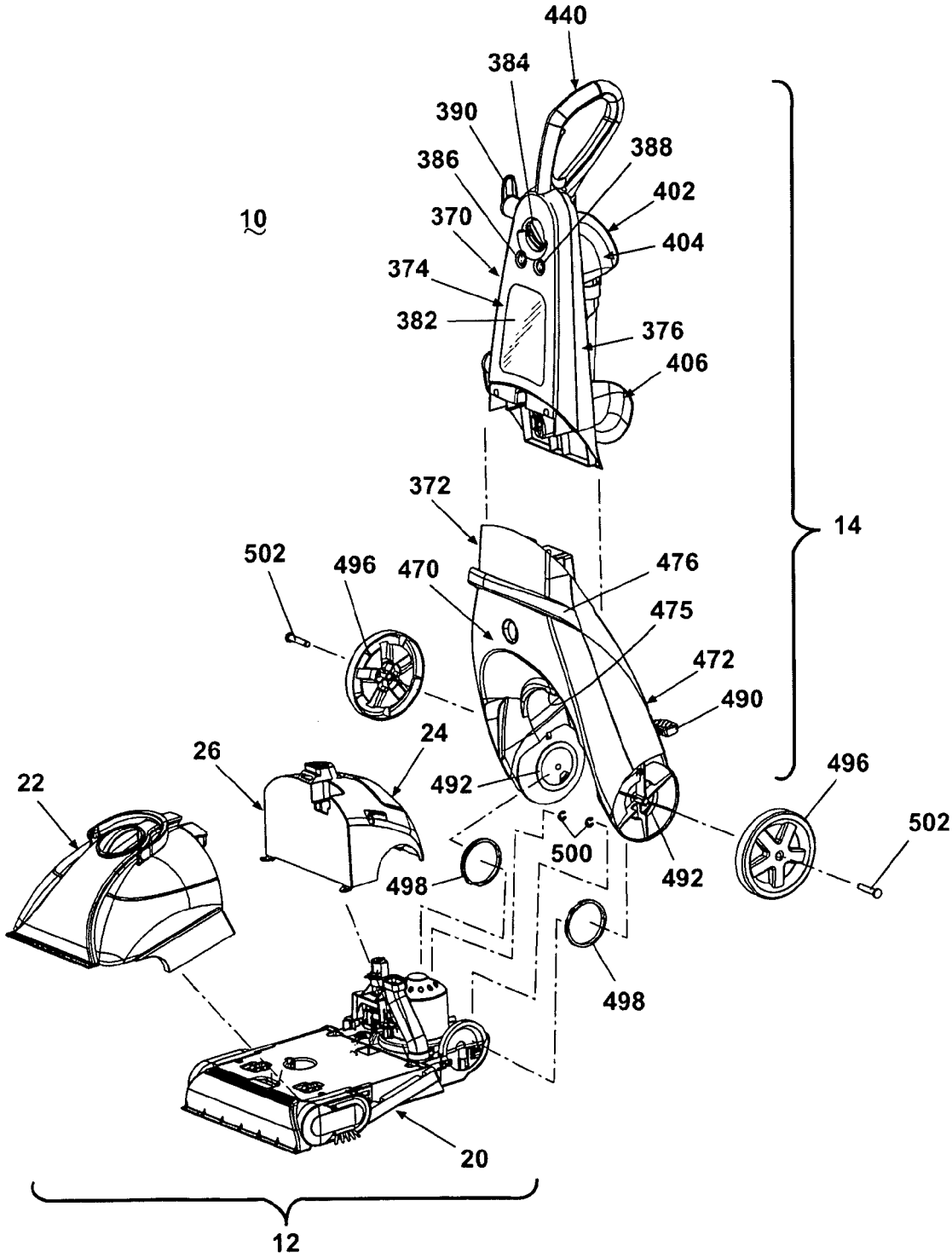
FIG. 5 is an exploded view of the foot assembly and the handle assembly of the extractor of FIG. 1, wherein the foot assembly is exploded to show a recovery tank assembly, a solution supply tank assembly, a base assembly, and a foot assembly cover, and the handle assembly is exploded into an upper handle and a lower handle.

As best seen in FIG. 5, the foot assembly 12 comprises a base assembly 20 that supports a recovery tank assembly 22 at a forward portion thereof, forward being defined as relative to the mounting location of the handle assembly 14 on the foot assembly 12, and a solution supply tank assembly 24 at a rearward portion thereof. Referring additionally to FIGS. 6-9, the recovery tank assembly 22 comprises a tank housing 30 with an open top covered by a removable lid 70 and an open bottom sealed by a bottom plate 38 having a central aperture 40. Together, the tank housing 30 and the bottom plate 38 form a recovery chamber 32 sized to receive a flexible cleaning fluid supply assembly 43 comprising a flexible bladder 44 having an inlet funnel 47 on an upper surface thereof and an outlet (not shown) on an opposite, lower surface and defining a cleaning fluid supply chamber 45. The flexible bladder 44 is utilized as a cleaning fluid supply tank. A suitable bladder 44 is disclosed in U.S. Pat. No. 6,131,237 to Kasper et al., which is incorporated herein by reference in its entirety. The tank housing 30 comprises a funnel receiver 50 located at the open top for capturing the inlet funnel 47 and thereby securing an upper portion of the cleaning fluid supply assembly 43 within the recovery chamber 32. The tank housing 30 further includes a pair of first and second bladder positioning members 52, 54 that protrude a predetermined distance into the recovery chamber 32 for, along with the funnel receiver 50, limiting vertical movement of the bladder 44 within the recovery chamber 32. The bladder outlet (not shown) is aligned with the central aperture 40 in the bottom plate 38 and is secured to a valve mechanism 48 in the central aperture 40 for controlling flow of the cleaning fluid from the cleaning fluid supply chamber 45 of the bladder 44 and for securing the bladder 44 to the bottom plate 38 in the manner described in the aforementioned U.S. Pat. No. 6,131,237 to Kasper et al. The bottom plate 38 also includes a downwardly projecting tank leveling member 42, whose purpose will be described hereinafter.

Figure 7:
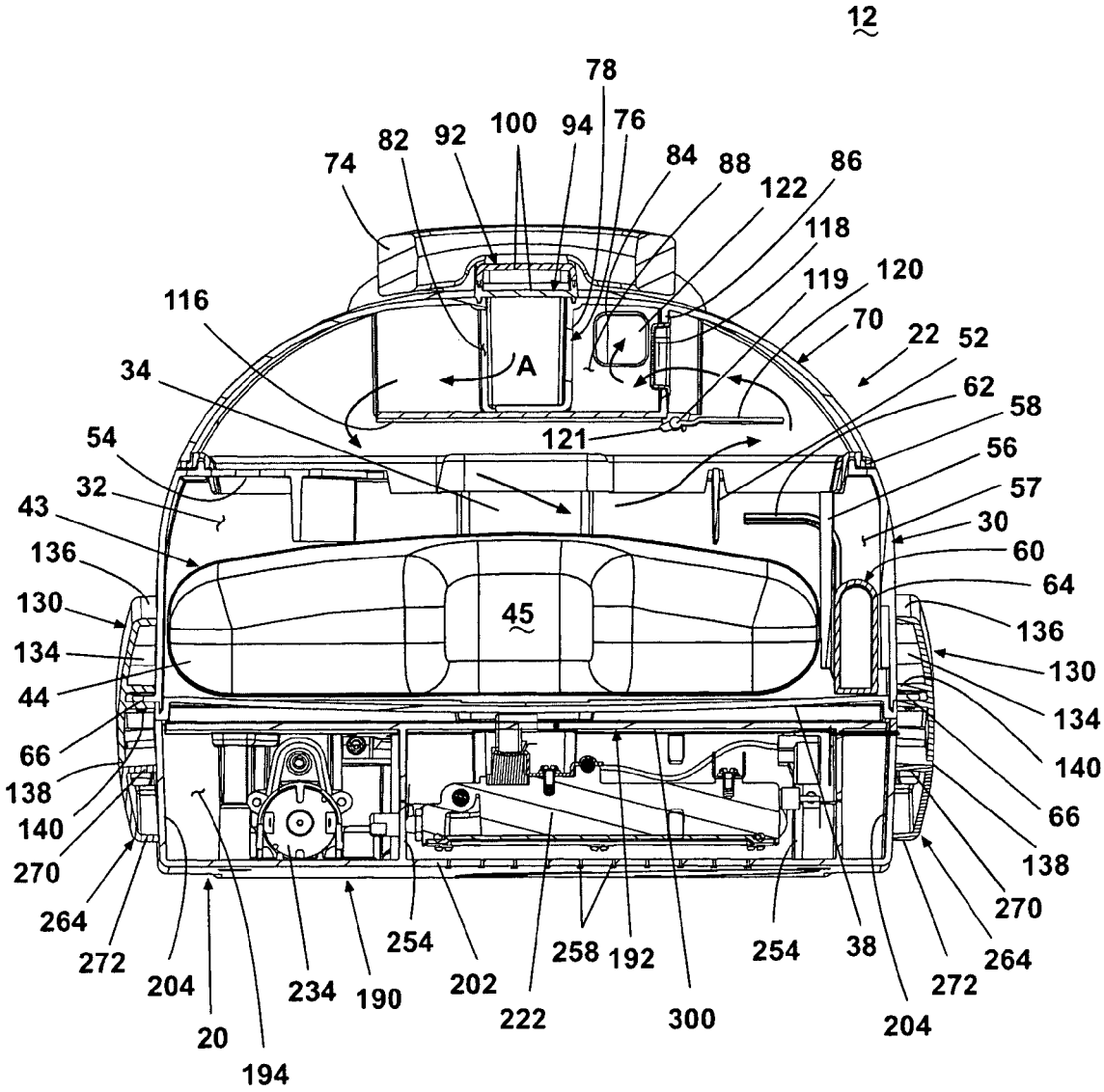
FIG. 7 is a sectional view of the foot assembly taken along line 7-7 of FIG. 1.
Figure 8A:
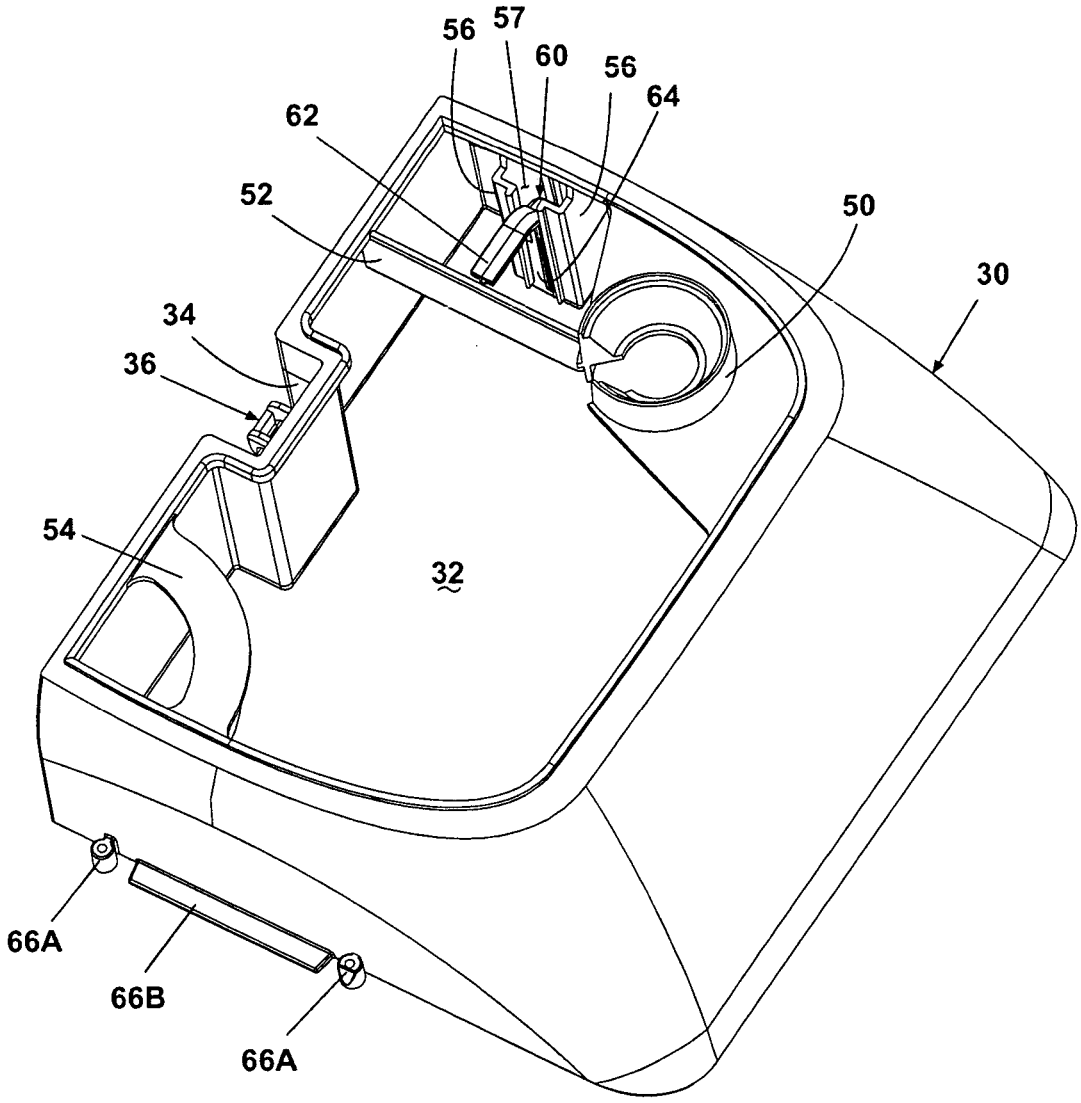
FIG. 8A is an upper perspective view of a recovery tank housing and a float from the recovery tank assembly of FIG. 5.

In the recovery chamber 32, a float chamber 57 is formed by a pair of spaced L-shaped, opposed vertical float walls 56 projecting inward towards the recovery chamber 32 from a sidewall of the tank housing 30 to slidingly receive a float 60, as best viewed in FIGS. 7 and 8A. The float 60 comprises a generally flat L-shaped upper portion 62 and a buoyant rectangular lower portion 64. The lower portion 64 is captured within the float chamber 57 by the float walls 56, while the upper portion 62 extends above the lower portion 64 and out of the float chamber 57 between the float walls 56. The float walls 56 and the float 60 are sized to accommodate vertical movement of the float 60 within the float chamber 57.

Referring now to FIGS. 6 and 8A-10B, the tank housing 30 has an elongated vertical recess 34 formed in a rear wall thereof and a tank latch 36 mounted in the recess 34 for releasably securing the lid 70 to the tank housing 30 with a sealing gasket assembly 58 therebetween. The tank latch 36 is preferably an over-center latch having a body 35 with an upper hook portion 37 and a lower grip portion 33, and the latch 36 is movably mounted to the tank housing 30 through a pivot member 39. In one embodiment, the sealing gasket assembly 58 is formed by a commonly know resilient elastomeric rope material that is placed between the tank housing 30 and the tank lid 70. In another embodiment, the sealing gasket assembly 58 is a single piece formed of a resilient elastomeric material to effectively seal the recovery chamber 32 from air and water leaks.

The lid 70 has a depending locking flange 68 (FIG. 10A) on a rear, lower portion thereof that is received in the recess 34 of the tank housing 30 for releasably mating with the tank latch 36 when the lid 70 is connected to the tank housing 30. The locking flange 68 terminates at a hook 69 sized to receive the hook portion 37 on the tank latch 36. To release the tank latch 36, the user pulls the grip portion 33 and pivots the body 35 about the pivot member 39 until the body 35 reaches an over-center position and the hook portion 37 disengages from the hook 69. In this condition, the tank latch 36 is unlatched from the hook 69, and the lid 70 can be removed from the tank housing 30. To lock the lid 70 to the tank housing 30, the hook portion 37 is aligned with the hook 69, and the user pivots the grip portion 33 about the pivot member 39 towards the tank body 30 until the body 35 reaches the over-center position and snaps into a latched condition shown in FIG. 10A.

Referring now to FIGS. 6, 7, 8B, and 9, the lid 70 further comprises a pair of flanges 72 on an upper surface thereof for pivotally mounting a recovery tank handle 74 that can be used to transport the recovery tank assembly 22 to and from the extractor 10. A cavity 76 formed in an upper surface of the lid 70 has a generally straight section 78 that extends from the rear of the lid 70 and merges with a generally circular section 80 near a front portion of the lid 70. The cavity 76 has an open top and is bounded on all other sides, except for an opening in a left side wall (relative to the orientation of FIGS. 6, 7, and 8B) of the straight section 78 to form a tank inlet 82 in fluid communication with the recovery chamber 32 when the lid 70 is mounted to the tank housing 30. The lid 70 also includes a tank outlet 84 formed in the rear wall thereof and adjacent to the cavity 76. A tank outlet conduit 122 is mounted to the rear of the lid 70 at the tank outlet 84 and has an inlet 124 that mates with the tank outlet 84 and a downward facing outlet 126 oriented orthogonal to the inlet 124.

Figure 8B:
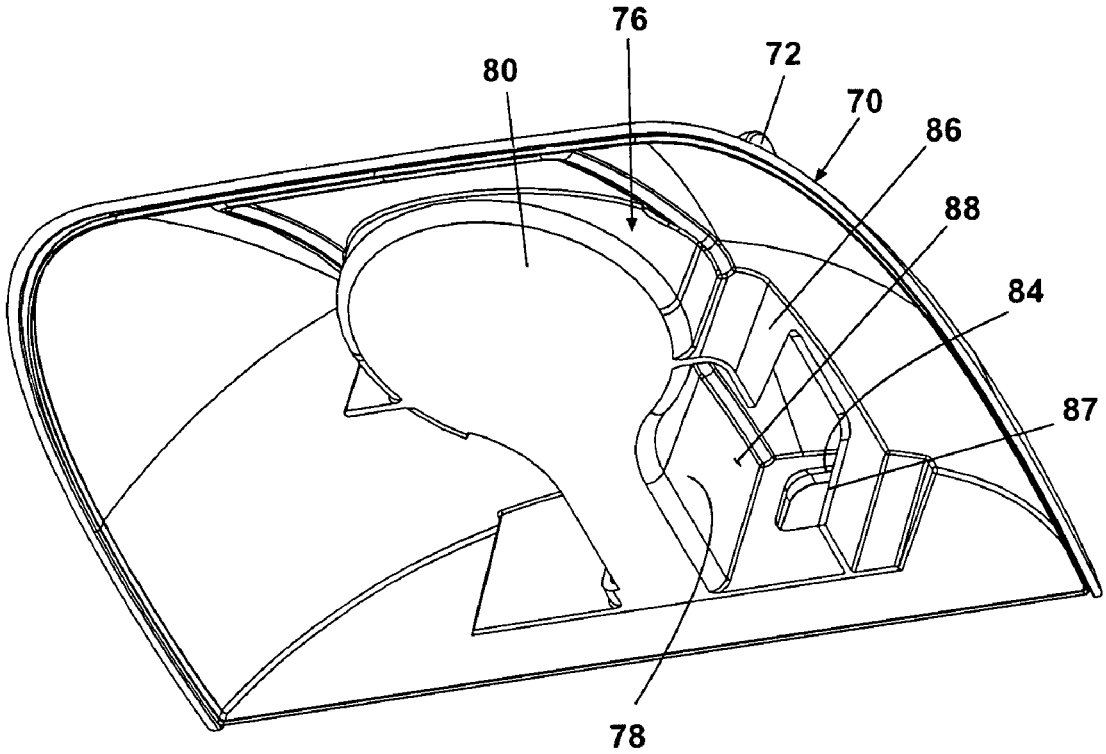
FIG. 8B is a bottom perspective view of a lid of the recovery tank assembly of FIG. 5.

The lid 70 supports a generally horizontal separator plate 116 beneath the cavity 76 and the tank outlet 84. As seen in FIGS. 7 and 8B, the separator plate 116 extends beyond the cavity 76 on both sides of the generally straight section 78 and mates with a baffle 86. The baffle 86 extends down from an upper portion of the lid 70 and forward from a rear wall of the lid 70 to join with the circular section 80 of the cavity 76 to form an outlet chamber 88 between the baffle 86, the right wall (relative to the orientation of FIGS. 7 and 8B) of the cavity 76, the separator plate 116, and the upper portion of the lid 70. The tank outlet 84 is positioned in the rear wall of the lid 70 such that it is in fluid communication with the outlet chamber 88 and functions as an outlet for the outlet chamber 88. The baffle 86 has an inlet opening 87 that functions as an inlet for the outlet chamber 88 and mounts a screen 118 that prevents undesirable particles from entering the outlet chamber 88. The separator plate 116 supports a lower portion of the screen 118, as shown in FIG. 7, and also supports a float door 120 rotatably mounted thereto through a pivot pin 119 and sized to cover the screen 118. Because the pivot pin 119 is off-center from the center of mass of the float door 120, the float door 120 naturally rotates clockwise relative to the orientation of FIG. 7 to a normally open position. However, the float door 120 comprises a stop 121 that contacts a bottom surface of the separator plate 116 to prevent the float door 120 from rotating beyond the generally horizontal, open position, as seen in FIG. 7, wherein the float door 120 does not block access to the screen 118 and, accordingly, the outlet chamber 88. In the open position, the float door 120 is oriented above the upper portion 62 of the float 60. As fluid level increases in the recovery chamber 32, the buoyant float 60 rises with the rising fluid. At a predetermined fluid level, the upper portion 62 of the float 60 contacts a lower surface of the float door 120 to force the float door 120 to rotate counterclockwise relative to the orientation of FIG. 7 about the pivot pin 119. Once the float door 120 rotates a predetermined amount, airflow at the tank outlet 84 draws the float door 120 to a vertical closed position, whereby the float door 120 mates with the screen 118 and closes the opening 87 to terminate fluid communication between the outlet chamber 88 and the recovery chamber 32.

Referring specifically to FIG. 7, the internal structure of the lid 70 forms a circulation path A within the lid 70 and the recovery chamber 32. The circulation path A begins at the tank inlet 82 and moves laterally before flowing down and around the separator plate 116 and into the recovery chamber 32. The circulation path A then proceeds laterally beneath the separator plate 116 toward the opposite side of the recovery chamber 32 and flows up and around the opposite side of the separator plate 116, through the screen 118, and into the outlet chamber 88. The circulation path A then flows out of the outlet chamber 88 through the tank outlet 84 and into the tank outlet conduit 122.

Figure 9:
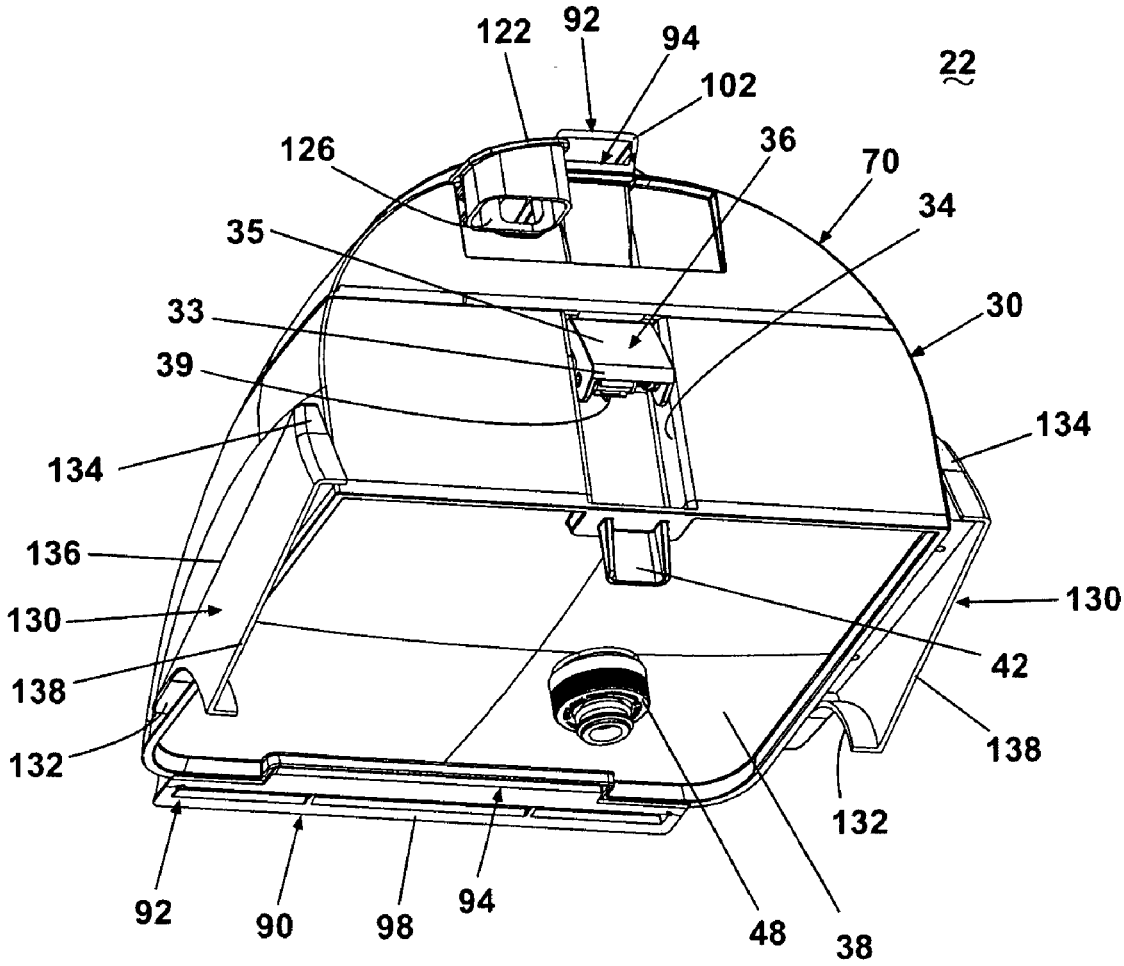
FIG. 9 is a rear perspective view of the recovery tank assembly of FIG. 5.

Referring again to FIGS. 6, 10A, and 10B, the recovery tank assembly 22 further comprises a recovery tank inlet conduit 90 that overlies the lid 70 and the tank housing 30 and has an upper portion 92 and a lower portion 94 joined together to form an arched fluid flow path therebetween. The recovery tank inlet conduit 90 has a forward, nozzle conduit section 96 that terminates at a nozzle conduit inlet 98 and a rearward, accessory conduit section 100 that terminates at an accessory conduit inlet 102. In one embodiment, the recovery tank inlet conduit 90 is integral with the lid 70. In another embodiment, the tank inlet conduit 90 is selectively removable from the lid 70 to facilitate cleaning of the tank inlet conduit 90. In either embodiment, the arched shape of the inlet conduit 90 adds structural rigidity to the tank lid 70 to thereby strengthen the recovery tank assembly 22. The nozzle conduit inlet 98, when assembled with the recovery tank assembly 22, is coplanar with the bottom plate 38, and the accessory conduit inlet 102 aligns with the rear wall of the lid 70 (FIG. 9). The nozzle conduit section 96 and the accessory conduit section 100 meet at a circular opening 104 formed in both the upper portion 92 and the lower portion 94. The circular opening 104 opens into the cavity 76 and is in fluid communication with the recovery tank inlet 82.

Figure 10A:
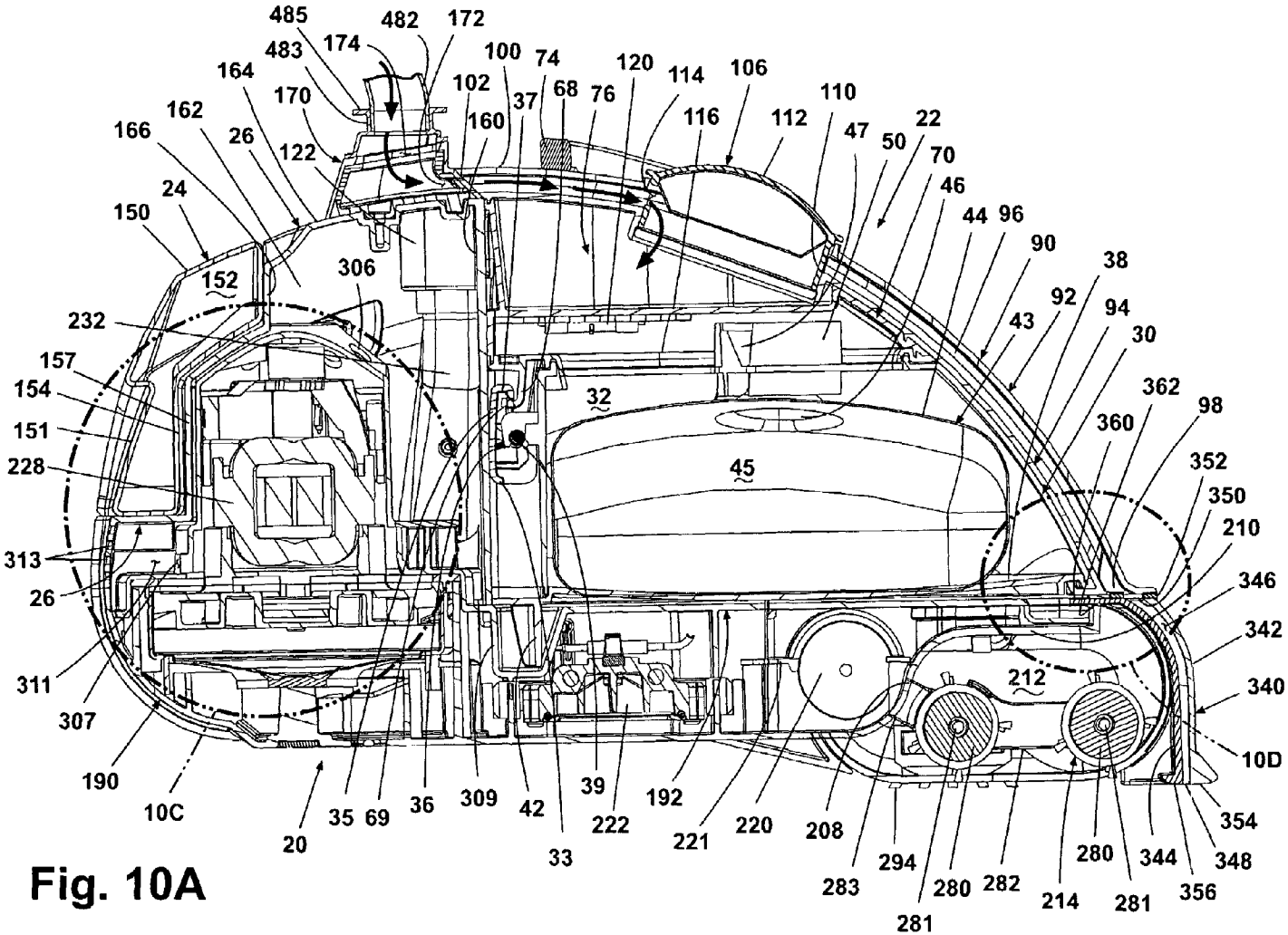
FIG. 10A is a sectional view of the foot assembly taken along line 10A-10A of FIG. 1, wherein a diverter is positioned in an accessory cleaning mode.
Figure 10B:
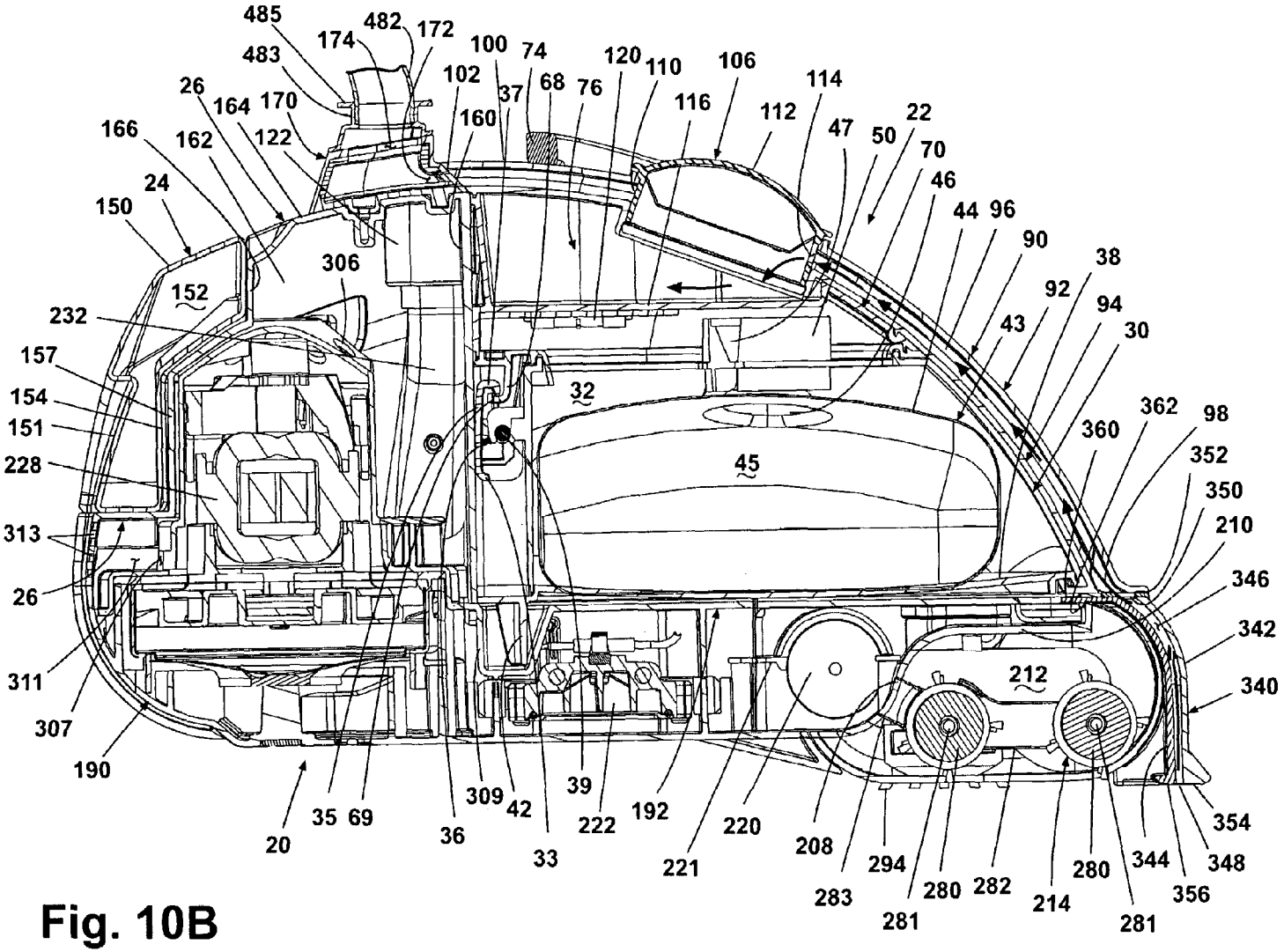
FIG. 10B is a sectional view of the foot assembly taken along line 10B-10B of FIG. 1, wherein the diverter is positioned in a floor cleaning mode.

A diverter valve 106 is rotatably mounted within the circular opening 104 and selectively communicates one of the nozzle conduit section 96 and the accessory conduit section 100 with the cavity 76 and thereby the tank inlet 82. The diverter valve 106 comprises a generally circular diverter body 108 with a gripping handle 112 and a depending peripheral flange 110 having a diverter inlet 114 formed therein. The peripheral flange 110 resides at least partially within the space between the upper and lower portions 92, 94 of the recovery tank inlet conduit 90 and defines a downwardly facing outlet for the diverter valve 106. The diverter valve 106 can be manually rotated between an accessory cleaning mode and a floor cleaning mode within the circular opening 104 by rotating the gripping handle 112. In the accessory cleaning mode, as shown in FIG. 10A, the diverter inlet 114 aligns with the accessory conduit section 100 and fluidly communicates the fluid flow path in the accessory conduit section 100 with the cavity 76 and the tank inlet 82. Additionally, the peripheral flange 110 blocks fluid communication between the fluid flow path in the nozzle conduit section 96 and the cavity 76. Conversely, in the floor cleaning mode, as shown in FIG. 10B, the diverter inlet 114 aligns with the nozzle conduit section 92 and fluidly communicates the fluid flow path in the nozzle conduit section 92 with the cavity 76 and the tank inlet 82. In this mode, the peripheral flange 110 blocks fluid communication between the fluid flow path in the accessory conduit section 100 with the cavity 76.

Figure 6:
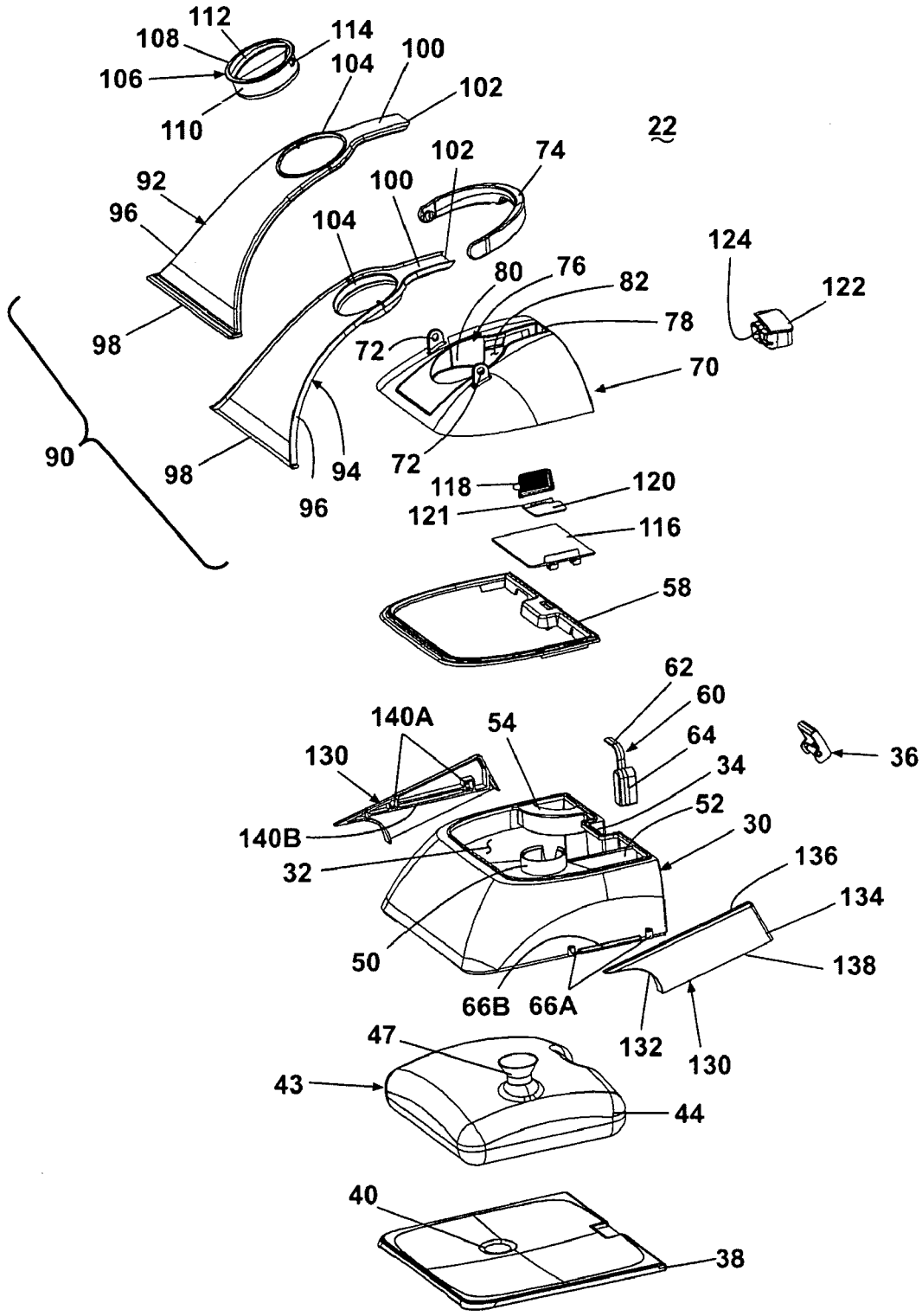
FIG. 6 is an exploded view of the recovery tank assembly of FIG. 5.

Referring now to FIGS. 6 and 8A, the recovery tank assembly 22 further comprises a pair of upper side rails 130 mounted to opposite sides of the tank housing 30. Each upper side rail 130 is defined by an arcuate front edge 132 and a rear edge 134 joined by spaced upper and lower edges 136, 138. Furthermore, each upper side rail 130 includes a mount located on an interior surface thereof and comprising a pair of spaced screw boss receivers 140A and a positioning flange receiver 140B between the screw boss receivers 140A. The mount on the upper side rails 130 mates with a complementary side rail mount located on the exterior of the tank housing 30 and comprising a pair of screw bosses 66A and an elongated positioning flange 66B between the screw bosses 66A. In particular, the screw boss receivers 140A receive the corresponding screw bosses 66A, and the positioning flange receiver 140B receives the positioning flange 66B. To secure the upper side rails 130 to the tank housing 30, screws or other mechanical fasteners are inserted through the screw boss receivers 140A and the screw bosses 66A from a lower side thereof. The upper side rails 130 are preferably angled relative to the tank housing 30 (i.e., the upper and lower edges 136, 138 are not parallel to the bottom plate 38) and project below the bottom plate 38. The upper side rails 130 facilitate mounting the recovery tank assembly 22 to the base assembly 20, as will be described in more detail hereinafter.

As shown in FIGS. 5, 10A, 10B, 11A, and 11B, the solution supply tank assembly 24 is removably received by a foot assembly cover 26 mounted to the base assembly 20. The solution supply tank assembly 24 comprises a solution supply tank housing 150 that defines a solution supply chamber 152 (FIG. 10A). The solution supply tank housing 150 includes an arcuate depression 154 in a front wall thereof, a grip depression 151 in a rear wall thereof to facilitate handling by the user, and an outlet 156 in a bottom wall thereof. The outlet 156 receives a valve mechanism 158 for controlling flow of fluid from the solution supply chamber 152.

The foot assembly cover 26 is mounted to a rear portion of the base assembly 20 through mounting tabs 159 and conceals various components mounted on the base assembly 20, which will be described in detail below. As best viewed in FIGS. 11A and 11B, the foot assembly cover 26 is formed by a generally vertical front wall 160, spaced side walls 162, each having a semicircular cutout 168, and a sloped upper wall 164 that transitions to a rear wall 166 having a plurality of cooling air vents 313 formed therein. A handle retainer 180 formed at the juncture between one of the side walls 162 and the upper wall 164 includes an arcuate detent 184 positioned in front of a ramp 182. The handle retainer 180 interacts with the handle assembly 14 to retain the handle assembly 14 in the upright position, as will be described in more detail hereinafter. The upper wall 164 and the rear wall 166 form a cavity 165 shaped and sized to receive the solution supply tank assembly 24. The cavity 165 is defined by a pair of spaced cavity side walls 161 joined by a generally orthogonal cavity rear wall 163 and a solution supply tank support 167 oriented generally orthogonal to the cavity side walls 161 and the cavity rear wall 163. The rear wall 162 includes a bulge 157 corresponding to the arcuate depression 154 in the solution supply tank housing 150. The solution supply tank support 167 supports the solution supply tank assembly 24 when the solution supply tank assembly 24 is mounted to the foot assembly 12 and includes a solution supply tank valve mechanism opening 169 sized to receive the solution supply tank valve mechanism 158 when the solution supply tank assembly 24 is mounted to the foot assembly 12.

The upper wall 164 of the foot assembly cover 26 supports a generally L-shaped accessory conduit connector 170. The accessory conduit connector 170 has an outlet 172 at a forward portion thereof and an inlet 174 at an upper portion thereof and oriented orthogonal to the outlet 172. The accessory conduit connector 170 is positioned on the upper wall 164 such that the outlet 172 is adjacent the front wall 160. The foot assembly cover 26 further includes an aperture 176 and a depression 178 located above the aperture 176 at the juncture of the front wall 160 and the upper wall 164 next to the accessory conduit connector 170. The depression 178 is sized and positioned to receive the tank outlet conduit 122 of the recovery tank assembly 22 when the recovery tank assembly 22 is mounted to the base assembly 20. Furthermore, when the recovery tank assembly 22 is mounted to the base assembly 20, the accessory conduit inlet 102 mates with the outlet 172 of the accessory conduit connector 170, as shown in FIGS. 10A and 10B, to establish fluid communication between the accessory conduit section 100 of the recovery tank inlet conduit 90 and the accessory conduit connector 170.

Referring now to FIGS. 5 and 12-13B, the base assembly 20 supporting the recovery tank assembly 22, the solution supply tank assembly 24, and the foot assembly cover 26 comprises a base housing 190 and a base housing cover 192 removably mounted to the base housing 190 to form a base housing cavity 194 therebetween. As best viewed in FIGS. 13A and 13B, the base housing 190 comprises a rearward section 196 and a forward section 198 joined by an integral center section 200 and is formed by a bottom wall 202, spaced side walls 204 with rear semicircular cutouts 205, a rear wall 206, and a front wall 208 that slopes upwardly and forwardly to form an agitator housing upper wall 210 with a lip 211 at the forward section 198.

The front wall 208 and the agitator housing upper wall 210 define a downwardly facing agitator chamber 212 sized to receive an agitator assembly 214, which will be described in more detail hereinafter. An upper surface of the agitator housing upper wall 210 includes a pair of spray tip receivers 216 that removably mount a pair of spray tips 218 that function as a dispenser for distributing fluid onto the surface to be cleaned. Each spray tip receiver 216 is formed by a pair of spaced, inclined side walls 148 joined by a rearward wall 149 and a forward wall 147. The side walls 148 each terminate at an inwardly extending upper wall 141 with a rearward notch 142 formed therein, the rearward wall 149 terminates at an arcuate spray tip conduit support 144, and the forward wall 147 terminates at a generally U-shaped flat 146.

Figure 14A:
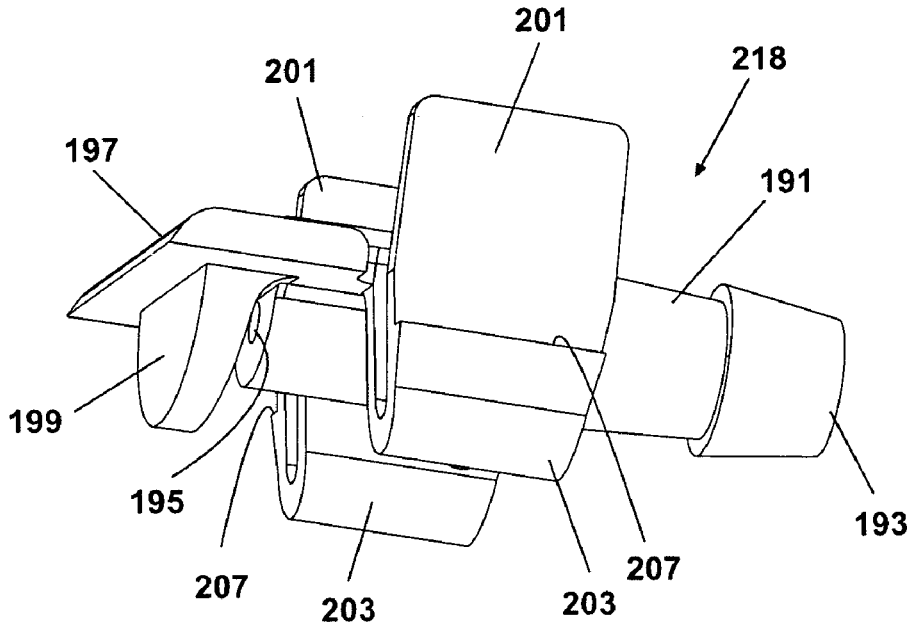
FIG. 14A is a perspective view of a spray tip from the base assembly of FIG. 5.
Figure 14B:
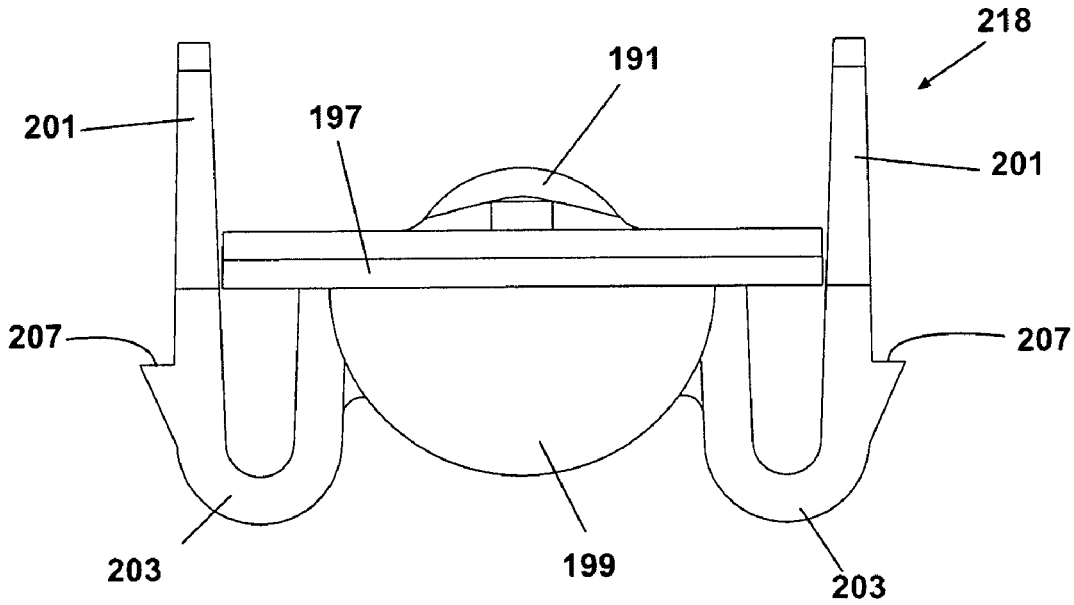
FIG. 14B is a front view of the spray tip of FIG. 14A.

Referring now to FIGS. 14A and 14B, each spray tip 218 comprises a spray tip conduit 191 that extends from a rearward inlet 193 to a forward outlet 195. Fluid that flows from the outlet 195 is atomized by an atomizing wall 199 that depends from a generally planar base 197 integral with the spray tip conduit 191. Each spray tip 218 further comprises a pair of resilient mounting tabs 201 having an outward facing prong 207 and an arcuate bend 203 about which the tabs 201 can flex toward towards the spray tip conduit 191.

Figure 13A:
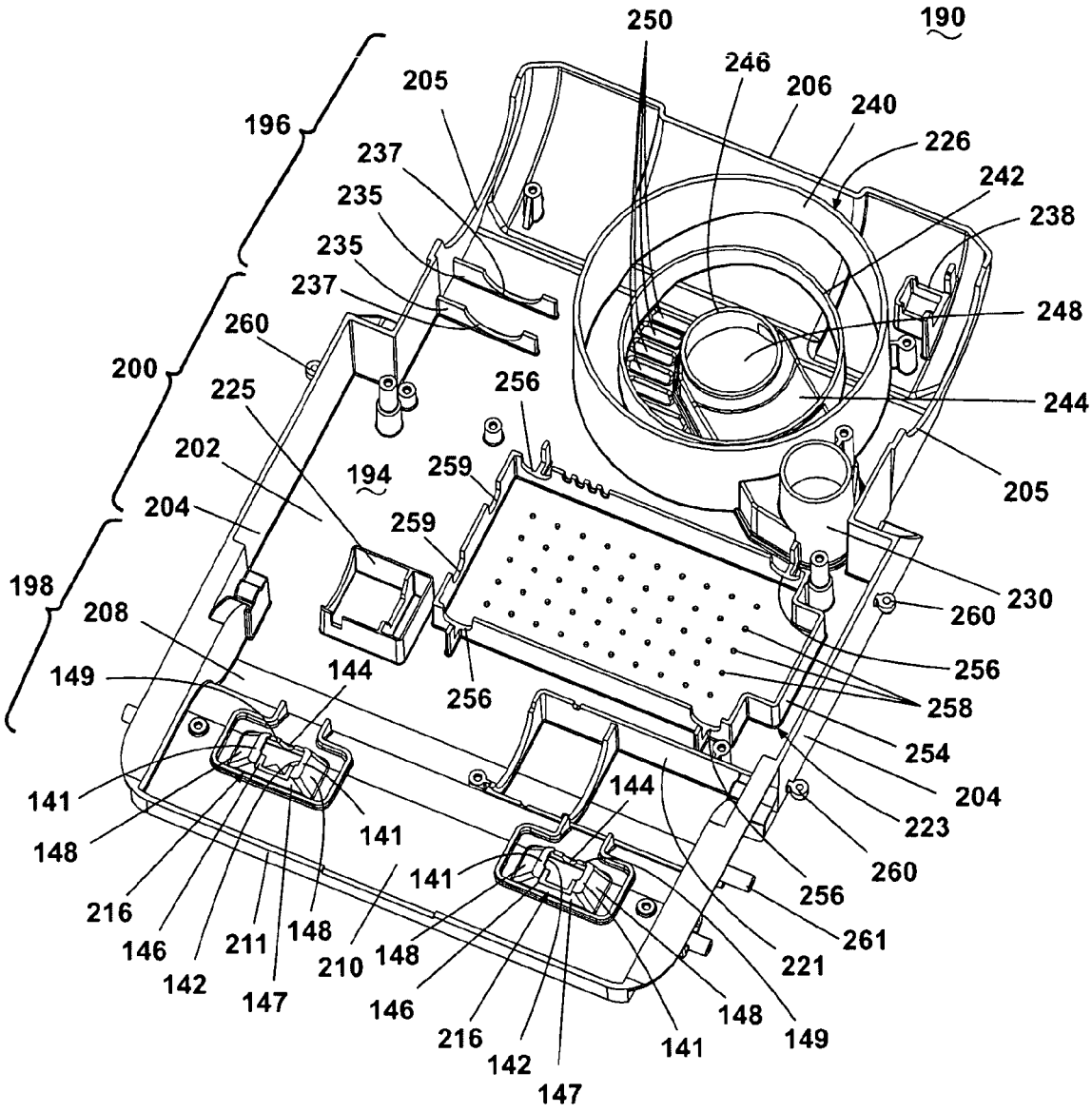
FIG. 13A is an upper perspective view of a base housing of the base assembly of FIG. 5.
Figure 13B:
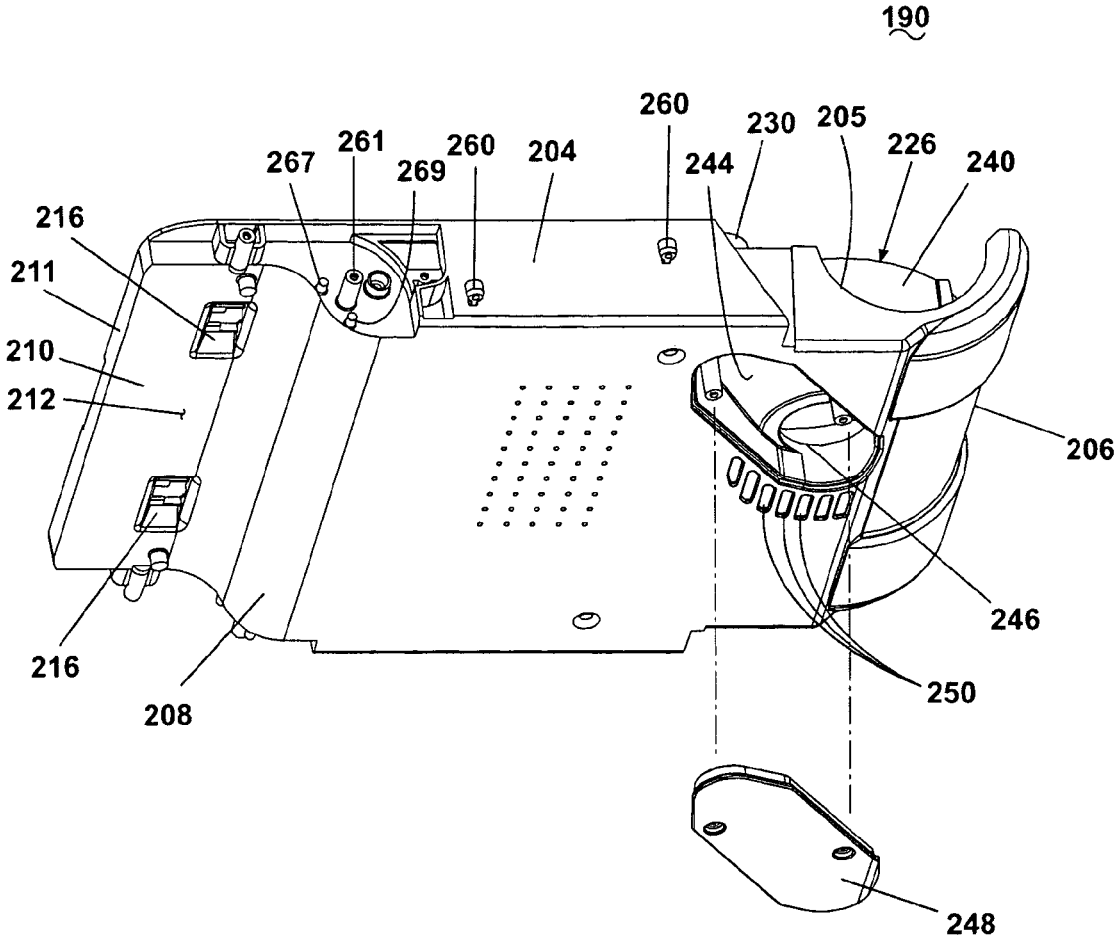
FIG. 13B is a lower perspective view of the base housing of the base assembly of FIG. 5.
Figure 15:
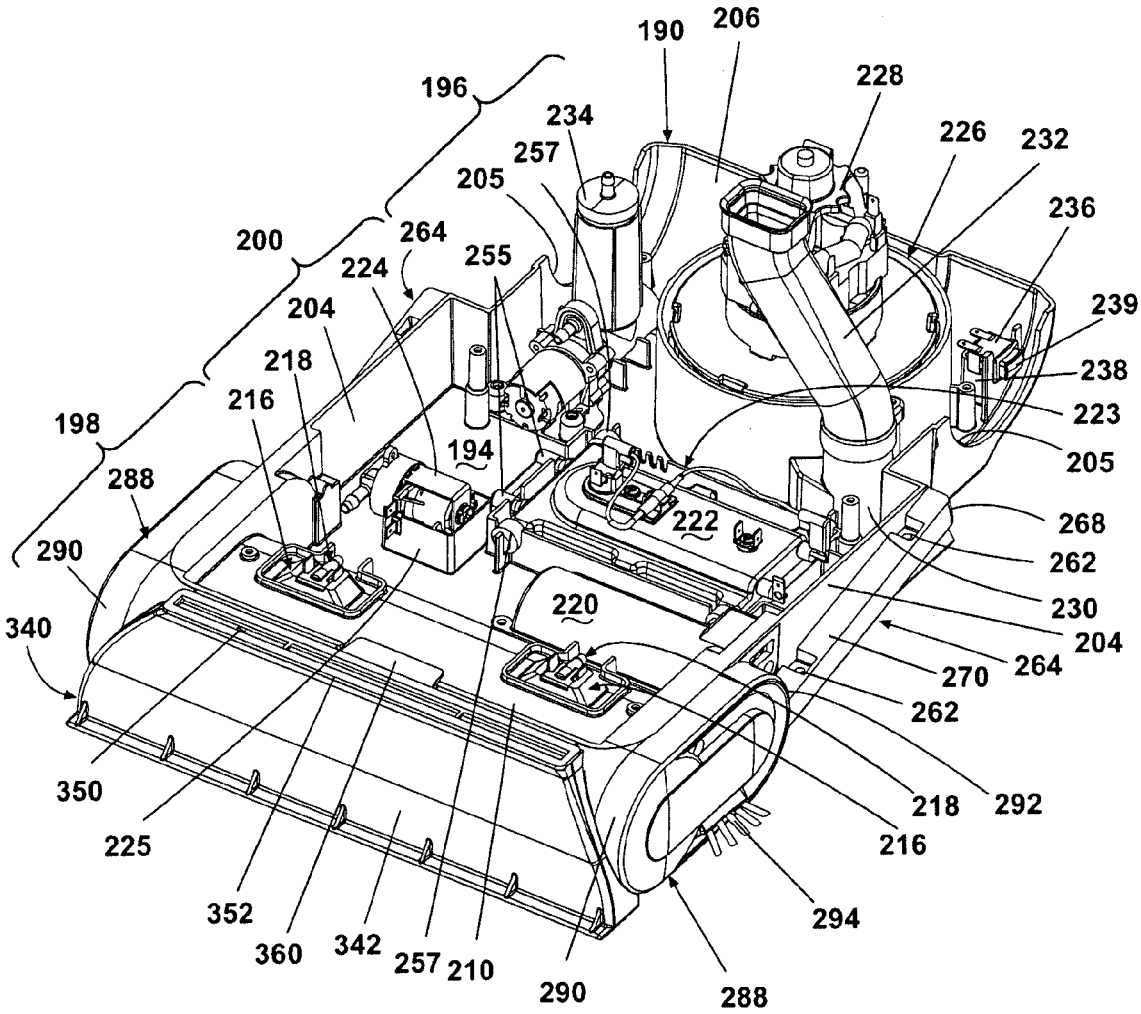
FIG. 15 is a front perspective view of the base assembly of FIG. 5 with a base housing cover and components supported thereby removed.

Referring additionally to FIGS. 13A, 13B, and 15, when mounted to the spray tip receivers 216, the spray tips 218 are in fluid communication with the agitator cavity 212 so that the fluid can be supplied from the spray tips 218 to the surface to be cleaned. Each spray tip 218 is mounted in its respective spray tip receiver 216 with the resilient tabs 201 abutting the notches 142 of the upper walls 141, the prongs 207 positioned beneath and abutting the upper walls 141, a portion of the planar base 197 resting on the flat 146, and the spray tip conduit 191 held in the spray tip conduit support 144. Upward movement of the spray tips 218 is prevented by interaction between the prongs 207 and the upper walls 141, while downward movement of the spray tips 218 is prevented by interaction between the planar base 197 and the flat 146.

The spray tips 218 can be removed from the spray tip receivers 216 by depressing the tabs 201 toward the spray tip conduit 191 so that the prongs 207 can clear the upper walls 141 and pulling the spray tips 218 upward and away from the base housing 190. To mount the spray tips 218 to the spray tip receivers 216, the user depresses the tabs 201 toward the spray tip conduit 191 so that the prongs 207 can clear the upper walls 141 and inserts the spray tip 218 into the respective spray tip receiver 216 until the planar base 197 abuts the flat 146. Next, the user releases the tabs 201, which, as a result of their resiliency, flex outward to abut the notches 142 of the upper walls 141 to hold the spray tips 218 in position.

Referring again to FIGS. 5, 12-13B, 15, and 16, the side walls 204 at the center section 200 each include mounts 260 that mate with mount receivers 262 on lower side rails 264 (FIGS. 12, 15, and 16) to removably mount the lower side rails 264 to the base housing 190 in an inclined orientation. Each lower side rail 264 comprises an arcuate front edge 266, a rear edge 268, and spaced upper and lower edges 270, 272. When the recovery tank assembly 22 is mounted to the base assembly 20, the lower edges 138 of the upper side rails 130 abut the upper edges 270 of the lower side rails 264. The lower side rails 264 limit the downward movement of the upper side rails 130 and also provide an aesthetic appearance to the foot assembly 12.

The base housing cavity 194 includes structures extending upward from the bottom wall 202 to support various components of the foot assembly 12. In particular, the base housing 190 comprises an agitator motor support 221 located in the base housing cavity 194 behind the front wall 208 for holding a commonly known agitator motor 220 for driving the agitator assembly 214. Additionally, the base housing 190 comprises a generally rectangular valve support 225 at the center section 200 for holding a spray tip valve 224 having an outlet that is in fluid communication with the inlets 193 of the spray tips 218. The base housing 190 further includes a heater support 223 that holds an optional heater 222 in the center section 200. The heater support 223 comprises a generally rectangular perimeter wall 254 sized to surround the heater 222 and having a plurality of arcuate cutouts 256 sized to receive mounting arms 257 that extend laterally from the heater 222 (FIG. 15). The perimeter wall 254 also has a pair of arcuate fluid conduit supports 259 sized to receive fluid conduits 255 leading into and out of the heater 222. The arcuate cutouts 256 and the corresponding mounting arms 257 and the arcuate fluid conduit supports 259 and the corresponding fluid conduits 255 are designed such that the heater 222 is held in an elevated position spaced from the bottom wall 202 of the base housing 190, as best seen in FIG. 7. The portion of the bottom wall 202 within the perimeter wall 254 of the heater support 223 includes a plurality of vent holes 258 to vent excess heat from the heater 222 to the surface to be cleaned and to prevent overheating of the heater 222.

At the rearward section 196, the base housing 190 includes a motor and fan assembly housing 226 for supporting a vacuum source in the form of a vertically oriented motor and fan assembly 228 and a motor and fan assembly inlet conduit 230 for mounting a transfer conduit 232 that connects the outlet 126 of the tank outlet conduit 122 to the motor and fan assembly inlet conduit 230 when the recovery tank assembly 22 is mounted to the base assembly 20. In particular, the transfer conduit 232 is covered by the foot assembly cover 26 and mates with the outlet 126 of the tank outlet conduit 122 at the aperture 176 of the foot assembly cover 26.

The rearward section 196 also includes a pair of upstanding ribs 235 with arcuate surfaces 237 for supporting a pump assembly 234 adjacent the motor and fan assembly housing 226. The pump assembly 234 has an outlet in fluid communication with an inlet of the spray tip valve 224. Additionally, the rearward section 196 comprises a generally rectangular switch support 238 that holds an agitator motor switch 236 on an opposite side of the motor and fan assembly housing 226 from the pump assembly 234 and adjacent to one of the semicircular cutouts 205. The agitator motor switch 236 includes an actuation button 237 that faces the semicircular cutout 205, as best seen in FIG. 15.

As best seen in FIGS. 13A and 13B, the motor and fan assembly housing 226 comprises a cylindrical outer peripheral wall 240 and a concentric cylindrical inner peripheral wall 242 that is shorter than the outer peripheral wall 240. A horizontal conduit 244 extends from the motor and fan assembly inlet conduit 230, through the outer peripheral wall 240 and the inner peripheral wall 242, and terminates at an upwardly oriented outlet 246 fitted with a sealing gasket 252 (FIG. 12) and located within the inner peripheral wall 242. An opening 249 in the bottom wall 202 of the base housing 190 permits access to the interior of the horizontal conduit 244, and a removable panel 248 selectively closes the opening 249. When the panel 248 is mounted to the base housing 190, the panel 248 is generally coplanar with the bottom wall 202 of the base housing 190 and forms a bottom wall of the horizontal conduit 244. A plurality of working air exhaust vents 250 formed in the bottom wall 202 between the outlet 246 and the inner peripheral wall 242 direct working exhaust air from the motor and fan assembly 228 out of the base housing 190 and toward the surface to be cleaned. In an alternative embodiment, the working exhaust air can be directed away from the surface to be cleaned, as more fully shown in U.S. Pat. No. 6,467,122 to Lenkiewicz et al., which is incorporated herein by reference in its entirety.

Figure 17A:
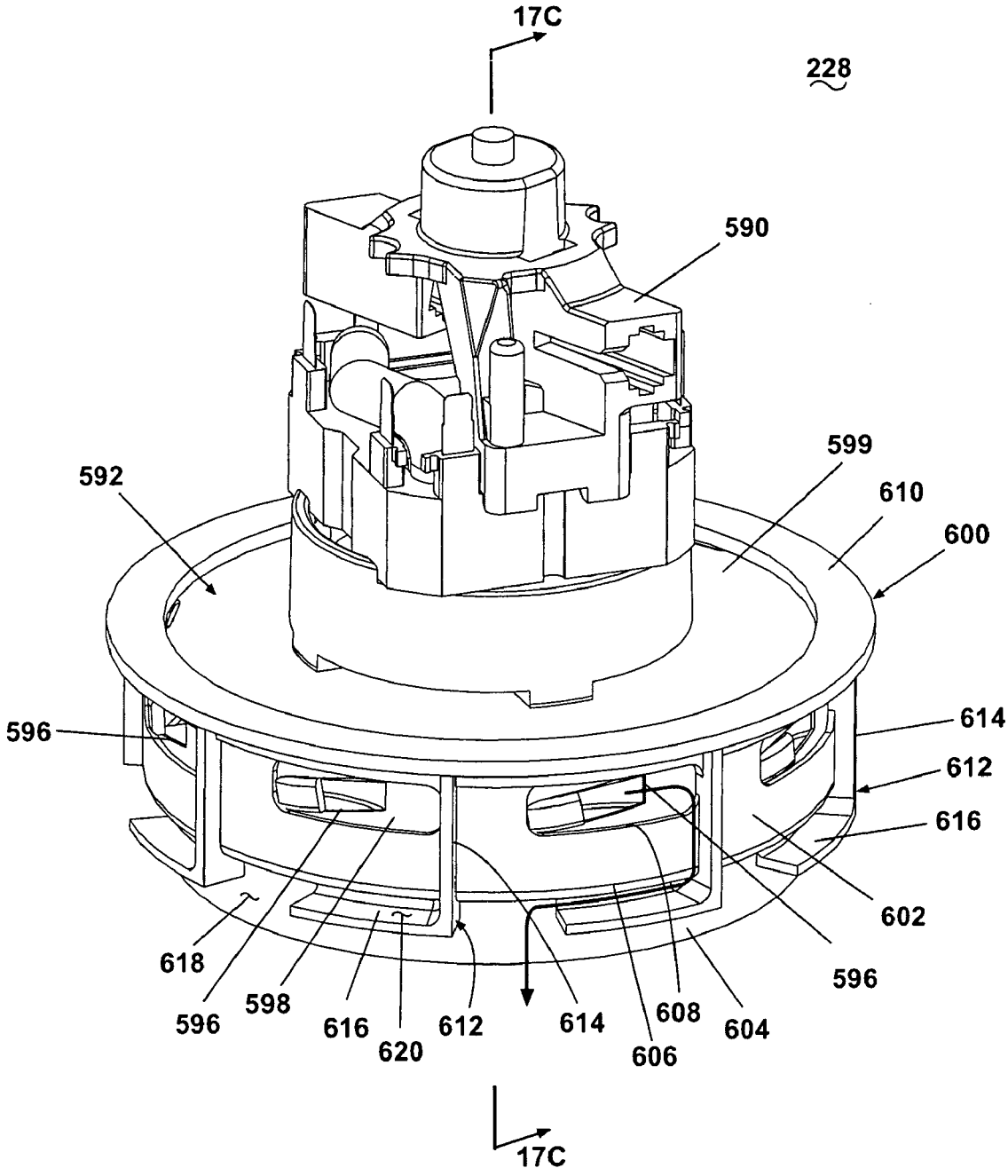
FIG. 17A is a perspective view of a motor and fan assembly from the base assembly of FIG. 5.
Figure 17B:
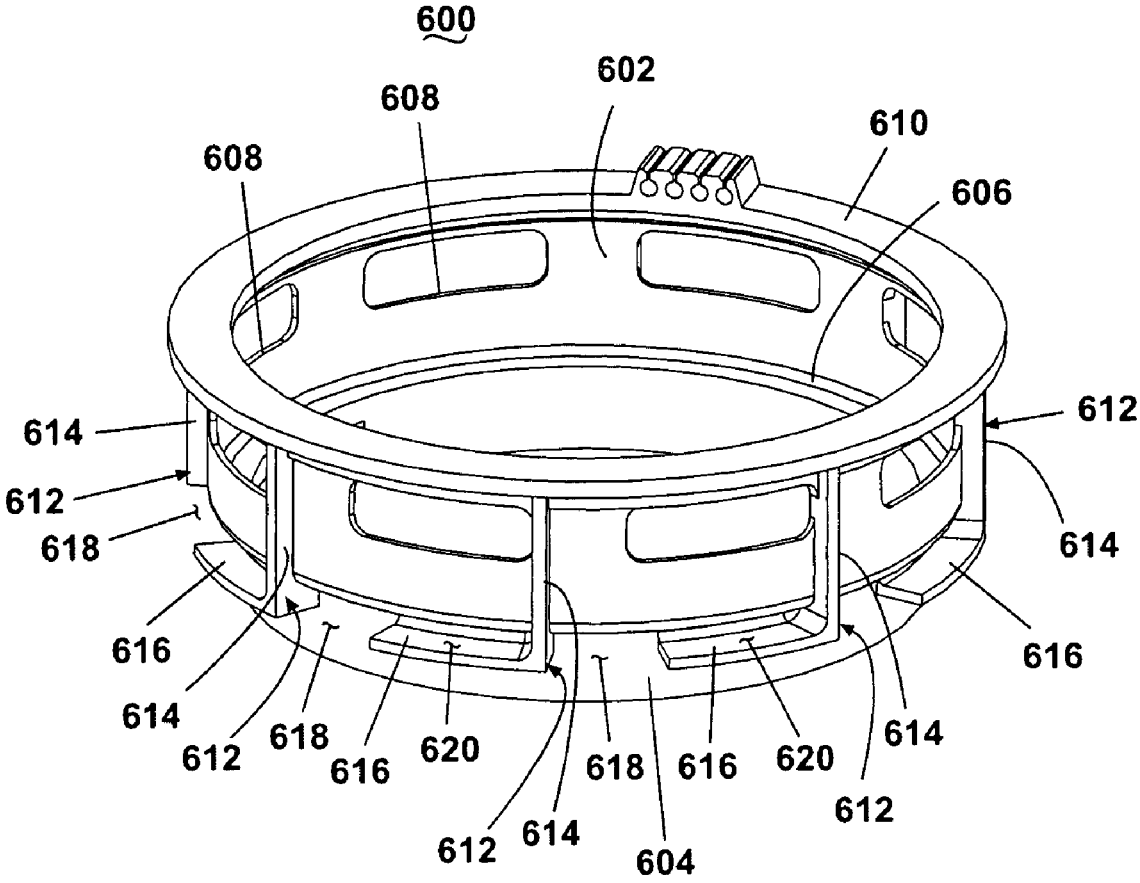
FIG. 17B is an enlarged view of a gasket from the motor and fan assembly of FIG. 17A.
Figure 17C:
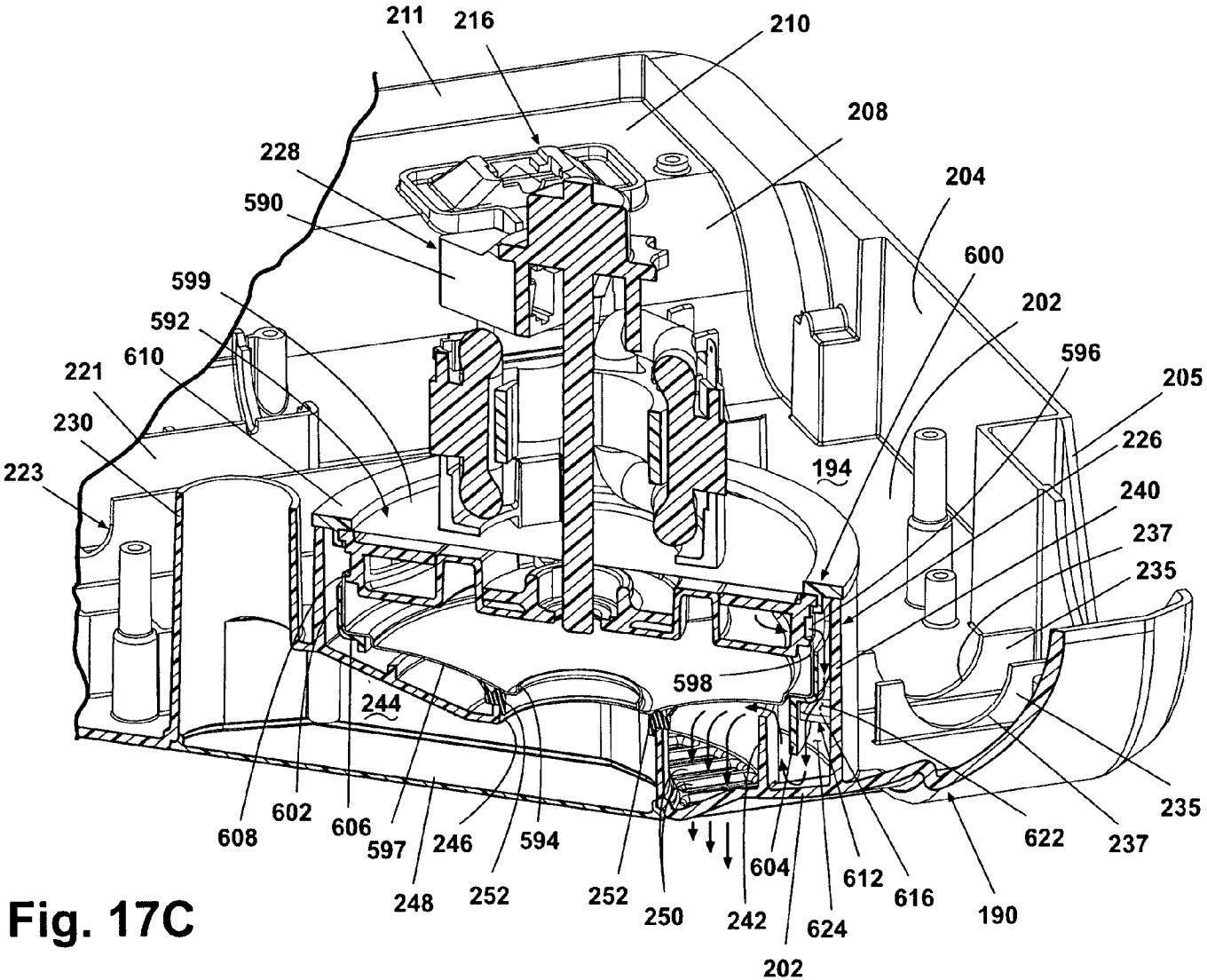
FIG. 17C is a perspective sectional view of the motor and fan assembly taken along line 17C-17C of FIG. 17A, with the motor and fan assembly mounted in the base housing of the base housing assembly from FIG. 5.

Referring now to FIGS. 17A-17C, the motor and fan assembly 228 comprises a motor 590 and a fan 592, wherein the motor 590 drives the fan 592 to create the working air flow through the extractor 10. The fan 592 has an inlet 594 centrally located on a downwardly tapering bottom wall 597 and a plurality of tangential outlets 596 circumferentially spaced around a peripheral wall 598. The outlets 596 are oriented to direct the working air exhaust in a counterclockwise direction relative to the orientation of FIG. 17A. The motor 590 is connected to a top wall 599 of the fan 592.

The motor and fan assembly 228 further includes a gasket 600 that surrounds the peripheral wall 598 of the fan 592. As best viewed in FIG. 17B, the gasket 600, which is preferably made of a resilient material, comprises an upper cylindrical wall 602 joined to a concentric lower cylindrical wall 604 of a smaller radius by a generally orthogonal step 606. The upper cylindrical wall 602 includes a plurality of arcuate apertures 608 formed therein and a circumferential flange 610 disposed on an upper edge thereof. The gasket 600 further comprises a plurality of circumferentially spaced L-shaped ribs 612 projecting radially from the upper and lower circular walls 602, 604. Each rib 612 has a generally vertical rib 614 and a generally horizontal rib 616. The generally vertical rib 614 extends from the sealing flange 610 downwardly along one end of a corresponding one of the arcuate apertures 608 to a position below the step 606, and the generally horizontal rib 616 extends orthogonally from a lower end of the vertical rib 614 and along the lower cylindrical wall 604 a distance slightly less than the length of the corresponding arcuate aperture 608. The horizontal rib 616 of one rib 612 is spaced from the vertical rib 614 of an adjacent rib 612 to form an arcuate opening 618 therebetween. Further, each horizontal rib 616 is spaced from the step 606 to form an arcuate channel 620 therebetween. The arcuate channel 620 is in fluid communication with the arcuate opening 618.

When the gasket 600 surrounds the fan 592, as best viewed in FIGS. 17A and 17C, the top, peripheral, and bottom walls 597, 598, 599 of the fan 592 are received between the sealing flange 610 and the step 606 to securely hold the fan 592 and prevent vertical movement thereof. Additionally, the outer arcuate apertures 608 are in register with the outlets 596 of the fan 592 such that the outlets 596 direct the working air exhaust through the arcuate apertures 608 and towards the corresponding vertical rib 614.

When the motor and fan assembly 228 is mounted within the motor and fan assembly housing 226, as best viewed in FIG. 17C, the inlet 594 in the bottom wall 597 of the fan 592 abuts the sealing gasket 252 on the outlet 246 of the horizontal conduit 244, and the lower cylindrical wall 604 overlaps but is spaced from the inner peripheral wall 242 of the motor and fan assembly housing 226. The ribs 612 abut an inner surface of the outer peripheral wall 240 of the motor and fan assembly housing 226 to space the upper cylindrical wall 602 from the outer peripheral wall 240. Furthermore, the sealing flange 610 rests on an upper edge of the outer peripheral wall 240 to form a seal therewith.

As a result of this configuration, the gasket 600 creates a convoluted working air exhaust path between the fan outlets 596 and the working air exhaust vents 250 located between the inner peripheral wall 242 and the outlet 264 of the horizontal conduit 244 of the motor and fan assembly housing 226. The working air exhaust path, shown with arrows in FIGS. 17A and 17C, extends from the outlet 596 and through the arcuate apertures 608 into a first space 622 between the upper cylindrical wall 602 of the gasket 600 and the outer peripheral wall 240 of the motor and fan assembly housing 226. The first space 622 is defined vertically between the sealing flange 610 and the horizontal rib 616. The working air exhaust flows toward the vertical rib 614, which directs the working air exhaust downward and into the channel 620 between the step 606 and the horizontal rib 616. The working air exhaust path changes direction and extends along the channel 620 and through the opening 618 into a second space 624 between the lower cylindrical wall 604 and the outer peripheral wall 240. The second space 624 is defined vertically between the horizontal rib 616 and the bottom wall 202 of the base housing 190. The working air exhaust flows below a lower end of the lower cylindrical wall 604 before turning upward between the lower cylindrical wall 604 and the inner peripheral wall 242 of the motor and fan assembly housing 226. Thereafter, the working air exhaust flows over the inner peripheral wall 242 and then downward towards the working air exhaust vents 250.

The gasket 600 of the motor and fan assembly 228 serves several functions. The convoluted working air path formed by the gasket 600 reduces fan noise by forcing the working air exhaust to make several turns prior to exiting the extractor 10 at the working air exhaust vents 250. Additionally, the resilient material of the gasket 600 dampens vibration of the motor and fan assembly 228. Preferably, the resilient material is a thermoplastic or thermoset rubber, and most preferably, the resilient material is ethylene propylene diene monomer (EPDM) elastomer. The gasket 600 also holds the motor and fan assembly 228 in a stabile axial position (i.e., a generally vertical position wherein a rotational axis of the fan 592 is generally perpendicular to the bottom wall 202 of the base housing 190) within the motor and fan assembly housing 226. Furthermore, the sealing flange 610 seals the fan 592 with the outer peripheral wall 240 of the motor and fan assembly housing 226 to prevent undesired escape of working air exhaust from the motor and fan assembly housing 226.

Referring again to FIGS. 10A, 12, and 13B, the agitator assembly 214 comprises dual horizontal axis brushrolls 280 oriented generally parallel to one another and parallel to the front wall 208 of the base housing 190. An axle 281 extends throughout the entire longitudinal axis of each brushroll 280 and is fixedly mounted to a corresponding axle support 265 on a corresponding end arm 282, 286 so that the brushrolls 280 rotate about their respective fixed axles 281. The end arms 282, 286 further comprise a pivot boss 263 at one end thereof. The pivot boss 263 of each end arm 282, 286 is pivotally attached to the corresponding side wall 204 of the base housing 190 on a corresponding end arm pivot pin 261. Pivotal movement of the end arms 282, 286 about the pivot pins 261 is limited in the upward direction by an upper stop 267 on the side wall 204 above the pivot pin 261 and in the downward direction by a lower stop 269 on the side wall 204 below the pivot pin 261. The assembly comprising the brushrolls 280, the axles 281, and the end arms 282, 286 forms a structure that maintains horizontal rigidity while minimizing end to end flexing or twisting by allowing the brushrolls 280 to rotate about the pivot pins 261 and thereby float over the surface to be cleaned and result in better cleaning performance. Alternatively, the agitator assembly 214 can be configured for manual height adjustment to accommodate the surface to be cleaned. For example, the brushrolls 280 should optimally be set at a higher height for a deep plush carpet than for a Berber carpet. Any suitable type of agitator height adjustment mechanism, such as those known for use with vacuum cleaners, can be employed for adjusting the height of the brushrolls 280.

The agitator assembly 214 is operably connected to a pinion gear 285 affixed to a drive shaft 284 of the agitator motor 220 through a main drive belt 283 coupled to a drive gear 287 on one end of one of the brushrolls 280, as is well known in the extractor and vacuum cleaner arts. The motor drive shaft 284 and the pinion gear 285 extend through the side wall 204 of the base housing 20 for connecting with the main drive belt 283. Additionally, the agitator assembly 214 comprises a brushroll belt 289 that rotatably couples the brushrolls 280 to one another so that rotation of the brushroll 280 connected to the main drive belt 283 induces rotation of the other brushroll 280. Optionally, the brushroll belt 289 can be adapted to rotate the brushrolls 280 in the same or opposite directions.

One advantage of the described dual belt drive system is that twisting of the brushrolls 280 in a longitudinal direction is minimized and this feature, in combination with the pivoting floating feature previously described, provides more even contact of the brushrolls 280 across the surface to be cleaned, resulting in improved cleanability. Additional improvements in cleanability are obtained by using two or more brushrolls 280, thereby increasing the weight of the agitator assembly 214 which provides a higher agitation force on the surface to be cleaned, thereby further improving brushroll 280 engagement with the surface to be cleaned that results in better cleaning.

Figure 12:
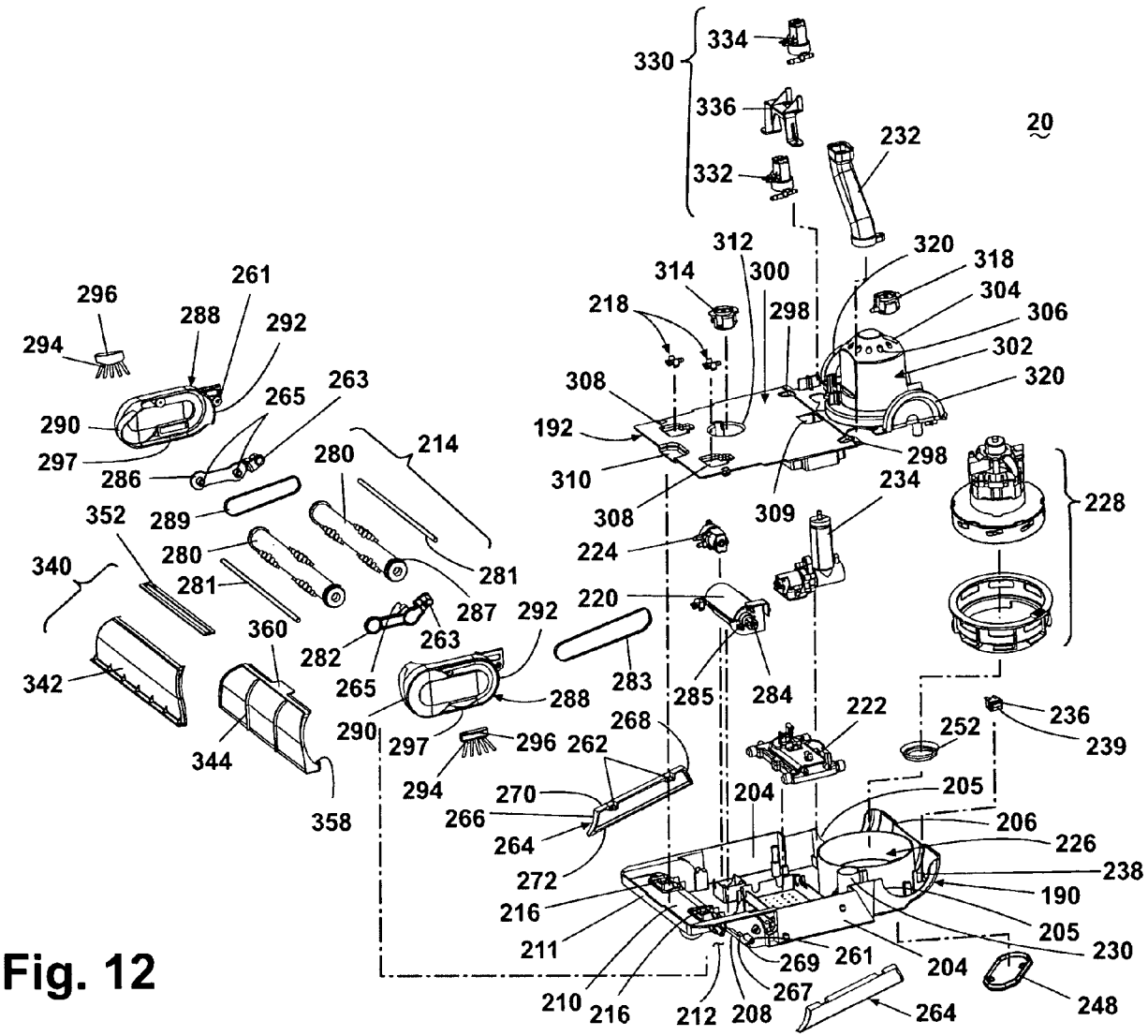
FIG. 12 is an exploded view of the base assembly of FIG. 5.
Figure 18:
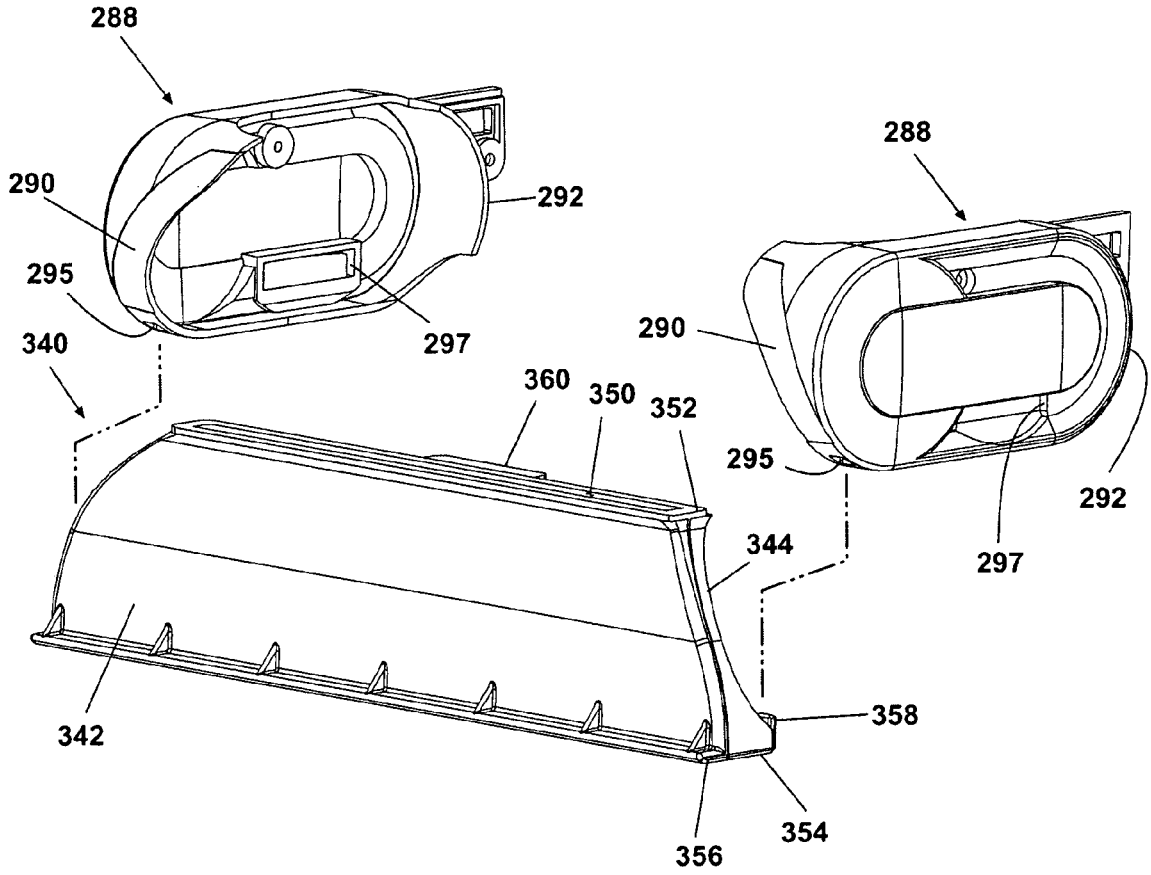
FIG. 18 is an enlarged view of a nozzle assembly and end caps from the base assembly of FIG. 5.

The agitator cavity 212 is accessible for replacing or repairing the agitator assembly 214. An end cap 288 is removably mounted to each of the base housing 190 by mechanical fasteners, such as with screws or detents. As best seen in FIGS. 1, 12, and 18, the end caps 288 have an elongated oval shape with curved front and rear ends 290, 292 and carry agitators in the form of stationary, optionally removable edge brushes 294. The rear curved ends 292 abut the arcuate front edges 266 of the lower side rails 264 and the arcuate front edges 132 of the upper side rails 130 when the recovery tank assembly 22 is mounted to the base assembly 20. The edge brushes 294 can be mounted to the end caps 288 in any suitable manner, such as by a press-fit or with mechanical fasteners. In the illustrated embodiment, the end edge brushes 294 comprise a brush block 296 that is snap-fit into a correspondingly shaped brush block receiver aperture 297 in the respective end cap 288. The brush blocks 296 can be inserted into the brush block receiver apertures 297 from either side of the end caps 288. Additionally, each end cap 288 includes a nozzle assembly mounting opening 295 in the curved front end 290. In one embodiment, the end caps 288 are translucent so that the agitator assembly 214 is at least partially visible to the user. In another embodiment, the end caps 288 are colored for aesthetic purposes.

Figure 10C:
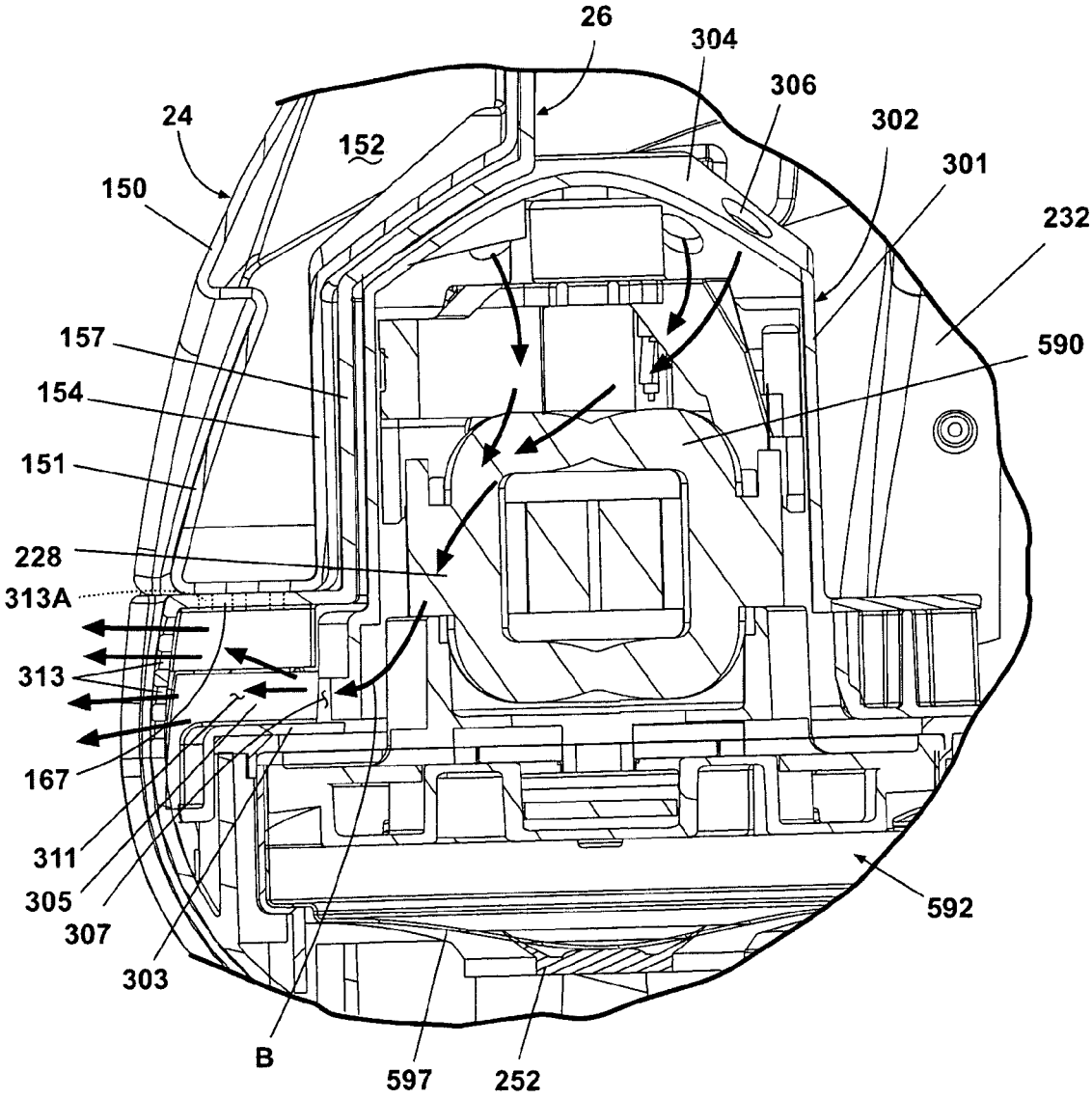
FIG. 10C is an enlarged view of the region marked 10C in FIG. 10A.
Figure 16:
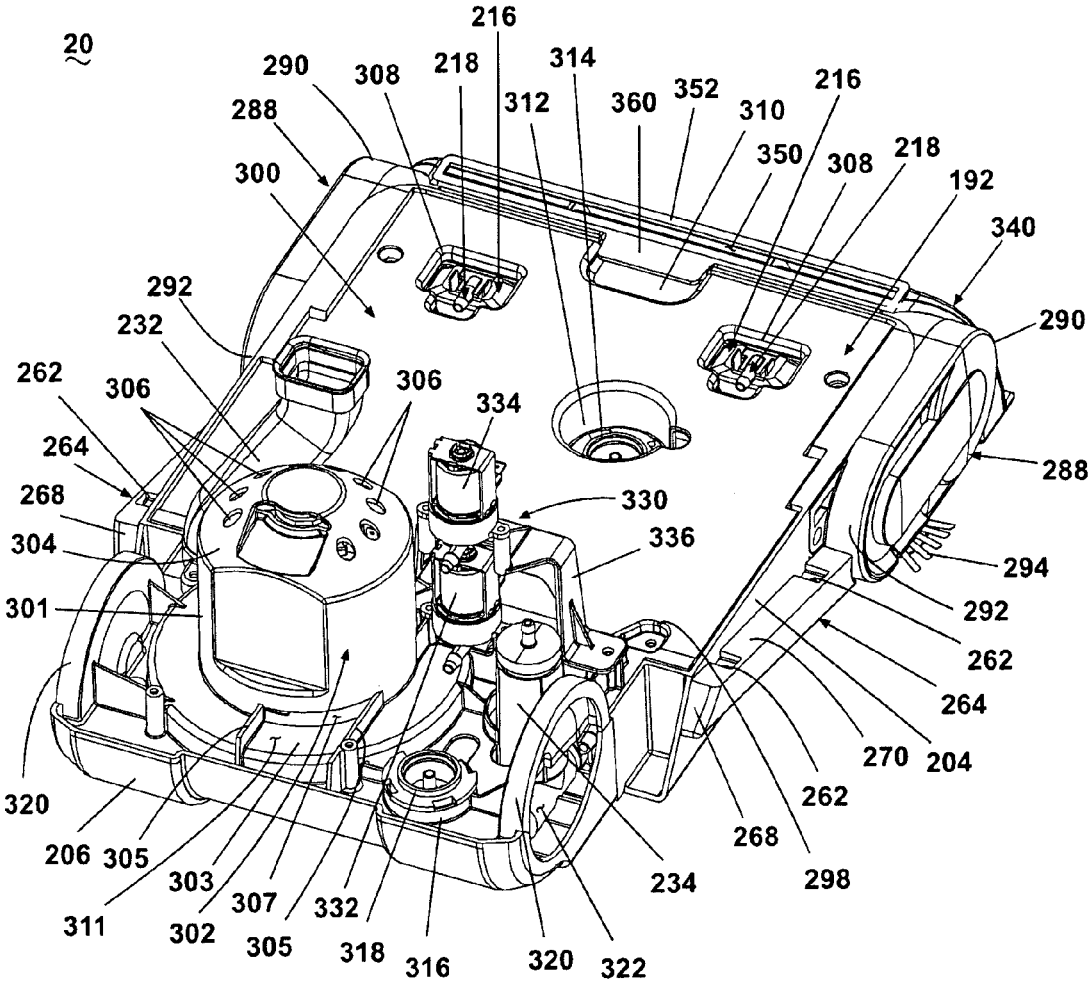
FIG. 16 is a rear perspective view of the base assembly of FIG. 5.

As shown in FIGS. 12 and 16, the base housing cover 192 comprises a generally planar front portion 300 and an integral rear portion 302 that is covered by the foot assembly cover 26, whose mounting tabs 159 are secured to the base housing cover 192 at corresponding mounting tab receivers 298 located at the juncture between the front portion 300 and the rear portion 302. The front portion 300 includes a pair of spaced spray tip openings 308, a shallow depression 310 at a forward end, a depression 309 sized and positioned to accommodate the tank leveling member 42 of the recovery tank assembly 22, and a centrally located recess 312 for holding a valve seat 314 that receives the valve mechanism 48 in the recovery tank assembly 22. The rear portion 302 has a motor and fan assembly cover 304 sized to overlie the motor and fan assembly 228 above the motor and fan assembly housing 226. The motor and fan assembly cover 304 comprises an upper motor cover 301 and a lower fan cover 303 and includes a plurality of cooling air inlet apertures 306 at an upper end of the motor cover 301. A rearward facing single cooling air exhaust aperture 307 is formed in the motor cover 301 at the junction between the motor cover 301 and the fan cover 303, and cooling air exhaust drawn into the cooling air inlet apertures 306 by a commonly known cooling air fan (not shown) flows over the motor 590 and through the cooling air exhaust aperture 307. The cooling air exhaust aperture 307 is in fluid communication with a cooling air exhaust conduit 311 formed horizontally between a pair of ribs 305 extending upward from the fan cover 303 and vertically between the fan cover 303 and the solution supply tank support 167 of the foot assembly cover 26 (FIG. 10C). The cooling air exhaust conduit 311 directs the cooling air exhaust from the cooling air exhaust aperture 307 to the cooling air vents 313 (FIGS. 3, 4, and 11B) in the foot assembly cover 26 to exhaust motor cooling air from the extractor 10 and into the atmosphere, as illustrated by arrows in FIG. 10C.

Referring again to FIG. 16, openings in the rear portion 302 allow the transfer conduit 232 and the pump assembly 234 to extend from below the base housing cover 192 to above the base housing cover 192. The rear portion 302 also includes a rear recess 316 for supporting a valve seat 318 that is positioned beneath the solution supply tank valve mechanism opening 169 (FIG. 11B) of the foot assembly cover 26. The valve seat 318 receives the valve mechanism 158 of the solution supply tank assembly 24 when the solution supply tank assembly 24 is mounted to the foot assembly 12. The rear portion 302 further comprises a pair of semicircular lobes 320 that mate with the base housing 190 at the semicircular cutouts 205 to define a pair of circular openings 322 to facilitate mounting the handle assembly 14 to the foot assembly 12, as will be described in more detail hereinafter.

Mounted on an upper surface of the rear portion 302 is a metering valve assembly 330 comprising a first metering valve 332, a second metering valve 334, and a valve bracket 336 for supporting the second metering valve 334 above the first metering valve 332. The first and second metering valves 332, 334 have inlets in fluid communication with the valve mechanism 158 of the solution supply tank assembly 24 and outlets in fluid communication with an inlet of the pump assembly 234. The outlets of the first and second metering valves 332, 334 have metering orifices (FIGS. 25A-25D) of different size that meter the amount of fluid that flows therethrough, as will be described in more detail below.

Referring now to FIGS. 10A, 10D, 12, 15, 16, and 18, the base assembly 20 further comprises a nozzle assembly 340 removably mounted to a forward portion thereof. The nozzle assembly 340 is formed by a forward section 342 and a rearward section 344 that join to form a fluid flow path 346 therebetween. The fluid flow path 346 begins at an elongated nozzle opening 348 positioned adjacent a surface to be cleaned and terminates at an elongated outlet 350 surrounded by a gasket 352 at an upper portion of the nozzle assembly 340. As best viewed in FIG. 10A, each of the forward and rearward portions 342, 344 of the nozzle assembly 340 have generally flat glide surfaces 354, 356, respectively, at a lower portion thereof. The glide surfaces 354, 356 rest on the surface to be cleaned and help distribute the weight of the extractor 10 over a relatively large surface area. Consequently, the foot assembly 12 can easily glide over the surface to be cleaned thereby reducing perceived exertion by the user during operation of the extractor 10. Optionally, the glide surface 354, 356 can be incorporated into a shoe that can be removably mounted to the nozzle assembly 340 at the nozzle opening 348 rather than forming the glide surfaces 354, 356 integrally with the nozzle assembly 340. For example, the glide shoe can be configured to be snapped onto or slid onto the nozzle assembly 340.

Figure 10D:
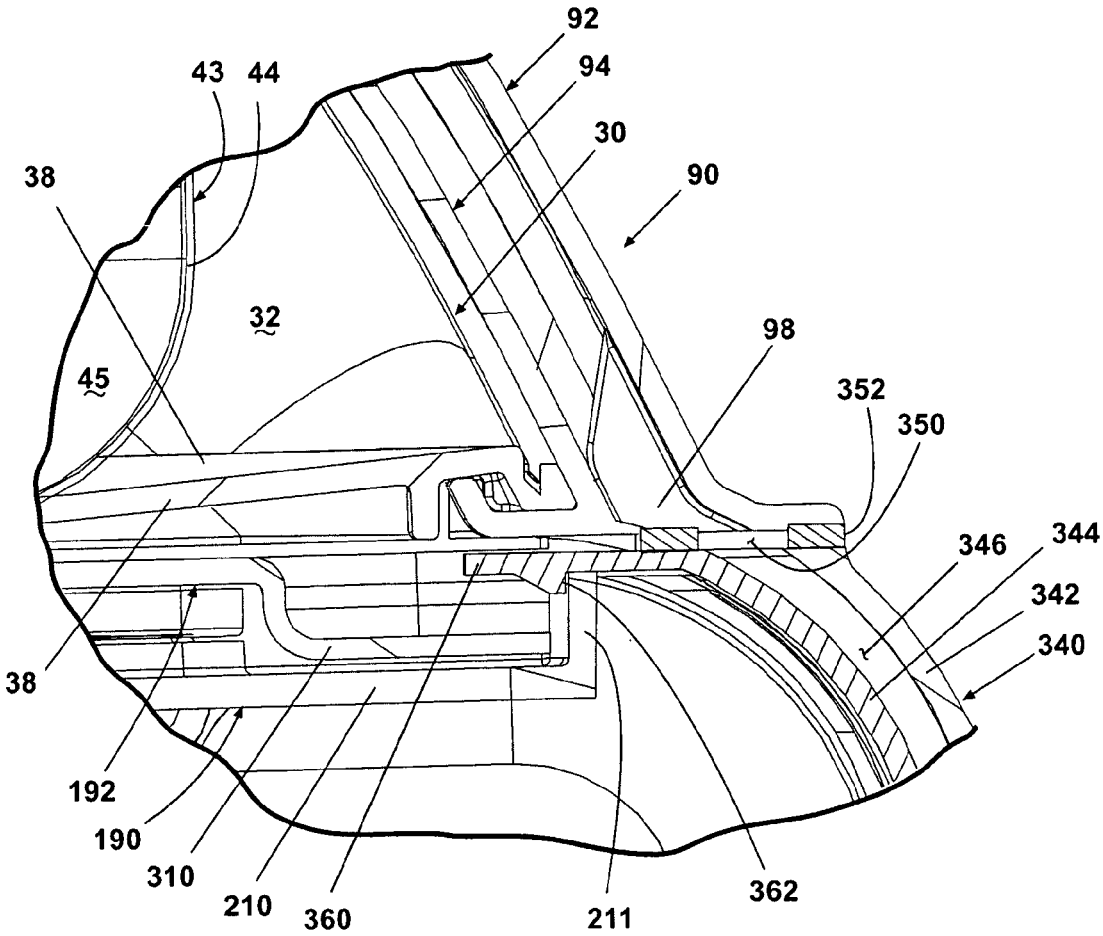
FIG. 10D is an enlarged view of the region marked 10C in FIG. 10A.
Figure 11A:
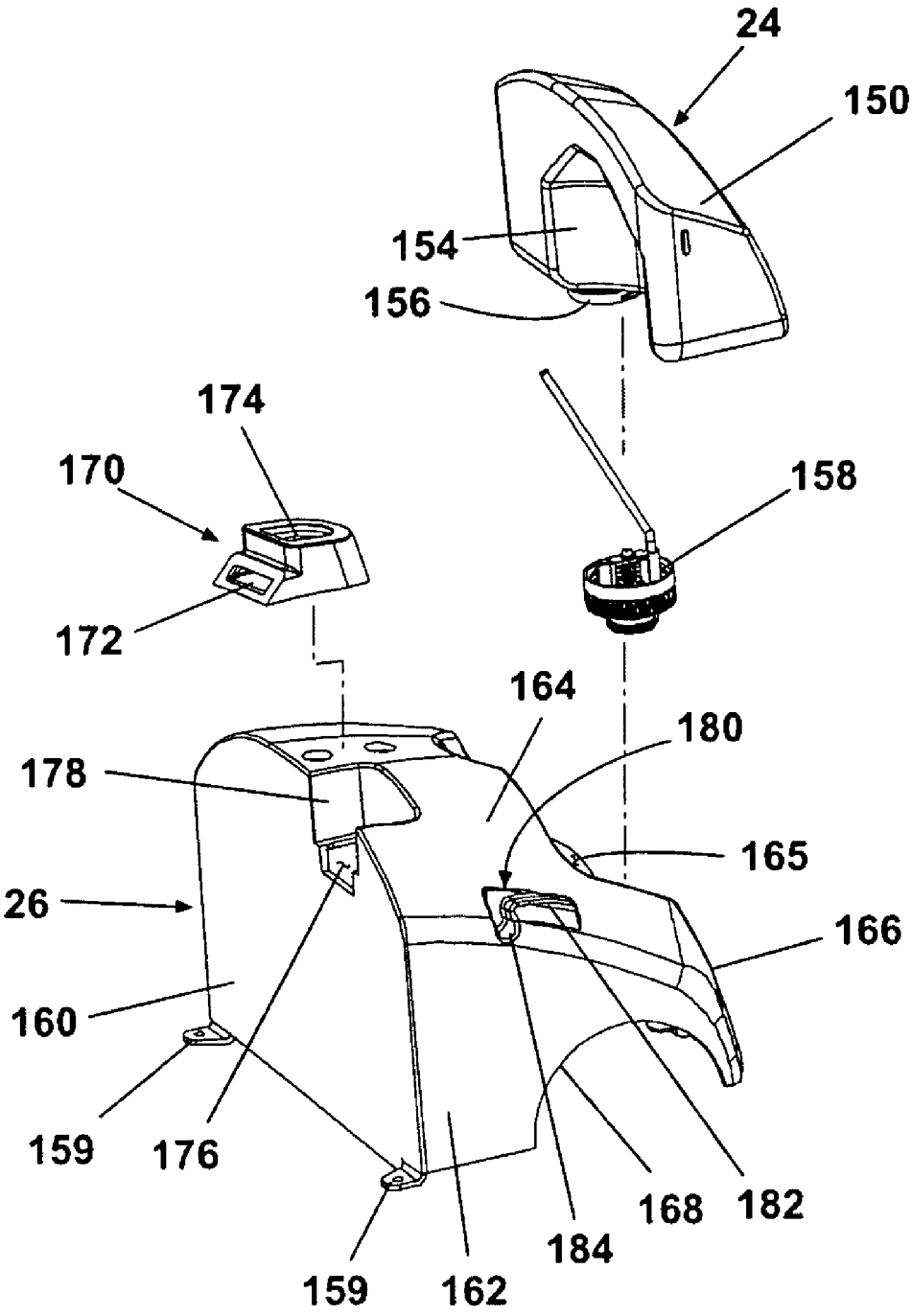
FIG. 11A is a front exploded view of the solution supply tank assembly and the foot assembly cover of FIG. 5.
Figure 11B:
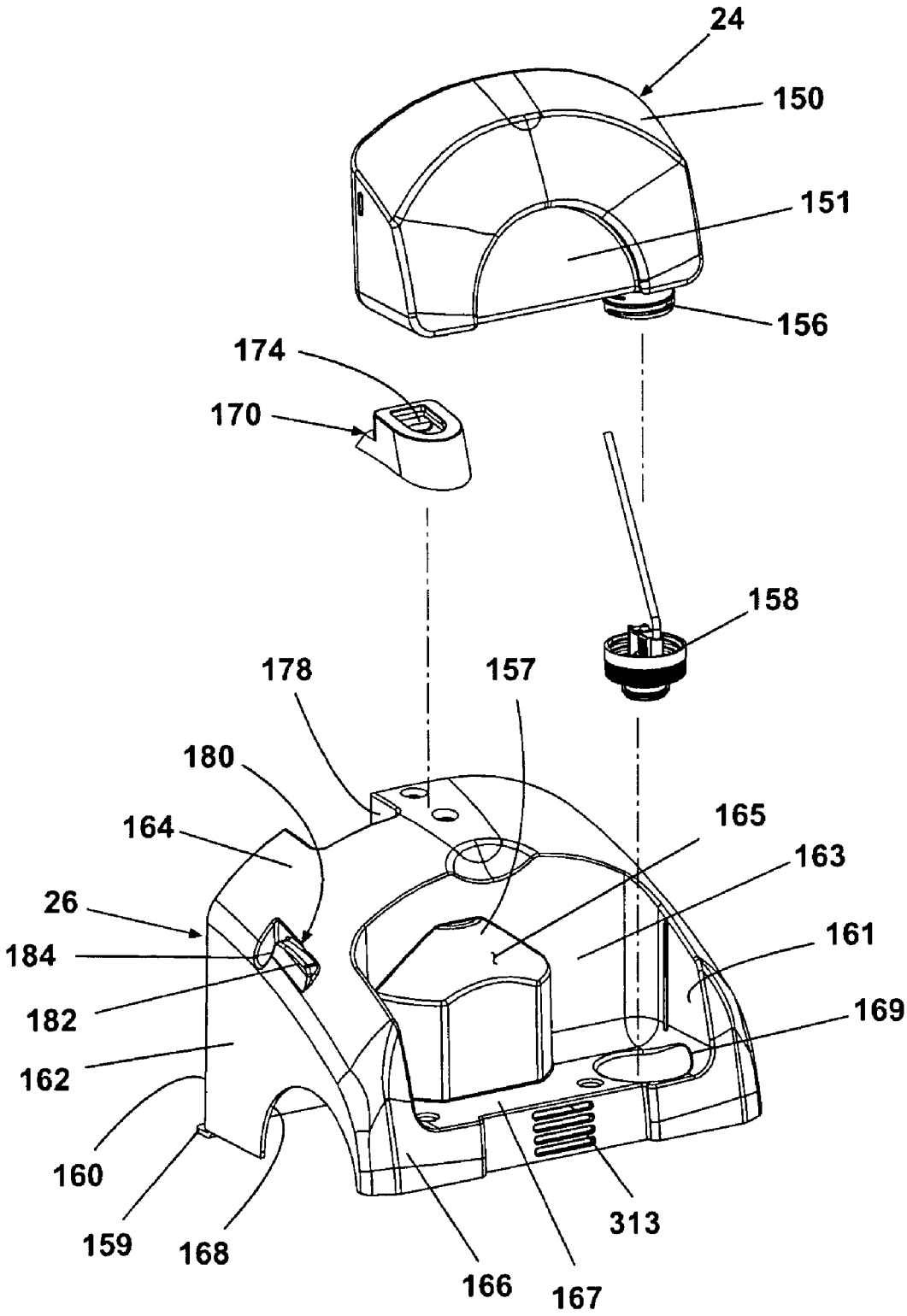
FIG. 11B is a rear exploded view of the solution supply tank assembly and the foot assembly cover of FIG. 5.

The nozzle assembly 340 further includes on the rearward portion 344 a pair of projections 358 extending upwardly from opposite ends thereof and a rearwardly extending tab 360 at the upper portion thereof for removably mounting the nozzle assembly 340 to the base assembly 20. The projections 358 are removably received in the nozzle assembly mounting openings 295 in the curved front ends 290 of the end caps 288, and the tab 360 is sized to be received in the depression 310 of the base housing cover 192 and includes a downwardly projecting prong 362 that abuts a rear side of the lip 211 of the agitator housing upper wall 210 to secure the nozzle assembly 340 to the base housing 20, as best viewed in FIG. 10D. The recovery tank assembly 22 must be removed from the base housing 20 in order to mount the nozzle assembly 340 to or remove it from the base housing 20. To mount the nozzle assembly 340 to the base housing 20, the projections 358 are inserted into the nozzle assembly mounting openings 295 in the end caps 288, and the nozzle assembly 340 is pivoted toward the base housing 20, whereby the tab 360 enters the depression 310 and the prong 362 rides over the lip 211 before snapping into place in the depression 310, as shown in FIG. 10D. To remove the nozzle assembly 340, the user pulls up slightly on the tab 360 so that the prong 362 can clear to the lip 211 and pulls the nozzle assembly 340 forward to pivot the nozzle assembly 340 away from the base housing 20 and remove the projections 358 from the nozzle assembly mounting openings 295 in the end caps 288. When the nozzle assembly 340 and the recovery tank assembly 22 are mounted to the base assembly 20, the elongated outlet 350 mates with the nozzle conduit inlet 98 of the nozzle conduit section 96 of the recovery tank inlet conduit 90 to thereby form a continuous working air path is formed through the nozzle assembly 340 and through the nozzle conduit section 96 of the recovery tank inlet conduit 90.

Figure 19:
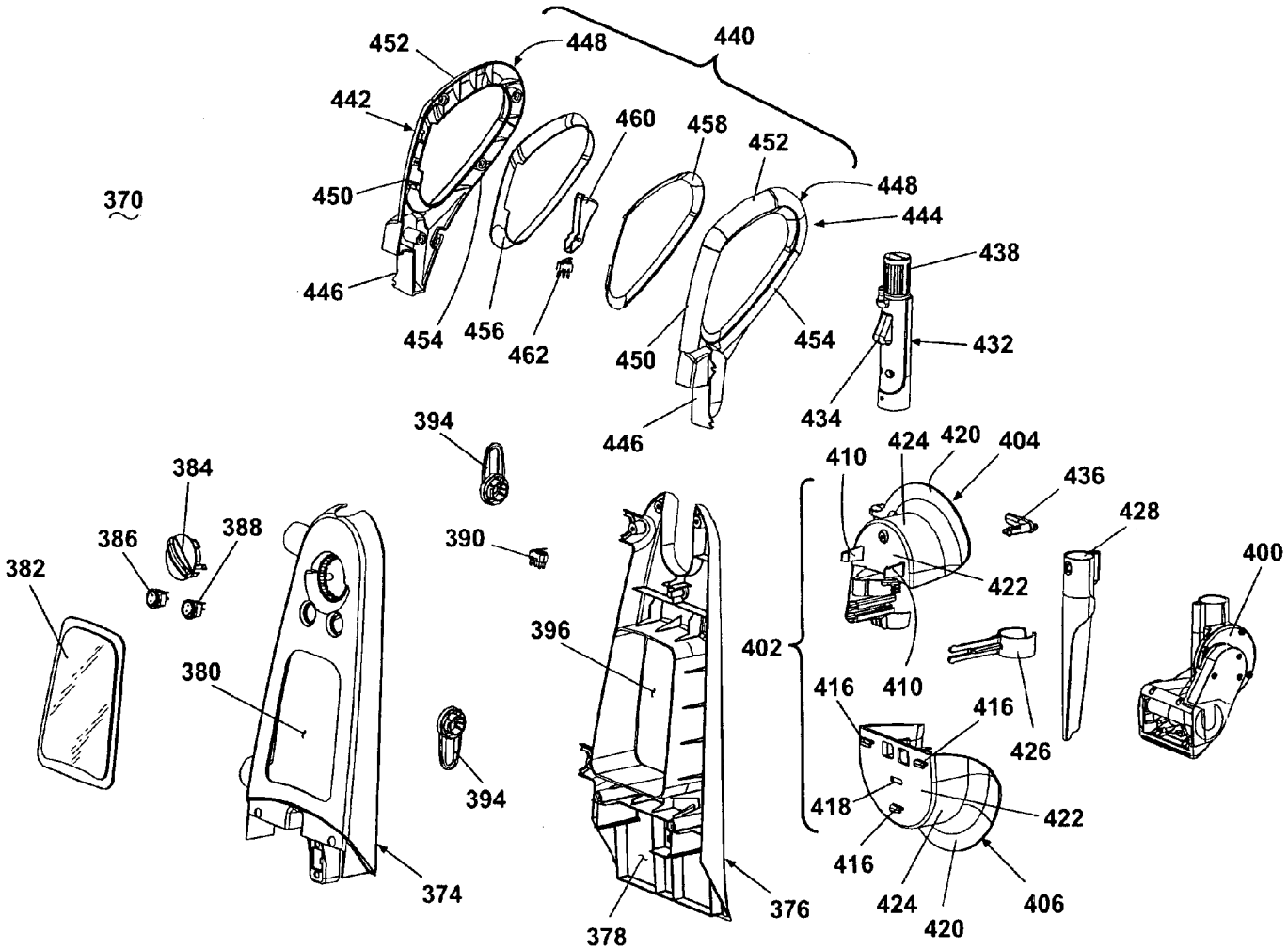
FIG. 19 is an exploded view of the upper handle of the handle assembly of FIG. 5.
Figure 20:
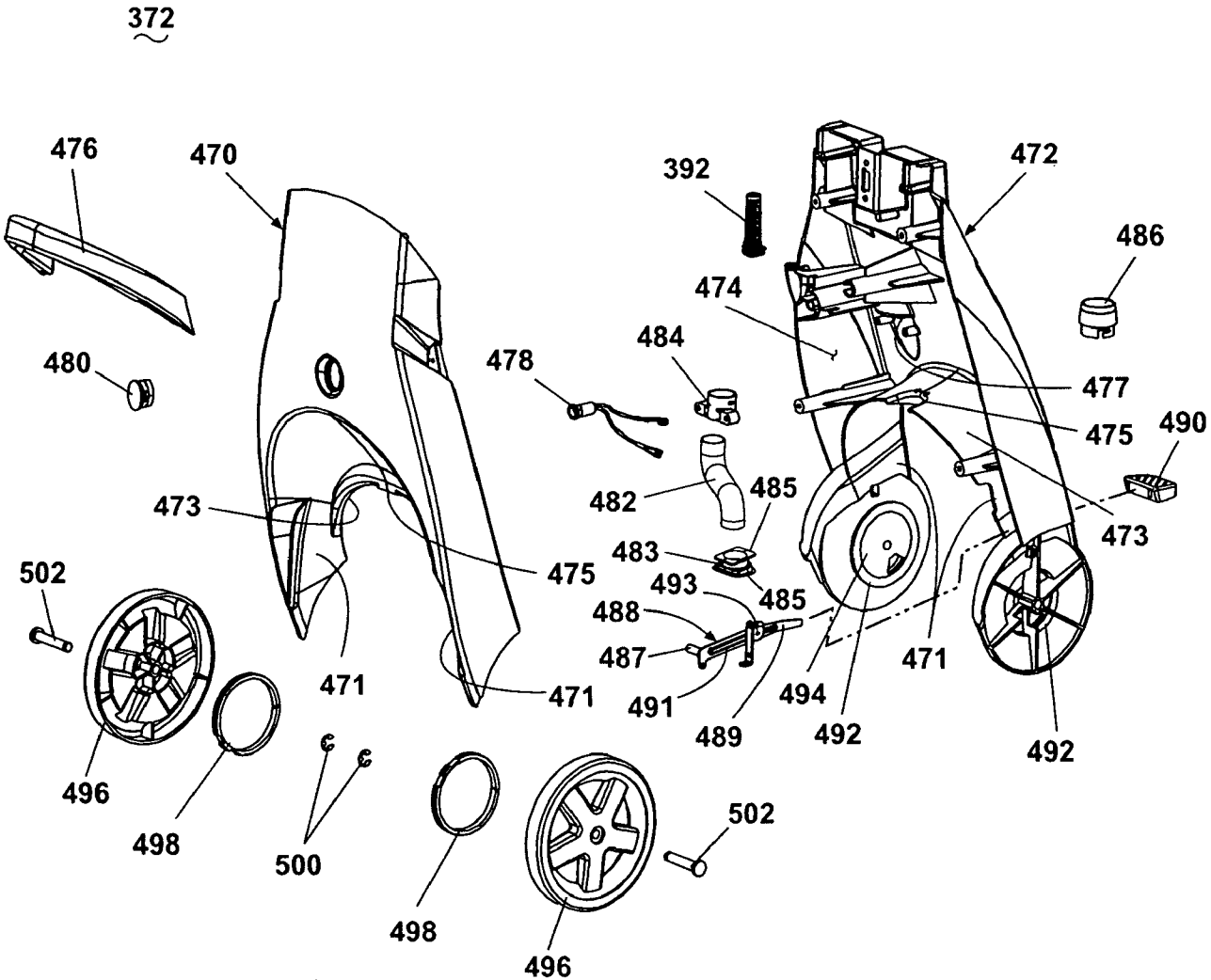
FIG. 20 is an exploded view of the lower handle of the handle assembly of FIG. 5.

Referring now to FIGS. 5, 19, and 20, the handle assembly 14 comprises an upper handle 370 removably mounted to a lower handle 372. As shown in FIGS. 5 and 19, the upper handle 370 is formed by a forward shell 374 and a rearward shell 376 that mate to form an upper handle cavity 378 therebetween. The forward shell 374 has an optional opening 380 that is closed by a translucent window 382. Above the opening 380, the forward shell 374 mounts a plurality of controls, including a cleaning mode knob 384, a main power switch 386, and a heater switch 388. The cleaning mode knob 384 is operatively connected to a cleaning mode switch 390 mounted in the upper handle cavity 378 and electrically connected to the first and second metering valves 332, 334, and the operation of the cleaning mode knob 384 will be described in more detail hereinafter. The heater switch 388 functions to activate the heater 222 when heated cleaning is desired, and the main power switch 386 is operatively connected to the motor and fan assembly 228, the pump assembly 234, the agitator motor 220, and a power cord 392 mounted to the lower handle 372. The entire power cord 392 is not shown in the figures, but it can be wrapped around a pair of cord wraps 394, as is well known in the extractor and vacuum cleaner arts. The power cord 392 can be coupled to a source of power, such as a home power supply. Alternatively, the extractor 10 can be powered by a portable power supply, such as a battery. The cord wraps 394 are held between the forward and rearward shells 374, 376 and can be rotated to quickly release the wrapped power cord 392, as is also well known in the extractor and vacuum cleaner arts.

The rearward shell 376 forms an accessory cavity 396 sized to mate with the opening 380 and the window 382 and to store a power brush accessory tool 400 or other suitable accessory tool. The accessory cavity 396 is closed by the window 382 so that a user can view the power brush accessory tool 400 from a front side of the extractor 10 and is open at a rear side of the rearward shell 376 so that the user can access the power brush accessory tool 400 from behind the extractor 10. Optionally, the accessory cavity 396 can include tool mounting fixtures for retaining the accessory tools therein.

Figure 21:
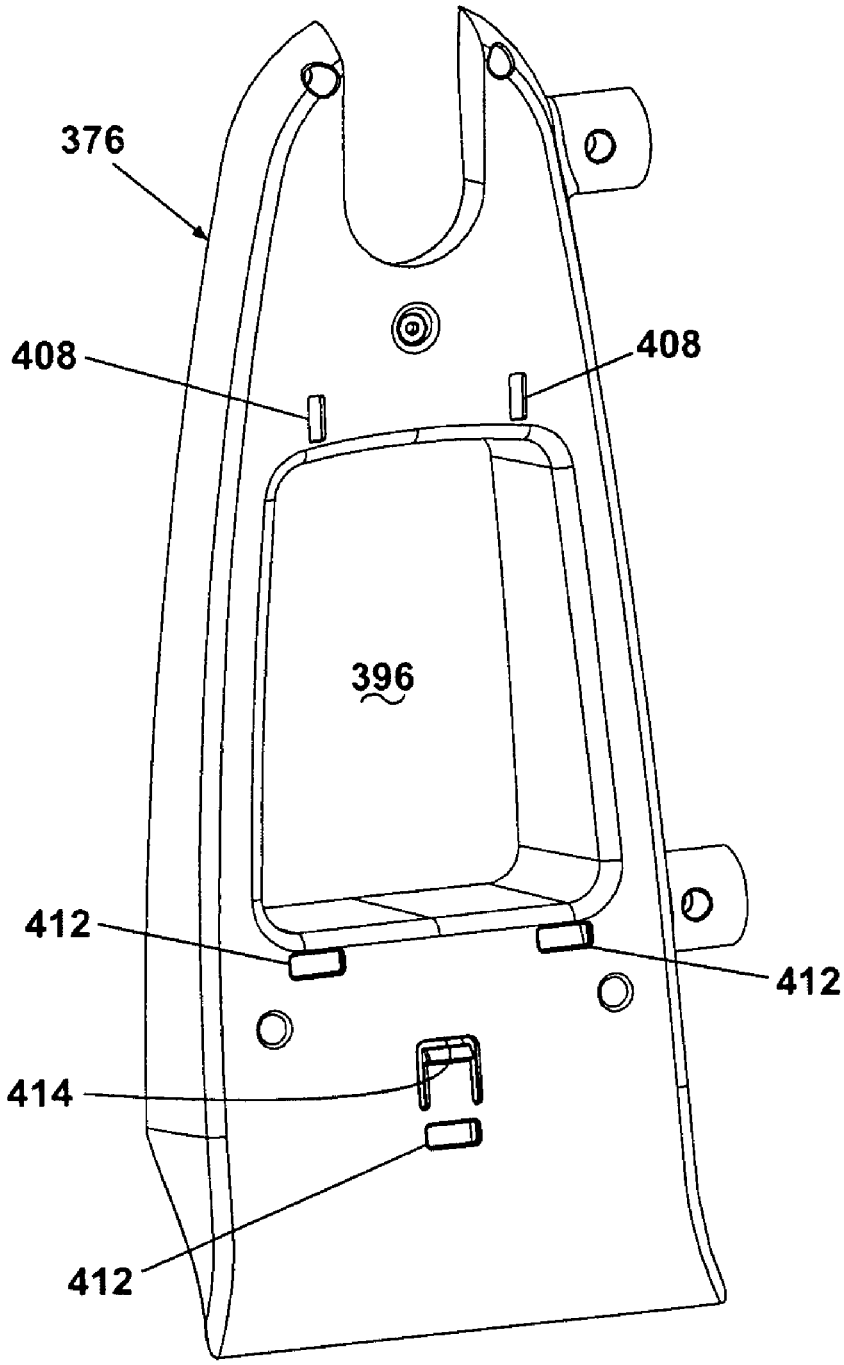
FIG. 21 is a rear perspective view of a rearward shell of the upper handle from the handle assembly of FIG. 5.

Referring additionally to FIG. 21, the rearward shell 376 removably mounts a tool and hose wrap caddy 402. The caddy 402 is formed by an upper section 404 and a lower section 406, with each section being independently mounted to the rearward shell 376. Each of the upper and lower sections 404, 406 comprises a base wall 422 integral with an arcuate peripheral wall 424 and an arcuate flange 420. The peripheral wall 424 and the arcuate flange 420 are sized to hold an accessory hose 430 (shown only in FIGS. 3 and 4) between the peripheral wall 420 and the rearward shell 376 when the caddy 402 is mounted to the rearward shell 376. The power brush accessory tool 400 in the accessory cavity 396 remains accessible when the accessory hose 430 is wrapped around the caddy 402. The upper section 404 is adapted to slidably receive a crevice tool mount 426 for holding a crevice tool 428 and to support an accessory tool handle 432 having an accessory tool fluid trigger 434 and a stem 438 for mounting an accessory tool. A rotatable arm 436 on the upper section 404 helps to releasably secure the accessory tool handle 432 to the caddy 402. The lower section 406 includes a pair of opposed projections 437 (FIG. 3) for holding another accessory tool.

The rearward shell 376 includes a pair of slits 408 that receive a pair of tangs 410 located on the base wall 422 of the upper section 404 for securing the upper section 404 to the rearward shell 376. To mount the lower section 406, the rearward shell 376 has a set of three apertures 412 arranged in a generally inverted triangular configuration with a rearwardly facing, resilient tang 414 located above the lowermost aperture 412. The apertures 412 are sized to receive correspondingly spaced downward facing L-shaped flanges 416 disposed on the base wall 422 of the lower section 406, and the lower section 406 has an aperture 418 located centrally on the base wall 422 relative to the L-shaped flanges 416 and sized to receive the tang 414. To mount the lower section 406 to the rearward shell 376, the L-shaped flanges 416 are inserted into the apertures 412 such that the aperture 418 is positioned above the tang 414. Next, the lower section 406 is slid downward relative to the rearward shell 376, whereby the L-shaped flanges 416 engage a lower edge of the apertures 412, and the aperture 418 moves downwardly so that the tang 414 engages the aperture 418 to secure the lower section 406 in place.

A handle grip 440 mounted to an upper portion of the upper handle 370 facilitates movement of the extractor 10 by the user across the surface to be cleaned. The handle grip 440 is formed by two mating halves 442, 444 and comprises a stem 446 for mounting the handle grip 440 to the upper handle 370 and an integral, generally triangular grip portion 448 with arcuate corners. The grip portion 448 is formed by a generally vertical, upright section 450 joined at an obtuse angle to one end of an upwardly and rearwardly extending hand section 452 and a connecting section 454 that connects an opposite end of the handle section 452 to the upright section 450 at the stem 446. Optionally, the handle grip 440 can include comfort grips 456, 458 made of rubber or other suitable polymer to provide a comfortable gripping surface for the user's hand and positioned on the interior of the grip portion 448. The handle grip 440 further comprises a fluid trigger 460 secured between the mating halves 442, 444 and operatively coupled to a trigger switch 462 located in a cavity formed between the mating halves 442, 444. As will be discussed in more detail hereinafter, the trigger switch 462 is electrically coupled to the spray tip valve 224 in the foot assembly 12.

Referring again to FIGS. 5 and 20, the lower handle 372 is formed by a forward shell 470 and a rearward shell 472 that mate to form a lower handle cavity 474 therebetween. Each of the forward and rearward shells 470, 472 is generally U-shaped with downwardly extending spaced legs 471 joined by an arched wall 473. A conduit opening 475 in the arched walls 473 supports an accessory conduit fitting 483 incorporating a pair of spaced ribs 485 and a channel therebetween sized to the thickness of the arched wall 473 for mounting the conduit fitting 483 to the arched wall 473. A portion of the accessory conduit fitting 483 protrudes below the arched wall 473 and mates with the inlet 174 of the accessory conduit connector 170 when the handle assembly 14 is in the upright position, as shown in FIG. 10A. The interface between the conduit fitting 483 and conduit connector 170 is sealed with a resilient gasket. An accessory conduit 482 is attached to the opposite end of the accessory conduit fitting 483 in the lower handle cavity 474, and an accessory conduit coupling 484 is mounted to the other end of the accessory conduit 482.

The rearward shell 472 includes an aperture 477 through which the accessory conduit coupling 484 extends to mate with an accessory hose coupling 486, which is accessible from the rear of the handle assembly 14. The opposite end of the accessory hose coupling 486 is sealingly connected to the accessory hose 430 thereby forming an accessory tool working air path from the accessory hose 430 and through the interior of the lower handle 372 via the accessory conduit 482. As a result of this configuration, a continuous accessory tool working air path is formed from the accessory hose 430 to the accessory conduit section 100 of the recovery tank inlet conduit 90 when the handle assembly 14 is in the upright position. The accessory hose coupling 486 removably mates with the accessory conduit coupling 484 via a commonly known bayonet twist-lock mechanism, which allows for the accessory hose 430 to be removed from the extractor 10, if desired.

The forward shell 470 mounts a carry handle 476, which facilitates carrying the extractor 10 from one location to another when it is not in use, and a heater indicator lens 480 to enhance visibility of a heater indicator 478, such as a light source, mounted in the lower handle cavity 474 behind the heater indicator lens 480. The heater indicator 478 is in operable communication with the heater 222 for communicating to the user an operational status of the heater 222. For example, the heater indicator 478 can indicate when the heater 222 has reached a predetermined temperature for heated cleaning or when fluid is flowing through the heater 222 for heated cleaning.

Figure 22:
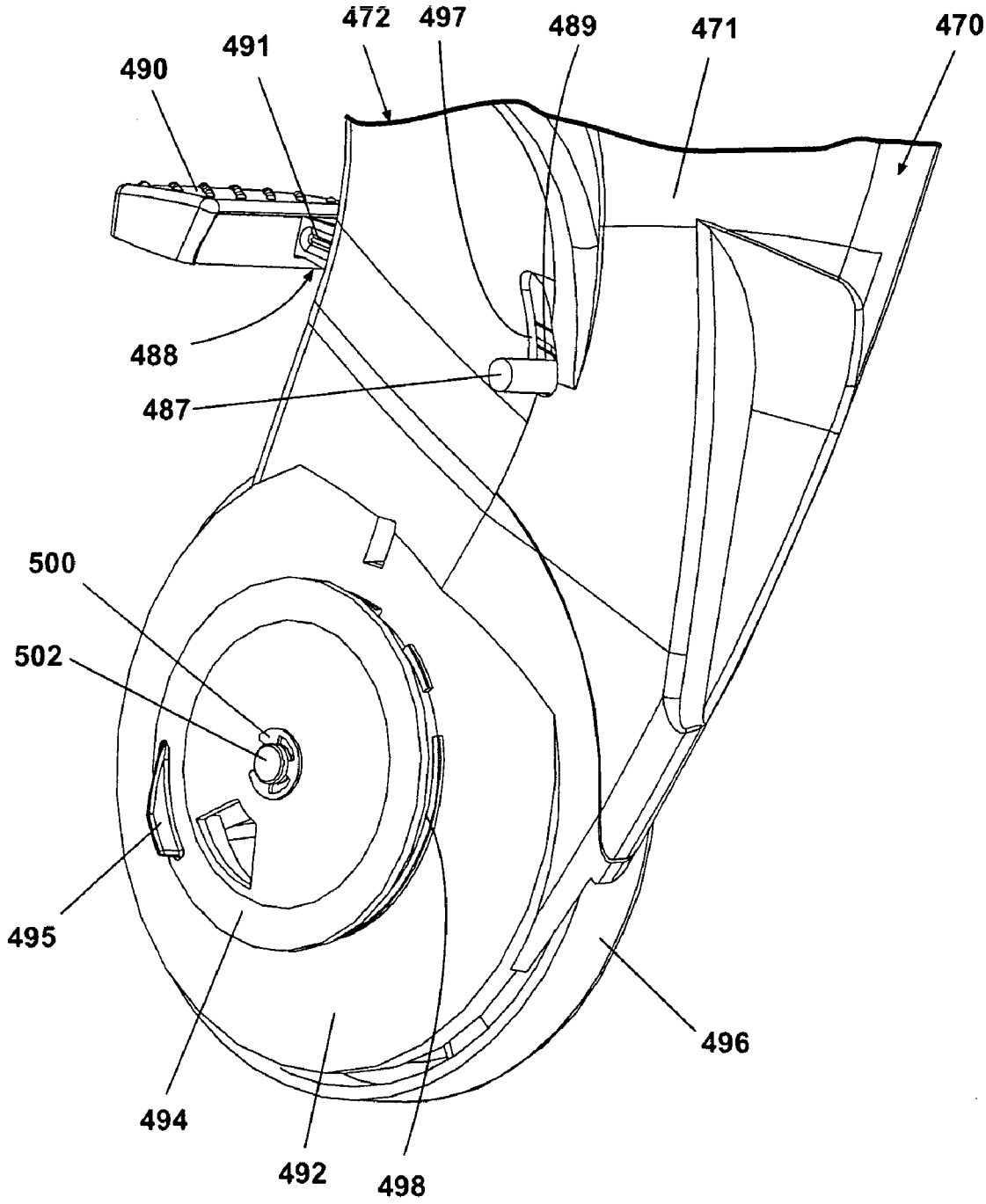
FIG. 22 is an enlarged perspective view of a leg of the lower handle from the lower handle assembly of FIG. 5.

With continued reference to FIG. 18 and additional reference to FIG. 22, the handle assembly 14 is pivotally connected to the foot assembly 12 through a pair of trunnions 492 disposed at the ends of the legs 471 on the rearward shell 472. The trunnions 492 each include a circular bearing 494 sized to be rotatably received in the circular openings 322 formed between the base housing 190 and the base housing cover 192 (FIG. 16) and held therein by bearing retainers 498. One of the bearings 494 includes an inwardly projecting, ramped agitator motor switch actuator 495, as best viewed in FIG. 22, that depresses the actuation button 239 of the agitator motor switch 236 (FIG. 15) when the handle assembly 14 is in the upright position. Additionally, wheels 496 are rotatably mounted to outer sides of the trunnions 492 through axles 502. The axles 502 are secured in place by retaining clips 500 positioned adjacent the bearings 494. The wheels 496 partially support the foot assembly 12 on the surface to be cleaned, and the axles 502 provide a pivot axis for pivotal movement of the handle assembly 14 relative to the foot assembly 12.

Figure 23:
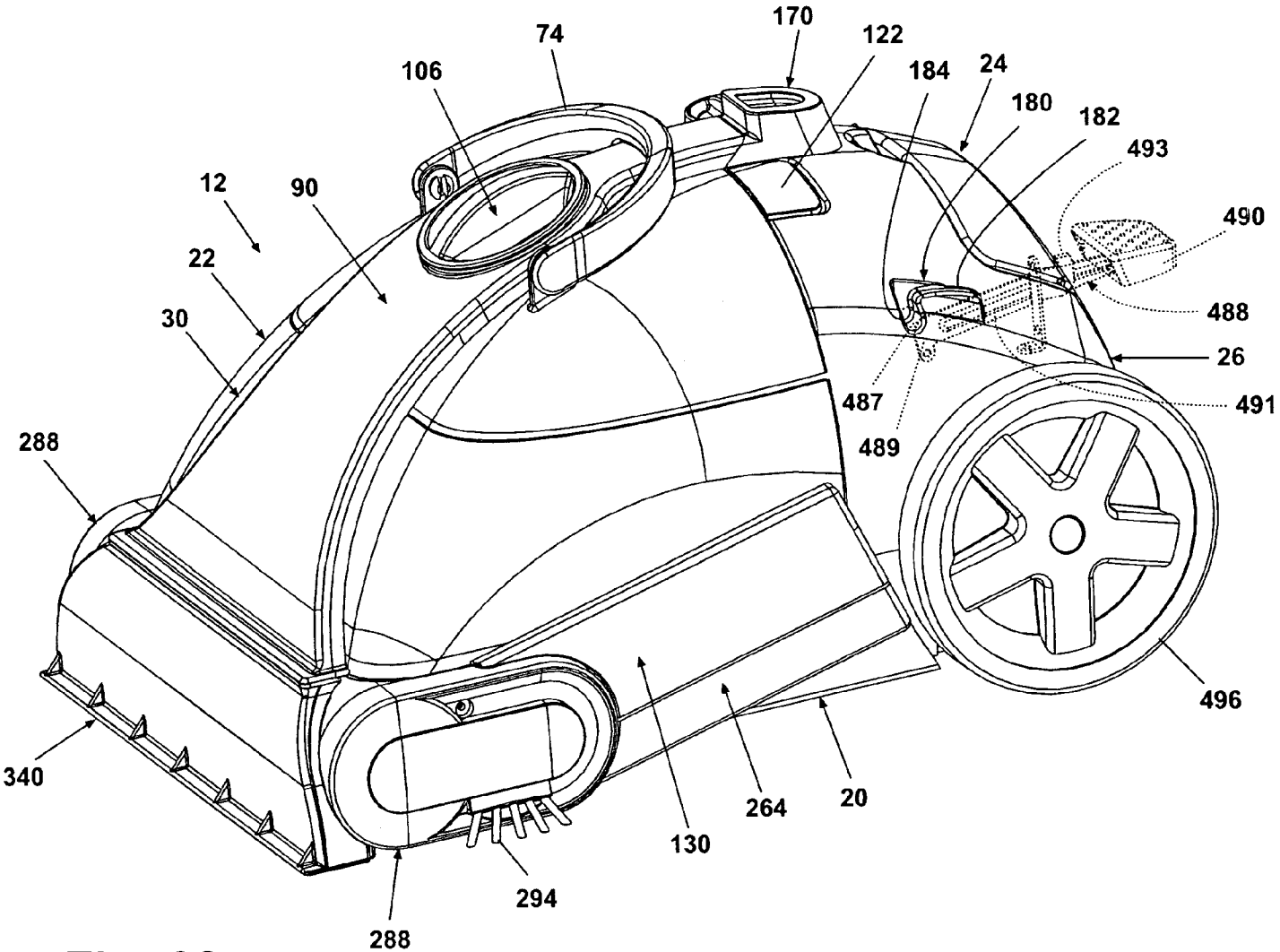
FIG. 23 is a perspective view of the foot assembly of FIG. 5 with a foot pedal from the handle assembly of FIG. 5 shown in phantom.

With additional reference to FIG. 23, the rearward shell 472 supports a pedal 490 connected to a lever mechanism 488 located in the lower handle cavity 474. The lever mechanism 488 comprises a bracket 493 fixedly mounted to the rearward shell 472 and an arm 489 slidably and pivotably mounted to the bracket 493 through an elongated slot 491. A rearward end of the arm 489 extends through the rearward shell 472 and is fixedly mounted to the pedal 490, and a forward end of the arm 489 terminates at a generally orthogonal retaining pin 487 that projects through an arcuate aperture 497 formed between the rearward shell 472 and the forward shell 470 on one of the legs 471, as best viewed in FIG. 22, and sized to accommodate movement of the retaining pin 487. As illustrated in FIG. 23, where the pedal 490 and the lever mechanism 488 are shown in phantom, the retaining pin 487 resides in the detent 184 of the handle retainer 180 in the foot assembly cover 26 to secure the handle assembly 14 in the upright position. To pivot the handle assembly 14 relative to the foot assembly 12, the user depresses the pedal 490 so that the arm 489 pivots about the bracket 493 to thereby displace the retaining pin 487 upward and out of the detent 184. When the retaining pin 487 is free from the detent 184, the user can pivot the handle assembly 14 rearwardly whereby the retaining pin 487 rides along the ramp 182 while the arm 489 slides rearwardly relative to the bracket 493. To return the handle assembly 14 to the upright position, the user pivots the handle assembly 14 forward, and the retaining pin 487 rides along the ramp 182 until it slides into a locked position in the detent 184. The locking action of the retaining pin 487 in the detent 184 ensures that the accessory conduit fitting 483 and the accessory conduit connector 170 are sealingly mated (FIG. 10A) when the handle assembly 14 is in the upright position so that there is not a loss of suction at this juncture when the extractor 10 is operated in the accessory cleaning mode.

Figure 24:
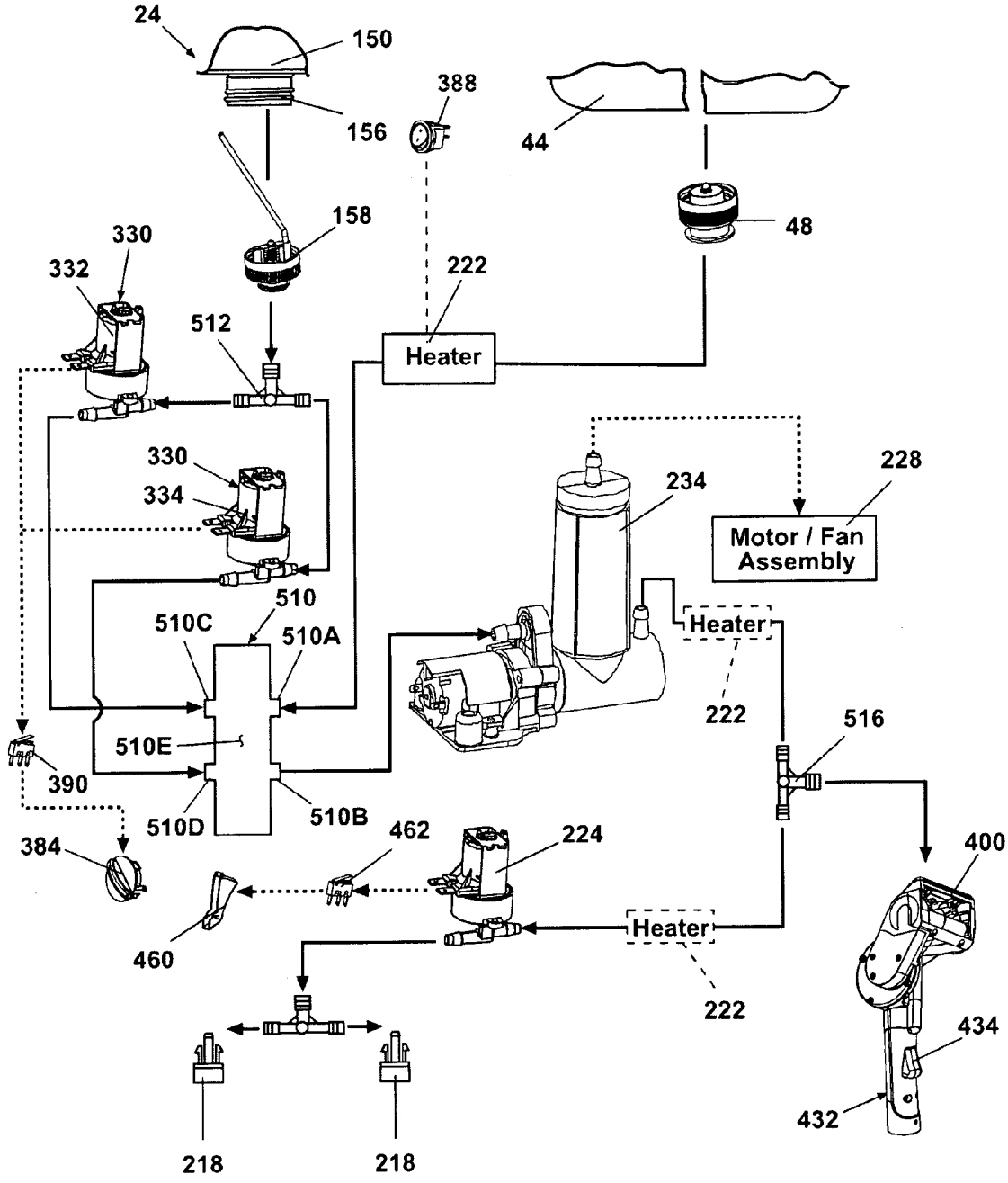
FIG. 24 is a schematic view of a fluid delivery system for the extractor of FIG. 1.
Figure 25A:
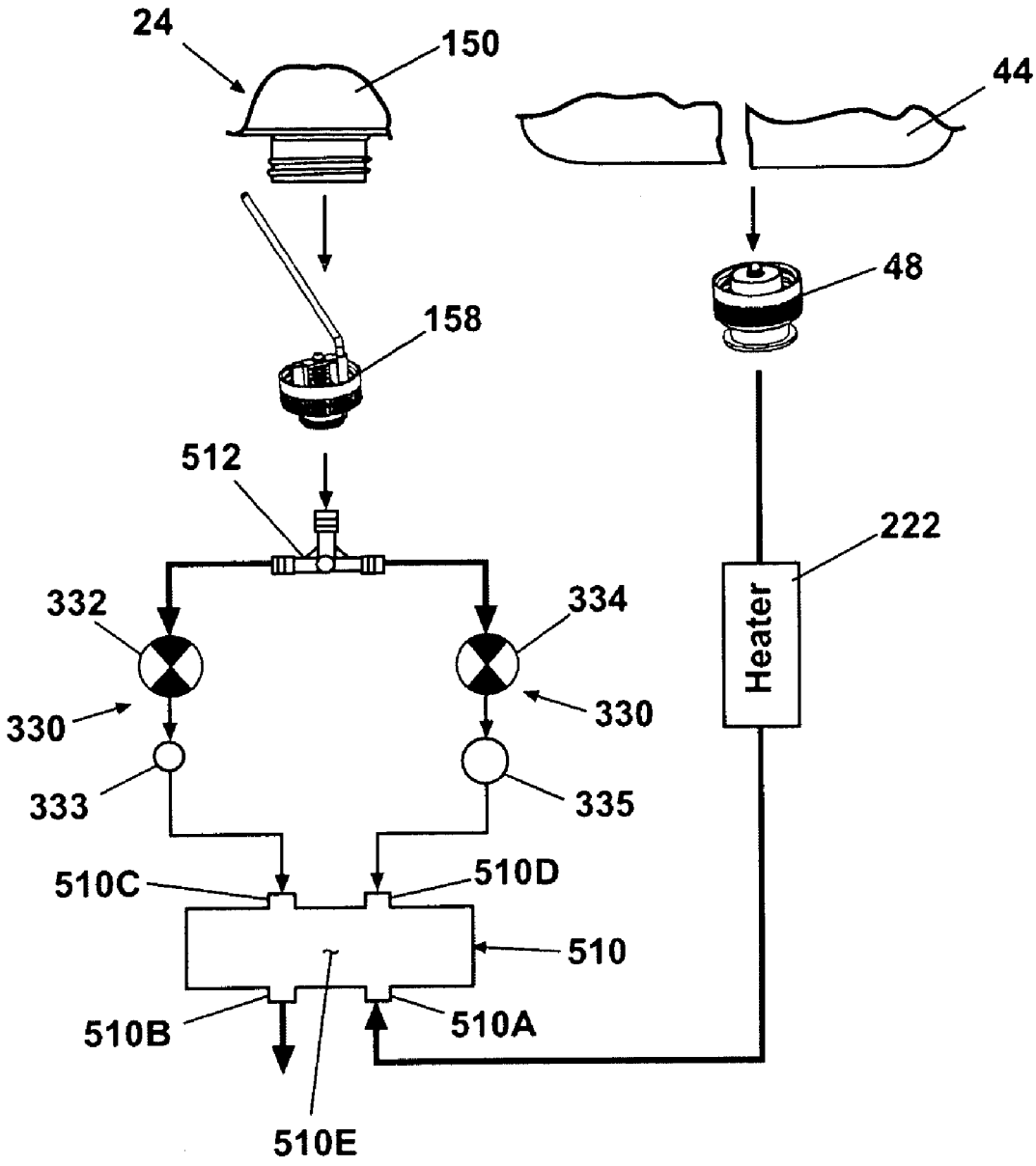
FIGS. 25A-25D are schematic views of a metering valve assembly from the fluid delivery system of FIG. 24 and showing four exemplary cleaning modes of the metering valve assembly.
Figure 25B:
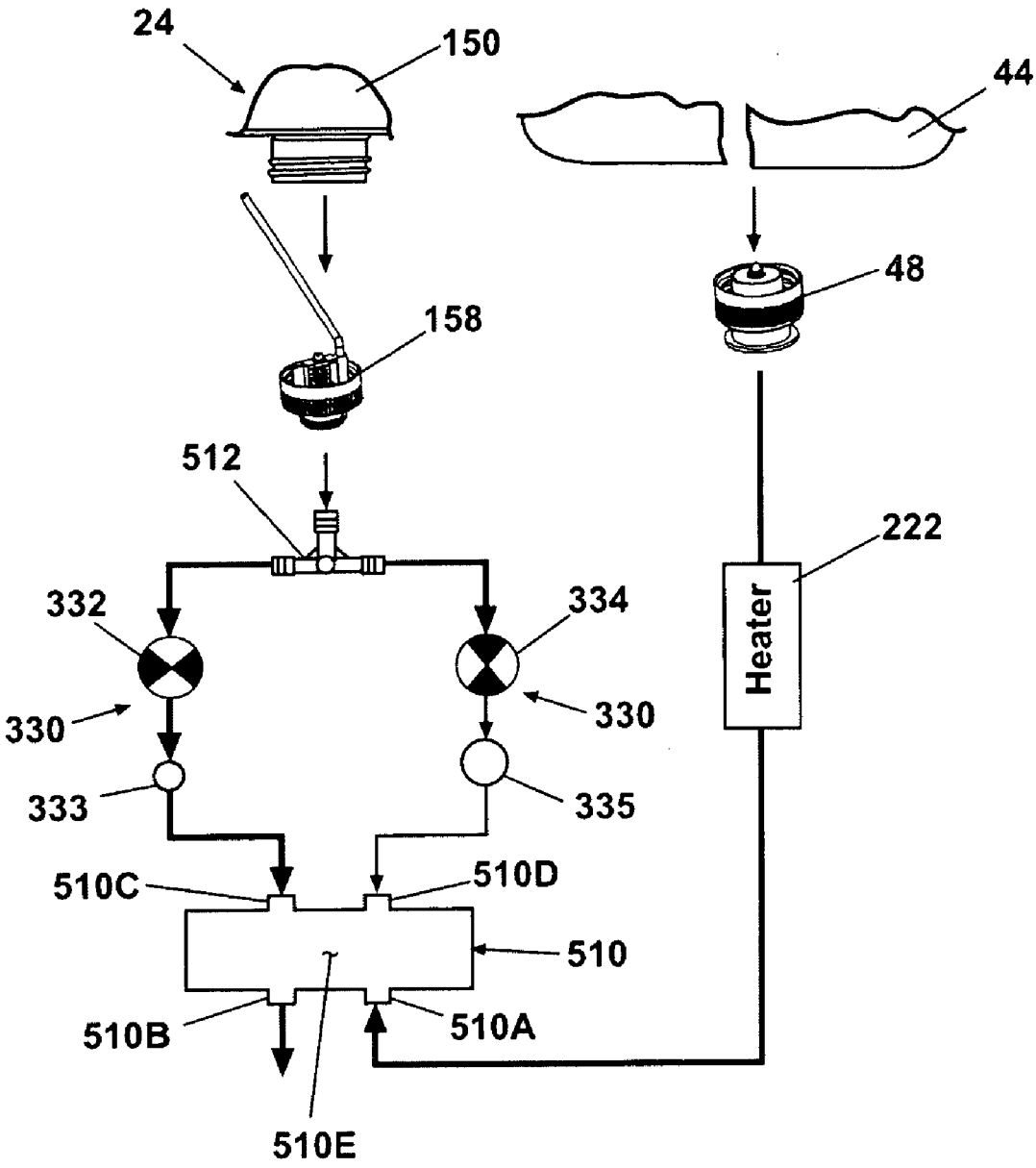
Figure 25C:
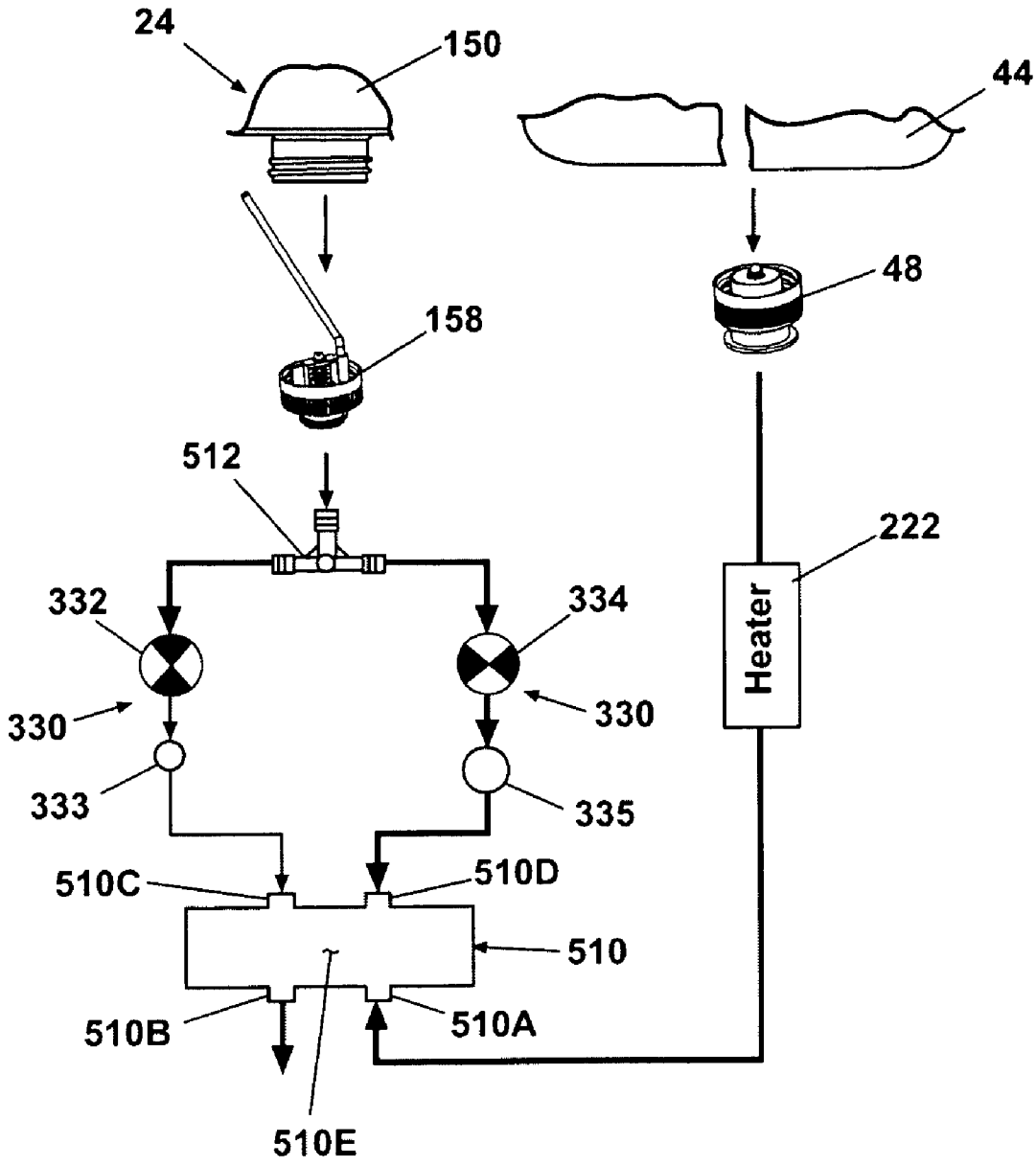
Figure 25D:
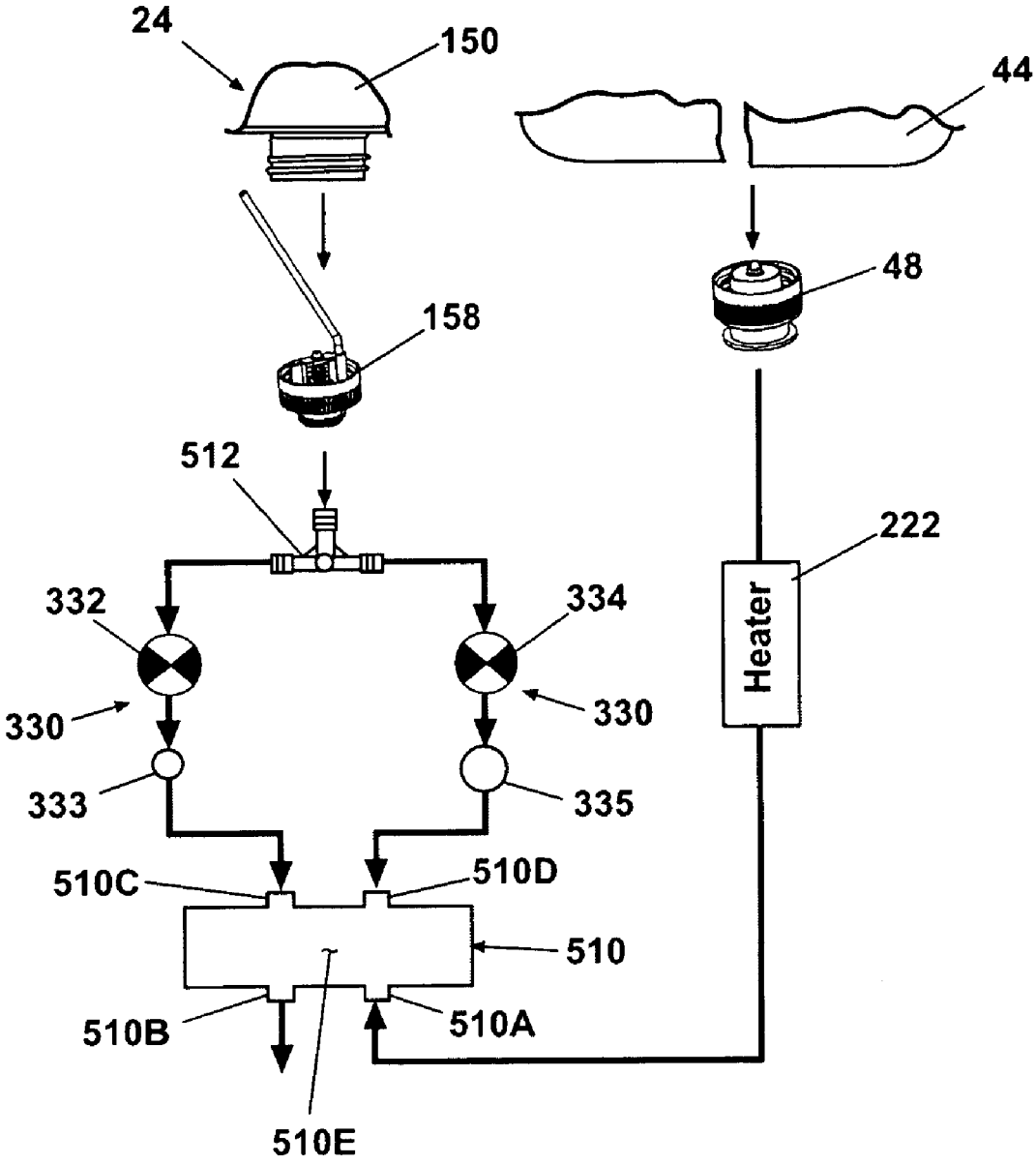

As mentioned above, the extractor 10 comprises the fluid delivery system for storing the cleaning fluid and delivering the cleaning fluid to the surface to be cleaned. For visual clarity, the various electrical and fluid connections within the fluid delivery system are not shown in the drawings described above but are depicted schematically in FIG. 24. Referring now to FIG. 24, the fluid delivery system comprises the bladder 44 for storing a first cleaning fluid and the solution supply tank housing 150 of the solution supply tank assembly 24 for storing a second cleaning fluid. The first and second cleaning fluids can comprise any suitable cleaning fluid, including, but not limited to, water, concentrated detergent, diluted detergent, and the like. Preferably, the first cleaning fluid is water, and the second cleaning fluid is concentrated detergent. The first and second cleaning fluids are dispensed from the bladder 44 and the solution supply tank housing 150 through the respective valve mechanisms 48, 158, which are received by the respective valve seats 314, 318 when the recovery tank assembly 22 and the solution supply tank assembly 24, respectively, are mounted to the base assembly 20. Preferably, the valve mechanisms 48, 158 are normally closed, and the valve seats 314, 318 open the valve mechanisms 48, 158 when the valve mechanisms 48, 158 are received by the valve seats 314, 318. An exemplary valve mechanism and valve seat is disclosed in the aforementioned U.S. Pat. No. 6,467,122. The first cleaning fluid flows from the bladder 44 and through the optional heater 222, which heats the first cleaning fluid when the heater 222 is activated through the heater switch 388, to a mixing manifold 510. The mixing manifold 510 forms a conduit for the first cleaning fluid between a first fluid inlet 510A and an outlet 510B and also includes two second cleaning fluid inlets 510C, 510D corresponding to outlets of the first and second metering valves 332, 334, respectively. The second cleaning fluid inlets 510C, 510D fluidly communicate with the conduit for the first cleaning fluid in a mixing chamber 510E. The first cleaning fluid always flows through the mixing chamber 510E while the second cleaning fluid is selectively supplied to the mixing chamber 510E depending on the operational mode of the metering valve assembly 330. The heater 222 can be any suitable heater that can heat fluids and is preferably an in-line heater. Exemplary valve mechanisms and heaters are disclosed in U.S. Pat. No. 6,131,237 and U.S. Patent Application No. 60/521,693, which are incorporated herein by reference in their entirety.

The second cleaning fluid flows from the solution supply tank housing 150 to a manifold 512 so that the second cleaning fluid can flow to both the first metering valve 332 and the second metering valve 334. The first and second metering valves 332, 334 are preferably solenoid valves in electrical communication with the cleaning mode switch 390. Alternatively, the first and second metering valves can be mechanically operated valves actuated from either the handle assembly 14 or the foot assembly 12. As stated above, the outlets of the first and second metering valves 332, 334 have metering orifices (FIGS. 25A-25D) of different size that meter the amount of fluid that flows therethrough. Preferably, the first metering valve 332 has a first metering orifice 333 that is smaller than a second metering orifice 335 for the second metering valve 334 so that a larger amount of fluid can flow through the second metering valve 334 in a given period of time. The operation of the first and second metering valves 332, 334 is controlled by the user through the cleaning mode knob 384 that is operably coupled to the cleaning mode switch 390.

As shown in FIGS. 25A-25D, where fluid conduits having fluid flowing therethrough are indicated with relatively thick lines compared to the relatively thin lines utilized to represent fluid conduits without fluid actively flowing therethrough, the user can preferably select from four cleaning modes: a rinse mode (FIG. 25A), wherein the first and second metering valves 332, 334 are closed so that none of the second cleaning fluid can flow therethrough; a light cleaning mode (FIG. 25B), wherein the first metering valve 332 is open and the second metering valve 334 is closed so that the second cleaning fluid can flow through only the first metering valve 332; a normal cleaning mode (FIG. 25C), wherein the first metering valve 332 is closed and the second metering valve 334 is open so that the second cleaning fluid can flow through only the second metering valve 334; and a heavy cleaning mode (FIG. 25D), wherein the first and second metering valves 332, 334 are open so that the second cleaning fluid can flow through both the first and second metering valves 332, 334. Hence, the first and second metering valves 332, 334 can be operated to control the concentration of the second cleaning fluid relative to the first cleaning fluid.

When the cleaning mode knob 384 is set to one of the light, normal, and heavy cleaning modes, the second cleaning fluid flows through the appropriate metering valve(s) 332, 334 to the mixing chamber 510E through one or more of the first and second metering valve fluid inlets 510C, 510D, depending on the cleaning mode, of the mixing manifold 510. In the mixing chamber 510E, the second cleaning fluid mixes with first cleaning fluid flowing therethrough. When rinse mode is selected, only the first cleaning fluid flows through the mixing chamber 510E. After flowing through the mixing manifold 510, the mixture of the first and second cleaning fluids or the first cleaning fluid alone, depending on the selected cleaning mode and hereinafter referred to and the cleaning fluid, flows to the pump assembly 234, which pressurizes the cleaning fluid. The pump assembly 234 is operatively connected to the motor and fan assembly 228 for operation of a primer stack portion thereof, as described in the aforementioned U.S. Pat. No. 6,131,237.

Downstream from the pump assembly 234, the cleaning fluid flows through a tee 516 to deliver the cleaning fluid to the accessory tool handle 432, which can be equipped with an accessory tool, such as the power brush accessory tool 400, and to deliver the cleaning fluid to the spray tip valve 224. The spray tip valve 224 is also preferably a solenoid valve, but can alternatively be a mechanically operated valve, and is controlled by the trigger switch 462 in the handle assembly 14. When a user depresses the fluid trigger 460 on the handle assembly 14, the trigger switch 462 opens the spray tip valve 224 to deliver the cleaning fluid to the spray tips 218 for dispensation onto the surface to be cleaned. Optionally, the spray tips 218 can be oriented to dispense the cleaning fluid onto the agitator assembly 214 for delivering the cleaning fluid to the surface to be cleaned. When the user desires to deliver the cleaning fluid through the accessory tool attached to the accessory tool handle 432, the user depresses the accessory tool handle fluid trigger 434. As a result of the configuration of the cleaning delivery system, pressurized cleaning fluid is delivered to both the accessory tool and to the spray tips 218.

As will be recognized by one skilled in the extractor art, various modifications can be made to the fluid delivery system. For example, the heater 222 and the pump assembly 234 are optional, or the heater 222 can be positioned downstream of the pump assembly 234 either before or after the tee fitting 516 that directs fluid to the accessory tool handle 432 and the spray tips 218, as indicated in phantom in FIG. 24. Additionally, the spray tips 218 can be replaced with another type of fluid distributor, such as a distribution bar.

Further, the number of metering valves and corresponding inlets to the mixing manifold 510 can be increased depending on the desired cleaning modes. For example, adding one metering valve and one inlet to the configuration described above results in three of the metering valves, three of the inlets for the second cleaning fluid, and eight cleaning modes. The first and second metering valves 332, 334 can also be replaced by a variable mixing valve, such as that disclosed in the aforementioned U.S. Pat. No. 6,131,237. However, the first and second metering valves 332, 334 are preferred because they advantageously enable formulation of the cleaning fluid with of a controlled and precise concentration of the second cleaning fluid relative to the first cleaning fluid.

The first and second metering valves 332, 334, including the first and second metering orifices 333, 335, and the fluid inlets 510C, 510D for the second cleaning fluid together form valved inlets for the mixing manifold 510. The valved inlets function to meter the amount of the second cleaning fluid that enters the mixing chamber 510E of the mixing manifold 510. The valved inlets can have any suitable configuration to achieve this function. For example, the metering orifices 333, 335 can be associated with the fluid inlets 510C, 510D rather than the valves 332, 334.

As mentioned above, the extractor 10 comprises the fluid recovery system for removing the spent cleaning fluid and dirt from the surface to be cleaned and storing the spent cleaning fluid and dirt. The fluid recovery system comprises the motor and fan assembly 228 which draws a vacuum on the recovery chamber 32 through the horizontal conduit 244, the motor and fan assembly inlet conduit 230, the transfer conduit 232, the tank outlet conduit 122, and the outlet chamber 88 in the lid 70 of the recovery tank assembly 22. Depending on the position of the diverter valve 106, the motor and fan assembly 228 draws a vacuum on either the nozzle assembly 340 or the accessory tool handle 432 and the accessory tool attached thereto.

When the diverter valve 106 is positioned in the floor cleaning mode, as illustrated in FIG. 10B, a working air conduit is formed from the nozzle opening 348, through the fluid flow path 346 in the nozzle assembly 340, out the elongated outlet 350 of the nozzle assembly 340, through the nozzle conduit inlet 98 to the nozzle conduit section 96 of the recovery tank inlet conduit 90, through the diverter inlet 114, into the cavity 76, and through the tank inlet 82 into the recovery chamber 32. The working air conduit continues, as shown in FIG. 7, around the separator plate 116 in the recovery chamber 32 and through the screen 118 into the outlet chamber 88, through tank outlet 84 into the tank outlet conduit 122, and through the transfer conduit 232 and the horizontal conduit 244 (FIGS. 13A and 15) before reaching the motor and fan assembly 228 at the horizontal conduit outlet 246.

When the diverter valve 106 is positioned in the accessory cleaning mode and the handle assembly 14 is in the upright position, as illustrated in FIG. 10A, a working air conduit is formed from the accessory tool on the accessory tool handle 432, through the accessory hose 430 (FIGS. 3 and 4) and the accessory hose coupling 486 to the accessory conduit coupling 484 (FIG. 20), from the accessory conduit coupling 484 to the accessory conduit 482 in the handle assembly 14, through the accessory conduit 482 and the accessory conduit coupling 483 to the accessory conduit connector 170, through the outlet 172 of the accessory conduit connector 170 (FIG. 10A) to the accessory conduit inlet 102 of the accessory conduit section 100 of the recovery tank inlet conduit 90, through the diverter inlet 114, into the cavity 76, and through the tank inlet 82 into the recovery chamber 32. The working air path continues from the recovery chamber 32 in the same manner as described above with respect to the floor cleaning mode.

It is apparent in the above description that the handle assembly 14 must be in an upright position, as shown in FIGS. 1-4, for the working air conduit to be complete for accessory cleaning. When the handle assembly 14 is upright, the accessory conduit fitting 483 at the end of the accessory conduit 482 sealingly mates with the inlet 174 of the accessory conduit connector 170, as shown in FIG. 10A, to establish fluid communication between the accessory hose 430 and recovery tank inlet conduit 90. When the handle assembly 14 is pivoted away from the upright position, the working air conduit disconnects and, therefore, suction cannot be applied at the accessory tool handle 432. As a result of this configuration, the accessory hose 430 can always be connected the handle assembly 14, and the user can easily switch between floor and accessory cleaning modes without having to connect and disconnect the accessory hose 430 from the handle assembly 14.

An exemplary description of the operation of the extractor 10 follows. It will be appreciated by one of ordinary skill in the extractor art that the operation can proceed in any logical order and is not limited to the sequence presented below. The following description is for illustrative purposes only and is not intended to limit the scope of the invention in any manner.

To operate the extractor 10, the user fills the bladder 44 and the solution supply tank assembly 24 with the first and second cleaning fluids, respectively. To fill the bladder 44, the user removes the recovery tank assembly 22 from the base assembly 20 by pivoting the recovery tank handle 74 and lifting the recovery tank assembly 22 from the base assembly 20 to release the valve mechanism 48 from the valve seat 314 and to separate the tank outlet conduit 122 from the transfer conduit 232. The forward shell 470 of the lower handle 372 is designed to allow removal of the recovery tank assembly 22 when the handle assembly 14 is in the upright or inclined position.

Once the recovery tank assembly 22 is removed, it can be set on a flat surface. The tank assembly 22 rests on the tank leveling member 42 and a forward portion of the upper side rails 130. Without the tank leveling member 42, the tank assembly 22 would rest on the entire lower edges 138 of the upper side rails 138 and thereby tilt rearwardly at a fairly severe angle, which could result in undesirable flow of fluid from the recovery chamber 32 through the tank outlet 84. The tank leveling member 42 raises the rear side of the tank assembly 22 to position the tank housing 30 to prevent any fluid in the recovery chamber 32 from undesirably flowing out of the tank housing 30 through the tank outlet 84. The tank leveling member 42 can level the recovery chamber 32 or can position the recovery chamber 32 such that the recovery chamber 32 tilts forwardly or rearwardly at a slight angle.

Next, the user removes the lid 70 from the tank housing 30 by releasing the tank latch 36 and pulling the lid 70 off of the tank housing 30 to expose the funnel 47. The first cleaning fluid is poured into the bladder 44 through the funnel 47. The lid 70 is replaced on the tank housing 30 and secured thereto by engaging the tank latch 36. The user then re-mounts the recovery tank assembly 22 with the full bladder 44 onto the base assembly 20 by aligning the upper side rails 130 with the lower side rails 264 and the base housing side walls 204, which function as guide surfaces for the upper side rails 130, and aligning the tank leveling member 42 with the slot 309 in the base housing cover 192. The user gently pushes the recovery tank assembly 22 on to the base assembly 20 to connect the valve mechanism 48 with the valve seat 314 and the tank outlet conduit 122 with the transfer conduit 232. When the recovery tank assembly 22 is mounted to the base assembly 20, the upper side rails 130 straddle the base assembly 20 to thereby position and retain the recovery tank assembly 22 on the base assembly 20.

To fill the solution supply tank housing 150 with the second cleaning fluid, the user removes the solution supply tank assembly 24 from the base assembly 20 by simply lifting the solution supply tank assembly 24 therefrom, thereby separating the valve mechanism 158 from the valve seat 318. The extractor 10 is designed to allow removal of the solution supply tank assembly 24 when the handle assembly 14 is in the upright or inclined position. Once the solution supply tank assembly 24 is removed from the base assembly 20, the valve mechanism 158 is removed from the tank outlet 156, which also functions as a tank inlet for filling the solution supply tank housing 150 with the second cleaning fluid. After the solution supply tank housing 150 is filled, the user replaces the valve mechanism 158 on the tank outlet 156 and mounts the solution supply tank assembly 24 to the base assembly 20, thereby coupling the valve mechanism 158 with the valve seat 318. With the bladder 44 and the solution supply tank assembly 24 filled with the first and second cleaning fluids, respectively, the user can operate the extractor 10 in the floor cleaning mode or the accessory cleaning mode.

Figure 26:
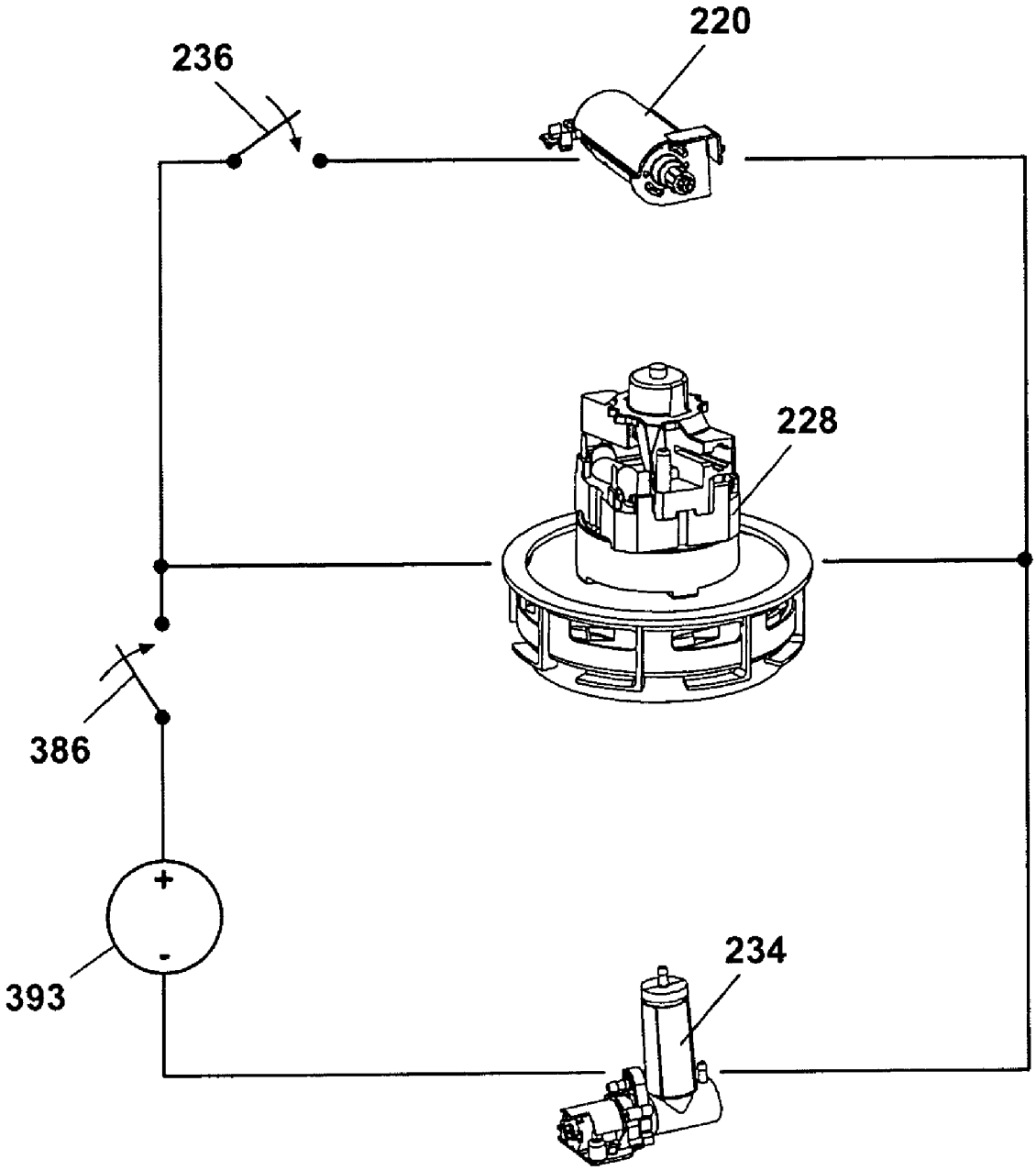
FIG. 26 is a schematic view of an electrical system for the extractor of FIG. 1.

To operate the extractor 10 in the floor cleaning mode, the user turns the diverter valve 106 to the floor cleaning mode, as shown in FIG. 10B, so that the diverter inlet 114 aligns with the nozzle conduit section 96. The user then actuates the main power switch 386 to supply power from a power source 393, such as the home power supply, to the motor and fan assembly 228, the pump assembly 234, and the agitator motor 220, as shown schematically in FIG. 26. Power to the agitator motor 220 is also controlled by the agitator motor switch 236 in the foot assembly 14. The agitator motor switch 236 is normally in a closed position to supply power to the agitator motor 220. However, when the handle assembly 14 is in the upright position, the agitator motor switch actuator 495 depresses the actuation button 239 of the agitator motor switch 236 to open the agitator motor switch 236 so that no power is supplied to the agitator motor 220. When the user pivots the handle assembly 14 away from the upright position, the agitator motor switch actuator 495 rotates away from the actuation button 239 to thereby return the agitator motor switch 236 to its normally closed position and supply power to the agitator motor 220 for floor cleaning. If the user desires heated cleaning, then the user actuates the heater switch 388 to power the heater 222, and the heater indicator 478 communicates the operational status of the heater 222 to the user. Next, the user selects a desired cleaning mode through the cleaning mode knob 384. Typically, the user initially performs one of the light, normal, or heavy cleaning modes and then follows with a rinse mode. Optionally, the user can change modes during use when encountering a lightly soiled surface (i.e., change to the light cleaning mode) or a heavily soiled surface (i.e., change to the heavy cleaning mode).

With the handle assembly 14 pivoted and agitator motor 220 powered, the user moves the extractor 10 along the surface to be cleaned while applying the cleaning fluid when desired by depressing the fluid trigger 460 with the same hand that holds the handle grip 440 at the hand section 452. The cleaning fluid is dispensed through the spray tips 218, and the surface to be cleaned is agitated by the brushrolls 220 and the edge brushes 294. The spent cleaning fluid and dirt on the surface to be cleaned are removed through the nozzle opening 348 and flow through the working air conduit described above (FIG. 10B) into the recovery chamber 32, where the spent cleaning fluid and dirt are removed from the working air. The working air continues along the working air conduit out of the recovery chamber 32 to the motor and fan assembly 228, and the exhaust air from the motor and fan assembly 228 leaves the foot assembly 14 through the vents 250 in the manner described in detail above.

To operate the extractor 10 in the accessory cleaning mode, the user pivots the handle assembly 14 to the upright position to thereby deactivate the agitator motor 220 and connect the accessory conduit fitting 483 with the inlet 174 of the accessory conduit connector 170. Next, the user selects the desired cleaning mode through the cleaning mode knob 384 and rotates the diverter valve 106 to the accessory cleaning mode to align the diverter inlet 114 with the accessory conduit connector 170, as illustrated in FIG. 10A. With a desired accessory tool mounted to the stem 438 of the accessory tool handle 432, the user cleans the surface to be cleaned by applying the cleaning fluid, if desired and suitable for the selected accessory tool, through depression of the accessory tool handle fluid trigger 434 and removing the spent cleaning fluid and dirt through the working air conduit described above (FIG. 10A). The spent cleaning fluid and dirt enters the recovery chamber 32, where the spent cleaning fluid and dirt are removed from the working air. The working air continues along the working air conduit out of the recovery chamber 32 to the motor and fan assembly 228, and the exhaust air from the motor and fan assembly 228 leaves the foot assembly 14 through the vents 250 in the manner described in detail above.

As the motor and fan assembly 228 operates with the extractor 10 in either the floor cleaning mode or accessory cleaning mode, cooling air for the motor 590 flows through a passageway for cooling the motor 590 and also heating the second cleaning fluid in the solution supply chamber 152. In particular, cooling air enters the motor cavity in the motor and fan assembly cover 304 through the cooling air inlet apertures 306, flows over the motor 590 of the motor and fan assembly 228, and is exhausted through the cooling air exhaust aperture 307. Because the cooling air removes heat from the motor 590 of the motor and fan assembly 228, the cooling air exhaust is warm. As shown by arrows B in FIG. 10C, the warm cooling air exhaust flows from the cooling air exhaust aperture 307, into the cooling air exhaust conduit 311, and ultimately to the atmosphere through the cooling air vents 313. Because the cooling air exhaust conduit 311 is partially defined by the solution supply tank support 167 and is thereby located adjacent the solution supply tank assembly 24, the warm cooling air exhaust is in heat exchange with the solution supply chamber 152 and advantageously heats the second cleaning fluid contained therein. In this embodiment, the solution supply tank support 167 conducts the heat from the cooling air exhaust to the solution supply tank assembly 24, including the solution supply chamber 152.

The cooling air exhaust conduit 311 can be routed in any suitable manner to facilitate heat exchange between the warm cooling air exhaust and the solution supply chamber 152. For example, the foot assembly cover 26 can include additional cooling air vents 313A in the solution supply tank support 167, as shown in phantom in FIG. 10C, for directing the warm cooling air exhaust towards the solution supply tank assembly 24. When the foot assembly cover 26 has the cooling air vents 313A, the cooling air vents 313 can be omitted whereby more of the warm cooling air exhaust is directed toward the solution supply tank assembly 24. Further, the lower end of the solution supply tank housing 150 can be spaced from the solution supply tank support 167 so that the warm cooling air exhaust can easily flow through the cooling air vents 313A. The cooling air vents 313A can have any suitable configuration ranging from a plurality of relatively small apertures (relative to the size of the solution supply tank support 167) to a single, relatively large aperture (relative to the size of the solution supply tank support 167).

As another example, the solution supply tank housing 150 can be configured so that the warm cooling air exhaust flows through the cooling air vents 313A and around or through the solution supply tank housing 150. To achieve this flow of the cooling air exhaust, the solution supply tank housing 150 can have, for example, a depression that defines an air flow path around the outside of the solution supply tank housing 150 or form one or more conduits that extend through the solution supply tank housing 150.

Optionally, the solution supply tank assembly 24 can be mounted on a thermally conductive body that absorbs heat from the warm cooling air exhaust and transfers the heat to the second cleaning fluid in the solution supply tank assembly 24. In another embodiment, an auxiliary heater can be positioned downstream from the motor 590, for example, in the cooling air exhaust conduit 311, to further heat the cooling air exhaust that is in heat exchange with the solution supply chamber 152.

In another embodiment, the cooling air vents 313 are located on a bottom surface of the base housing 190 in a manner similar to the working air exhaust vents 250 to aid in heating and drying the surface that is being cleaned. An example of an extractor with vents that direct the motor cooling air exhaust toward the surface to be cleaned is disclosed in the aforementioned U.S. Pat. No. 6,467,122.

Alternatively, cooling air exhaust from a motor other than the motor 590 of the motor and fan assembly 228 can be utilized to heat the second cleaning fluid in the solution supply chamber 152 in a manner similar to that described above. For example, the motor can be the agitator motor 220 or any other motor known for use in an extraction cleaner, including a drive motor that provides power for moving the extraction cleaner over a surface to be cleaned.

During operation in either the floor cleaning mode or the accessory cleaning mode, the bladder 44 empties and compresses, due to its flexibility, as the recovery chamber 32 fills with the spent cleaning fluid and dirt. If the spent cleaning fluid and dirt in the recovery chamber 32 reaches a predetermined level, the float 60 rises such that the upper portion 62 contacts the float door 120. As the fluid level continues to rise, the float 60 forces the float door 120 to pivot toward the tank outlet screen 118 until, at a predetermined position, the working air flow draws the float door 120 to the generally vertical, closed position in contact with the screen 118 to block fluid communication between the motor and fan assembly 228 and the recovery chamber 32 and thereby prevent the recovery chamber 32 from overfilling. When the user turns off power to the motor and fan assembly 228, the working air flow ceases and no longer holds the float door 120 in the closed position. As a result, the float door 120 pivots about the pivot pin 119 and returns to the generally horizontal, open position. To empty the recovery chamber 32, the user removes the recovery tank assembly 22 from the base assembly 20 as described above. With the lid 70 removed from the tank housing 30, the user can empty the contents of the tank housing 30 through the open top of the tank housing 30.

If desired, the user can remove the nozzle assembly 340 for replacement, repair or cleaning. Preferably, the nozzle assembly 340, the recovery tank inlet conduit 90, and the lid 70 are made of a transparent or translucent material so that a user can visually observe the interior regions of these components. Additionally, the user can remove the spray tips 218 for replacement, repair, or cleaning thereof and the end caps 288, which can also be made of a transparent or translucent material, for accessing the agitator assembly 214 from a side of the foot assembly 12.

Figure 27:
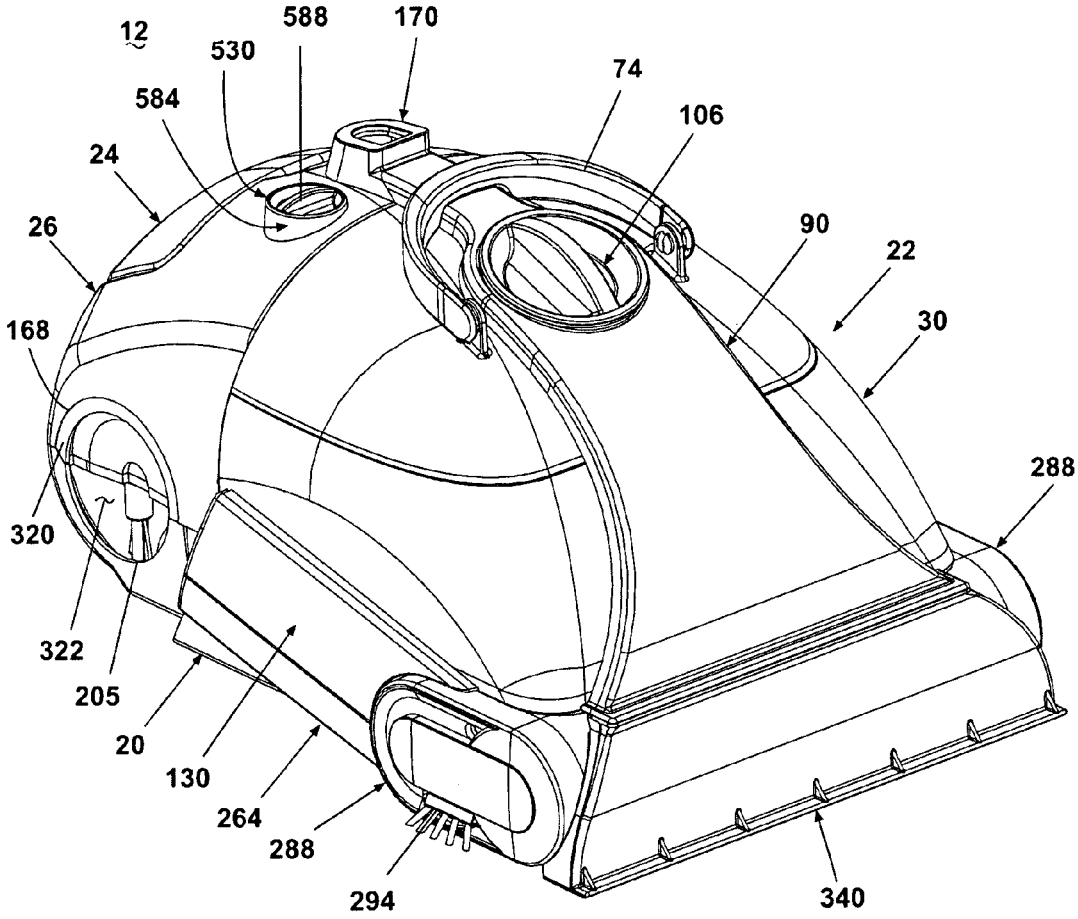
FIG. 27 is a front, left perspective view of a foot assembly with an alternative metering valve assembly according to the invention.
Figure 28:
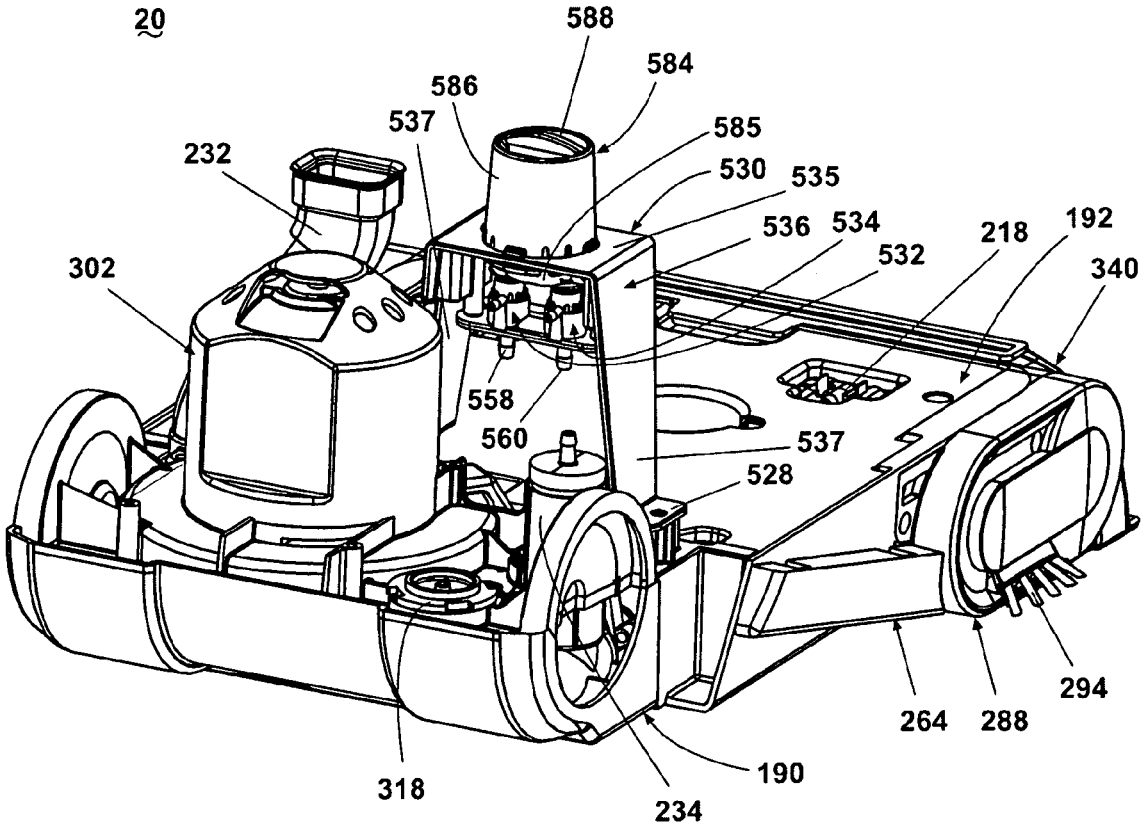
FIG. 28 is a rear perspective view of a base assembly of the foot assembly of FIG. 27 with the alternative metering valve assembly.
Figure 29:
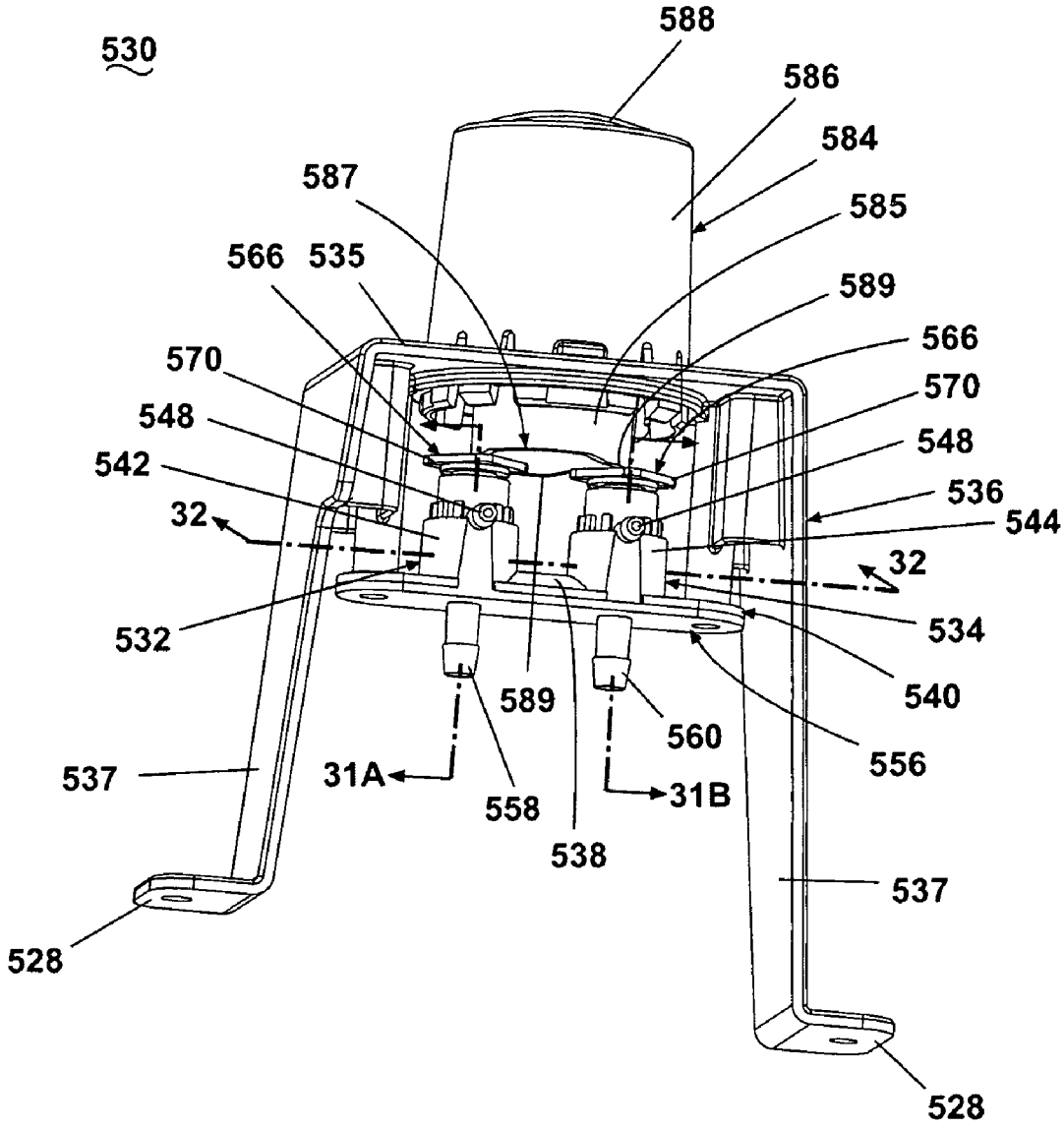
FIG. 29 is a perspective view of the metering valve assembly of FIGS. 27 and 28.
Figure 30:
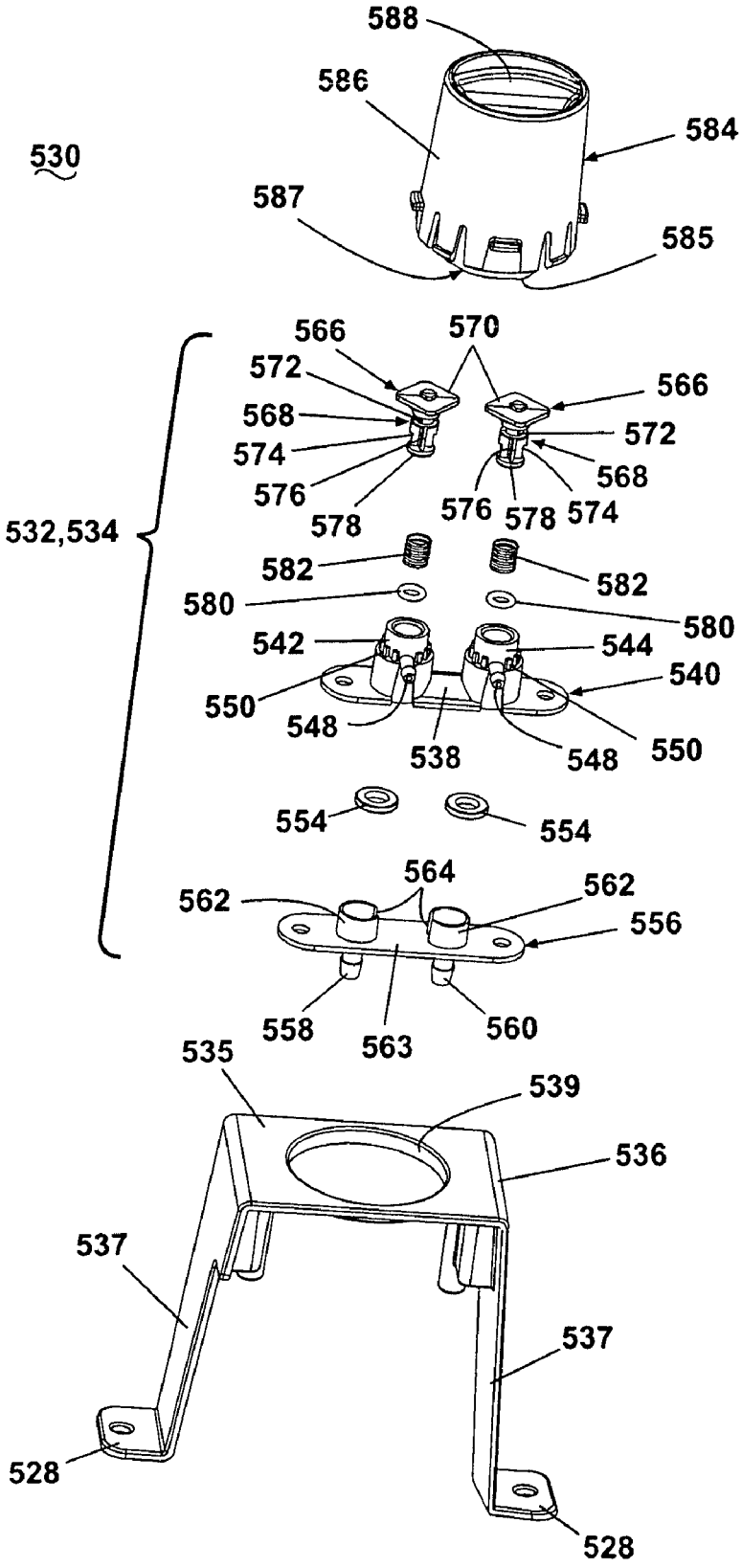
FIG. 30 is an exploded view of the metering valve assembly of FIG. 29.

An alternative embodiment of a metering valve assembly 530 according to the invention is illustrated in FIGS. 27-32. The metering valve assembly 530 replaces the metering valve assembly 330 and the cleaning mode knob 384 and the corresponding cleaning mode switch 390 of the first embodiment. Consequently, the fluid delivery system shown in FIG. 24 is the same for the alternative embodiment, except that the components downstream of the heater 222 and the valve mechanism 158 and upstream of the pump assembly 234 are replaced with the metering valve assembly 530, which incorporates a mixing manifold with a mixing chamber. The remaining components of the foot assembly 12 shown in FIGS. 27 and 28 are substantially identical to those shown and described with respect to the first embodiment and are therefore identified with the same reference numerals.

Figure 31A:
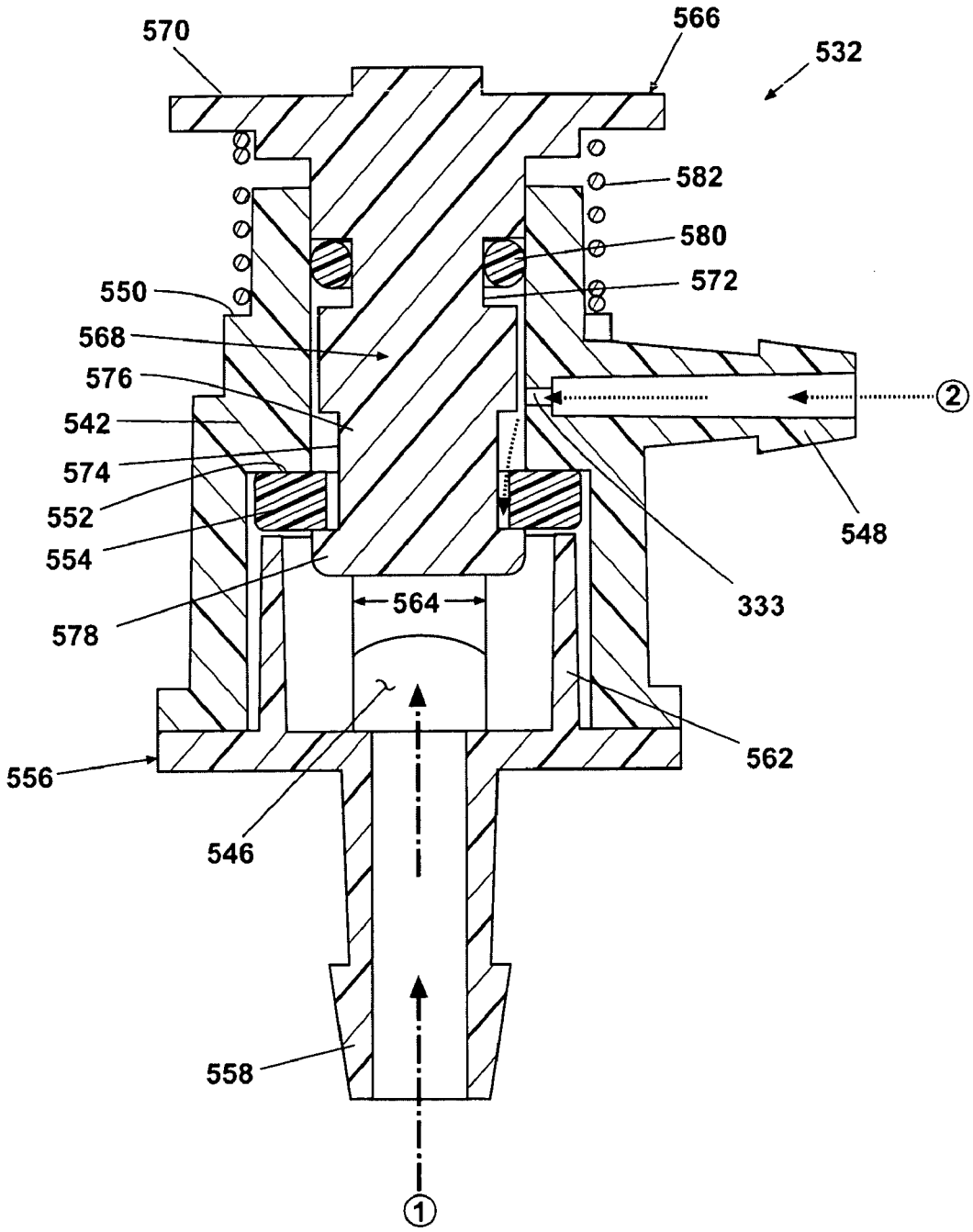
FIG. 31A is a sectional view taken along line 31A-31A of FIG. 29, wherein a first metering valve of the metering valve assembly of is in a closed position.
Figure 31B:
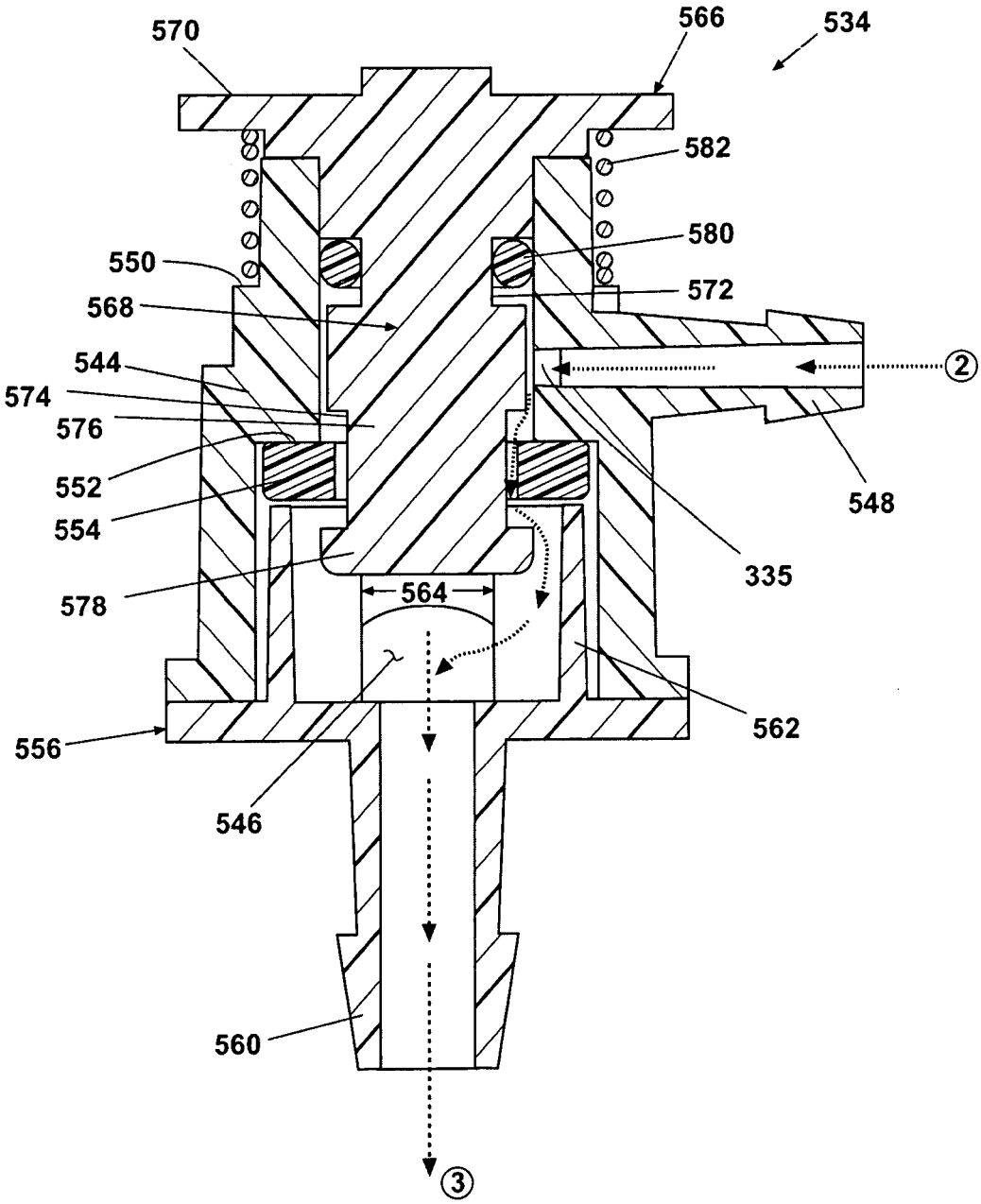
FIG. 31B is a sectional view taken along line 31B-31B of FIG. 29, wherein a second metering valve of the metering valve assembly is in an open position.
Figure 32:
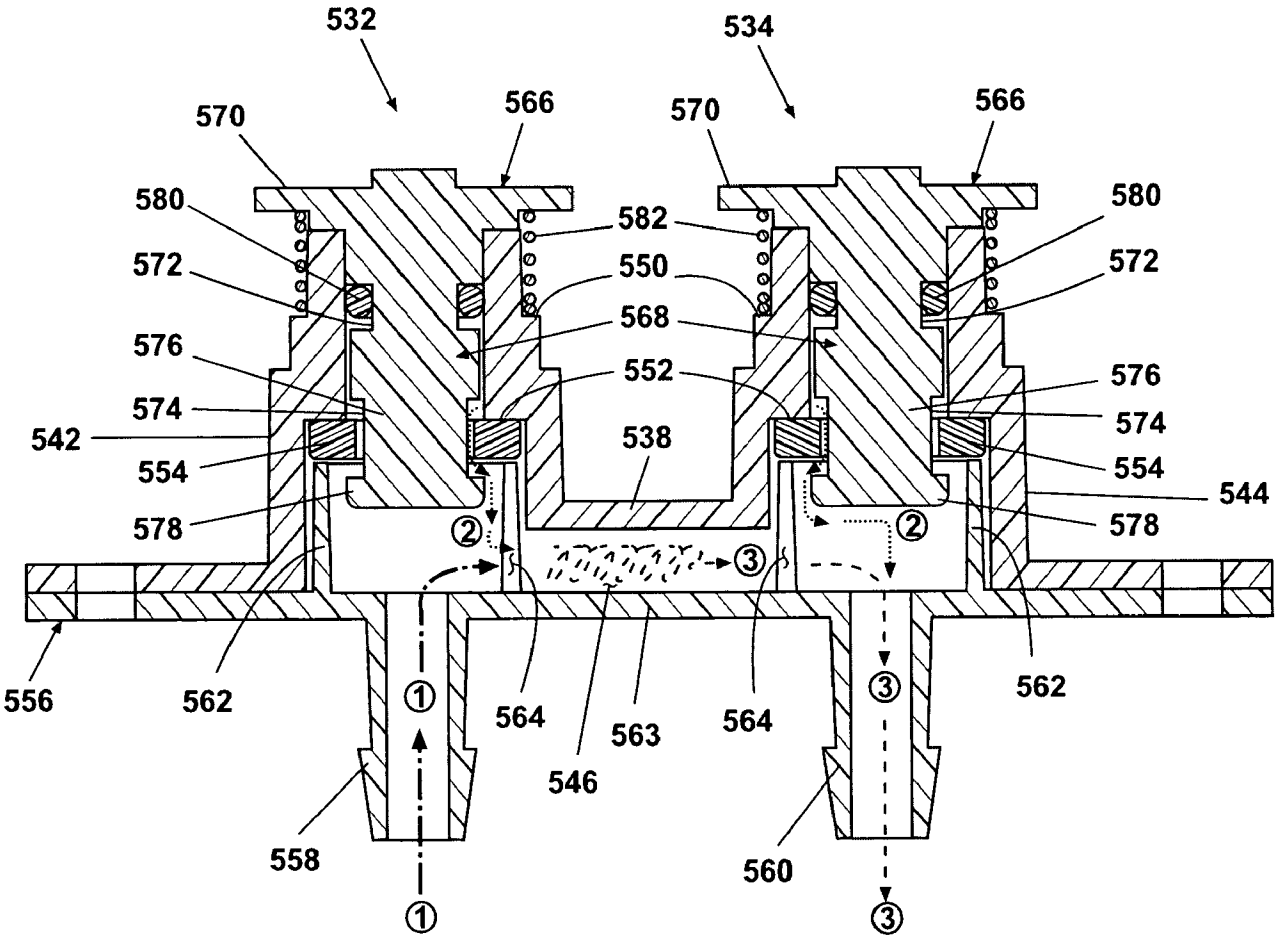
FIG. 32 is a sectional view taken along line 32-32 of FIG. 29, wherein the first metering valve and the second metering valve of the metering valve assembly are in open positions.

The alternative metering valve assembly 530 comprises a first metering valve 532 and a second metering valve 534 and is supported by a generally U-shaped valve bracket 536 comprising a platform 535 with a circular mounting aperture 539 and a pair of depending legs 537 mounted to the base housing cover 192 by fasteners that extend through terminal flanges 528. An upper portion of the first and second metering valves 532, 534 is formed by a valve housing 540 comprising a hollow first valve body 542, a hollow second valve body 544, and a connecting wall 538 therebetween. The first and second valve bodies 542, 544 comprise radially oriented valve inlets 548 in fluid communication with the solution supply tank assembly 24 and leading to a respective first and second metering orifice 333, 335 (FIGS. 31A and 31B) within the first and second valve bodies 542, 544. In particular, the first metering valve 532 comprises the first metering orifice 333, and the second metering valve 534 comprises the second metering orifice 335, which is larger than the first metering orifice 333 for the same reasons as described above for the first embodiment metering valve assembly 330. As shown in FIGS. 31A, 31B, and 32, the first and second valve bodies 542, 544 include an exterior shoulder 550 an interior shoulder 552. The interior shoulder 552 is disposed at approximately half the height of the valve bodies 542, 544 such that the interior of the valve bodies 542, 544 below the interior shoulder 552 has a larger diameter than above the interior shoulder 552. An annular gasket 554 is positioned below the interior shoulder 552 in sealing contact therewith. The valve inlets 548 and the corresponding metering orifice 333, 335 are located above the interior shoulder 552.

A valve platform 556 comprises a platform 563 that sealingly mates with a lower surface of the valve housing 540 to form a lower portion of the first and second metering valves 532, 534. The valve platform 556 comprises on a lower side thereof a first cleaning fluid inlet 558 in fluid communication with the bladder 44 and an outlet 560 and, on an upper side thereof, a pair of generally cylindrical upstanding valve body receivers 562. The valve body receivers 562 project into the respective first and second valve bodies 542, 544 to a position where their upper end is slightly spaced from the gasket 554.

Additionally, the valve body receivers 562 include apertures 564 oriented such that they face one another and are in fluid communication with a mixing chamber 546 (FIG. 32) formed between the platform 562 and the connecting wall 538 of the valve housing 40.

Each of the first and second metering valves 532, 534 further comprise a valve stem 566 having a plunger 568 that depends from a generally perpendicular control knob interface plate 570. The plunger 568, which is slidingly received within the respective hollow valve body 542, 544, includes an upper circumferential notch 572 and a lower notch 574 formed in a plurality of radially extending fins 576. A terminal disk 578 at the lower end of the fins 576 defines the lower end of the lower notch 574. A commonly known O-ring seal 580 seated within the upper circumferential notch 572 of the plunger 568 creates a seal between the plunger 568 and an inner surface of the respective valve body 542, 544 above the interior shoulder 552 and the respective metering orifice 333, 335. The annular gasket 554 is positioned within the lower notch 574 on the fins 576 of the plunger 568 and has an inner diameter slightly less than the diameter of the lower notch 574 to form an annular fluid passageway therebetween. Thus, a fluid passageway is formed from the valve inlet 548, through the respective metering orifice 333, 335, axially along and between the fins 576 of the plunger 568, and in the annular space between the annular gasket 554 and the plunger 568, as indicated by an arrow labeled 2 in FIG. 31A.

The valve stem 566 is biased upward to a closed position shown in FIG. 31A by a biasing member, such as a spring 582 disposed between a lower surface of the control knob interface plate 570 and the exterior shoulder 550 of the respective valve body 542, 544. In this position, the terminal disk 578 abuts the annular gasket 554, thereby limiting upward movement of the valve stem 566 and creating a seal between the annular gasket 554 and the terminal disk 578. Consequently, the fluid passageway described above terminates at this seal. Corresponding flows of the first and second cleaning fluids when the valve stem 566 is in the closed position are indicated by arrows labeled 1 and 2, respectively, in FIG. 31A.

When the plunger 568 shifts downward within the respective valve body 542, 544, the terminal disk 578 moves downward to an open position to form a vertical space between the annular gasket 554 and the terminal disk 578, as shown in FIG. 31B. Consequently, the fluid passageway described above continues from the annular space between the annular gasket 554 and the plunger 568 and into the valve body receiver 562 and the mixing chamber 546. Thus, the second cleaning fluid that flows through the fluid passageway mixes with the first cleaning fluid that enters through the first cleaning fluid inlet 558. Flows of the second cleaning fluid when the valve stem 566 is in the open position is indicated by arrows labeled 2 in FIG. 31B.

Vertical movement of the valve stem 566 and thereby the plunger 568 is effected by a cleaning mode knob 584 mounted in the mounting aperture 539 of the bracket platform 525 and positioned above the valve stems 566. The cleaning mode knob 584 comprises an upper portion 586 that extends above the valve bracket 536 and projects through the foot assembly cover 26. The upper portion 586 includes a grip 588 accessible to the user for rotation of the cleaning mode knob 584. A lower portion 585 of the cleaning mode knob 584 extends below the valve bracket 536 and interacts with the control knob interface plates 570 of both of the valve stems 566 to simultaneously control the operation of the first and second metering valves 532, 534. The lower portion 585 terminates in a cam surface 587 having a plurality of projections 589, and each projection 589 is sized to depress the control knob interface plate 570 when in register therewith for moving the corresponding plunger 568 downward and thereby opening the corresponding metering valve 532, 534.

The operation of the metering valve assembly 530 will now be described with continued reference to FIGS. 29-32 and additional reference to the schematic views in FIGS. 25A-25D. The second cleaning fluid from the fluid supply tank assembly 24 is available at the valve inlets 548, while the first cleaning fluid from the bladder 44 flows in the first cleaning fluid inlet 558, through the mixing chamber 546, and out the outlet 560 to the pump assembly 234. When the extractor 10 is operated in the rinse mode, the user rotates the grip 588 and thereby the cleaning mode knob 584 to a corresponding rinse position, in which both of the valve stems 566 are in the closed position shown in FIG. 31A. As described above, when the valve stems 566 are in the closed position, the terminal disk 578 abuts the annular gasket 554 to terminate the fluid passageway at the annular space between the annular gasket 554 and the plunger 568. Thus, the second cleaning fluid does not pass through either of the first and second metering valves 532, 534. Meanwhile, the first cleaning fluid enters the first cleaning fluid inlet 558, as indicated by arrows labeled 1 in FIG. 31A, and only the first cleaning fluid is dispensed at the outlet 560.

For operation of the extractor 10 in one of the light, normal, and heavy cleaning modes, the user rotates the grip 588 and thereby the cleaning mode knob 584 to a corresponding position to open the first metering valve 532 for the light cleaning mode, the second metering valve 534 for the normal cleaning mode, or both the first and second metering valves 532, 534 for the heavy cleaning mode. These cleaning modes and the rinse mode are functionally the same as the cleaning modes schematically shown in FIGS. 25A-25D of the first embodiment. When the second metering valve 534 is opened for the normal cleaning mode, the valve stem 566 is in the open position shown in FIG. 31B. As described above, the valve stem 566 is displaced downward to form a vertical space between the terminal disk 578 and the annular gasket 554 to thereby fluidly communicate the valve inlet 548 with the interior of the valve body receiver 562 and the mixing chamber 546. Thus, the second cleaning fluid, whose flow is indicated by arrows labeled 2 in FIG. 31B, mixes with the first cleaning fluid to form the cleaning solution before exiting at the outlet 560, as indicated by arrows labeled 3 in FIG. 31B. During the light cleaning mode, the first metering valve 532 opens in the same fashion, and both the first and second metering valves 532, 534 open in the same fashion for the heavy cleaning mode. The positions of the first and second metering valves 532, 534 in the heavy cleaning mode are shown in FIG. 32, where flow of the first cleaning fluid is indicated by arrows labeled 1, flow of the second cleaning fluid is indicated by arrows labeled 2, and flow of a mixture of the first and second cleaning fluids is indicated by arrows labeled 3. In each mode, the amount of second cleaning fluid that mixes with the first cleaning fluid is determined by the sizes of the first and the second metering orifices 333, 335 of the corresponding first and second metering valves 532, 534 and progressively increases for a more concentrated cleaning solution.

The metering valve assembly 530 can be modified in any suitable manner. For example, the metering valve assembly 530 can include more than two of the metering valves 532, 534, depending on the desired number of cleaning modes. For example, adding one metering valve with a corresponding inlet to the configuration described above results in three of the metering valves, three of the inlets for the second cleaning fluid, and eight cleaning modes.

The operation of the extractor 10 with the alternative metering valve assembly 530 is substantially identical to the operation described above for the first embodiment. The primary difference is that the user rotates the cleaning mode knob 584 located on the foot assembly 12 to switch between cleaning modes.

Whereas, the invention has been described with respect to two fluid tanks, it is within the scope of the invention to meter three or more fluids from three or more separate tanks with metering valve assemblies according to the invention. For example, in addition to the water and cleaning solution tanks, a third tank can comprise a carpet or bare floor protectant and a fourth tank can contain a miticide. Thus, the invention in it broader terms in not limited to the metering of fluids from only two tanks.

It is within the scope of the invention to alter various components of the extractor 10 or to add other features to the extractor 10. Examples of alterations and additions follow.

Figure 33:
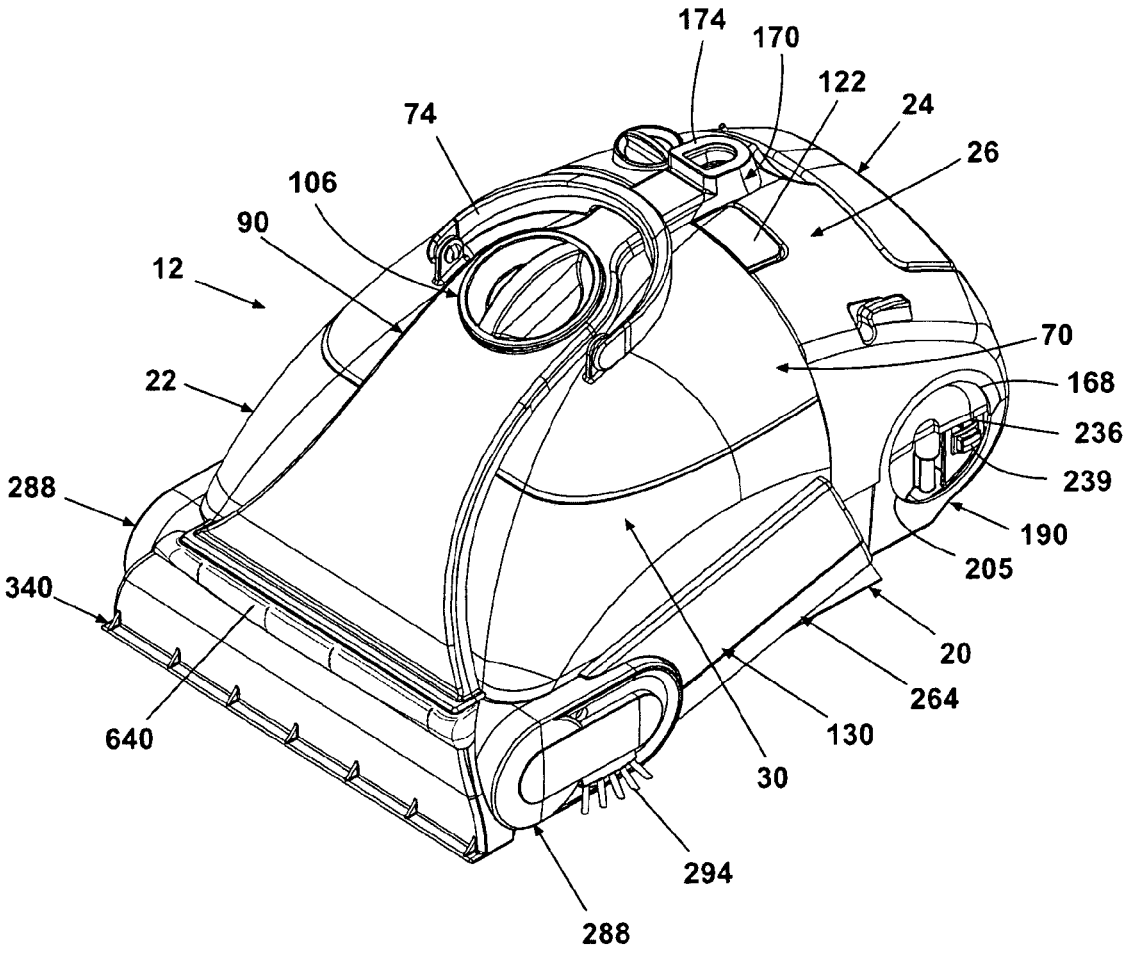
FIG. 33 is a perspective view of the foot assembly of FIG. 1 with an alternative nozzle assembly.
Figure 34:
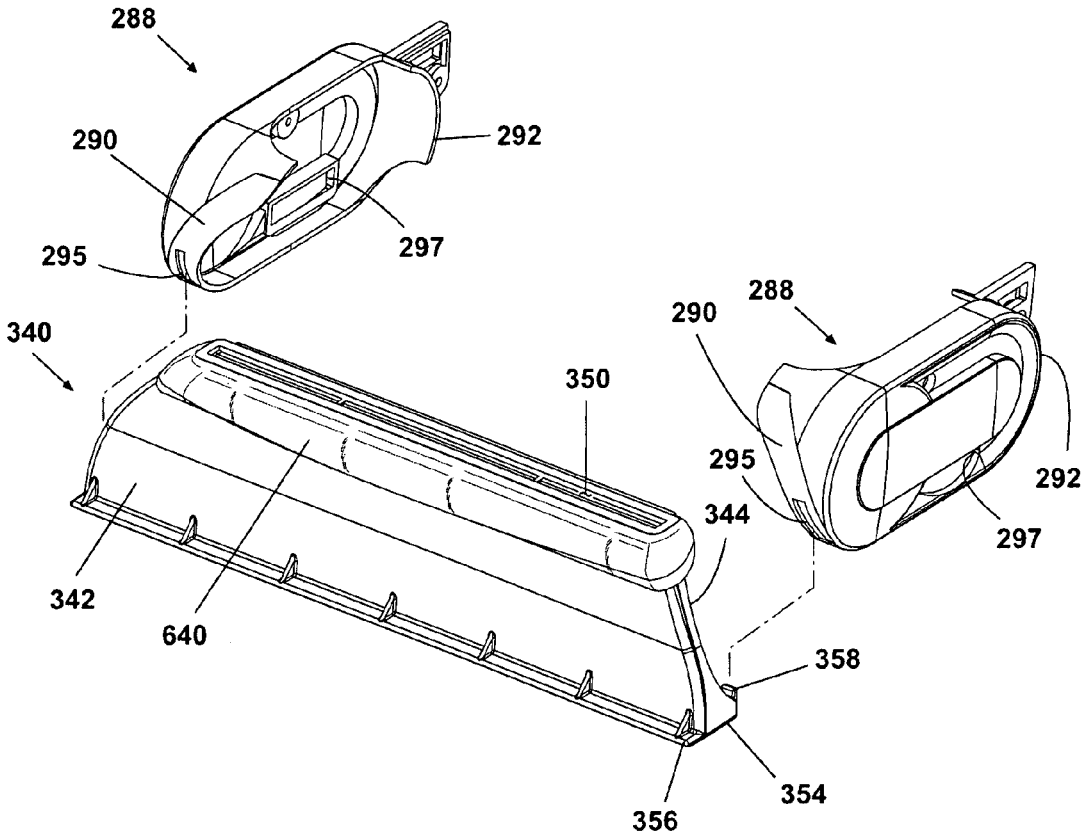
FIG. 34 is an exploded view of the alternative nozzle assembly of FIG. 33.

Referring now to FIGS. 33 and 34, the nozzle assembly 340 rather than the agitator assembly 214 can be configured to float on the surface to be cleaned. Because the agitator assembly 214 has moving parts, it can be somewhat complicated to make the agitator assembly 214 the floating component. By fixing the vertical position of the agitator assembly 214 and allowing the nozzle assembly 340 to float, which does not have any moving parts, the design is simplified while still allowing both the brushrolls 281 and the nozzle opening 348 are in contact with the surface to be cleaned.

In the illustrative embodiment of FIGS. 33 and 34, the nozzle assembly 340 comprises a flexible bellows 640 at an upper end thereof, and the nozzle assembly 340 is coupled to the recovery tank inlet conduit 90 at the flexible bellows 640. The flexible bellows 640 can be configured to be removably mounted to the recovery tank inlet conduit 90 so that the recovery tank inlet conduit 90 can be separated from the nozzle assembly 340 when the recovery tank assembly 22 is removed from the base assembly 20. The flexible bellows 340 contracts when the nozzle assembly 340 moves upward and expands as the nozzle assembly 340 moves downward relative to the recovery tank inlet conduit 90. Furthermore, the nozzle assembly mounting openings 295 in the end caps 288 can be elongated to allow for vertical movement of the nozzle assembly 340 relative to the end caps 288 as the nozzle assembly 340 floats over the surface to be cleaned. Optionally, the nozzle assembly 340 can include a biasing element to apply downward pressure on the nozzle assembly 340 against the surface to be cleaned, as shown in U.S. Pat. No. 2,622,254, which is incorporated herein by reference in its entirety. The nozzle assembly 340 can also be configured to pivot to create the desired floating effect.

Figure 35A:
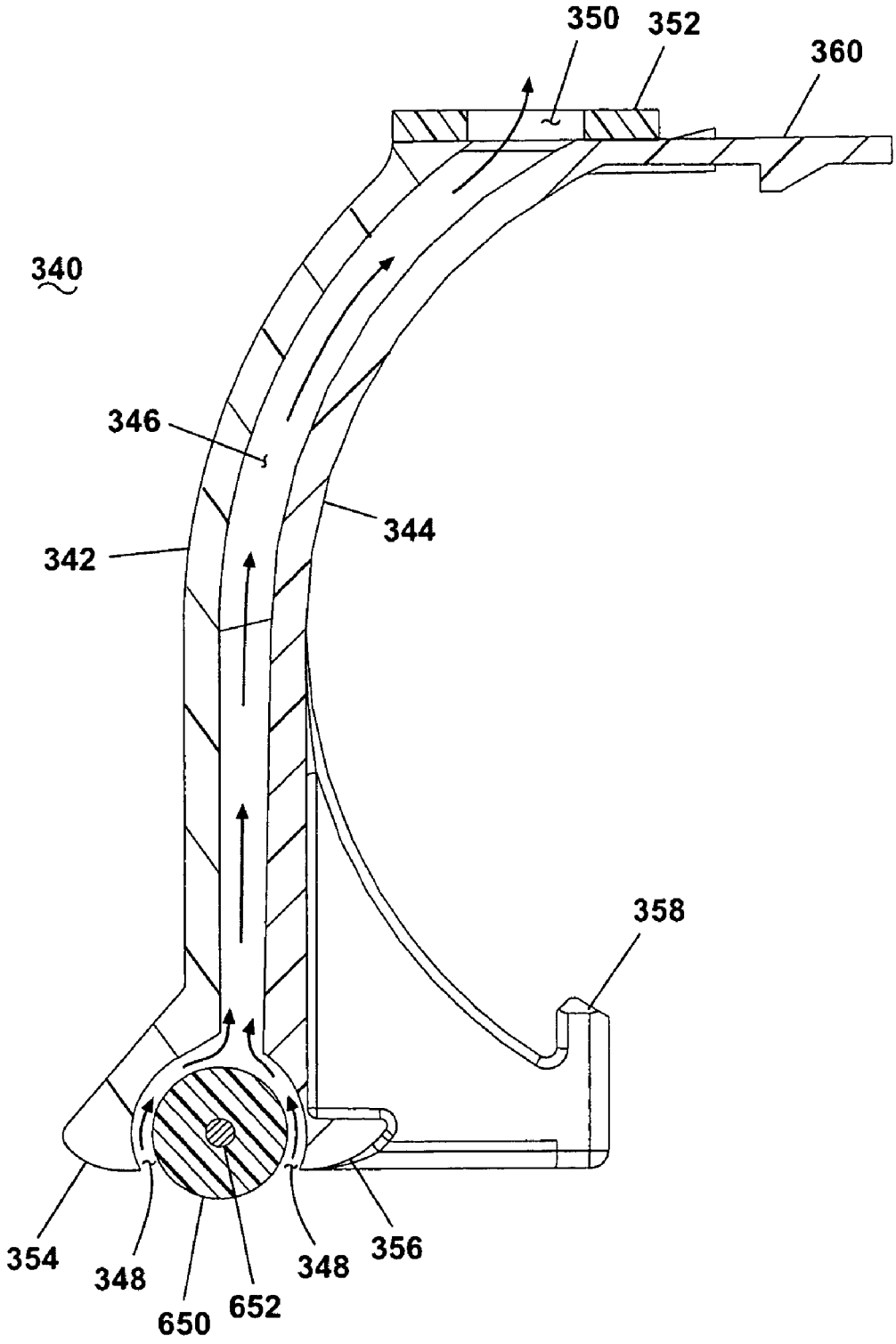
FIG. 35A is a sectional view of another alternative nozzle assembly with a squeegee roller.

Referring now to FIG. 35A, the nozzle assembly 340 can be adapted to include a squeegee roller 650 mounted in the nozzle opening 348. In particular, the squeegee roller 650 is rotatably mounted on an axle 652 such that the squeegee roller 650 rotates when the user moves the extractor 10 in forward and rearward directions. The squeegee roller 650 is centered within the nozzle opening 348 so that air, liquid, and debris can be lifted from the surface to be cleaned and flow in front of and behind the squeegee roller 650 regardless of the direction of movement of the extractor 10 across the surface to be cleaned. The squeegee roller 650 can be a soft covered roller that is safe to use on carpets and bare floors. Advantageously, the squeegee roller 650 has a larger surface area in contact with the surface to be cleaned compared to conventional wiper blade squeegees, and, as a result, additional force can be distributed over a larger area to improve water recovery.

Figure 35B:
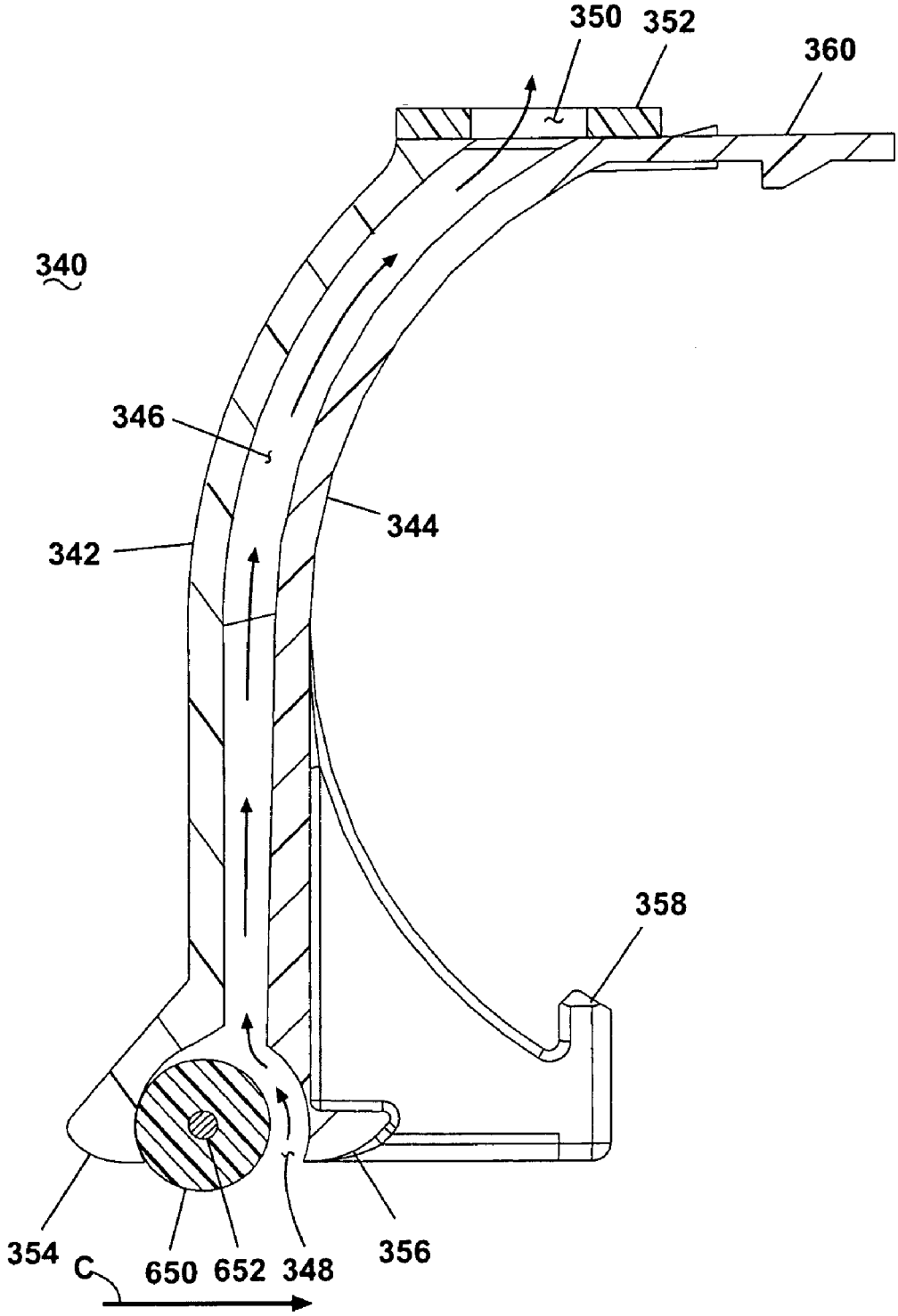
FIG. 35B is a sectional view of another alternative nozzle assembly with a squeegee roller with an axle slidably mounted in the nozzle opening and shown in a position corresponding to rearward movement of the extractor.
Figure 35C:
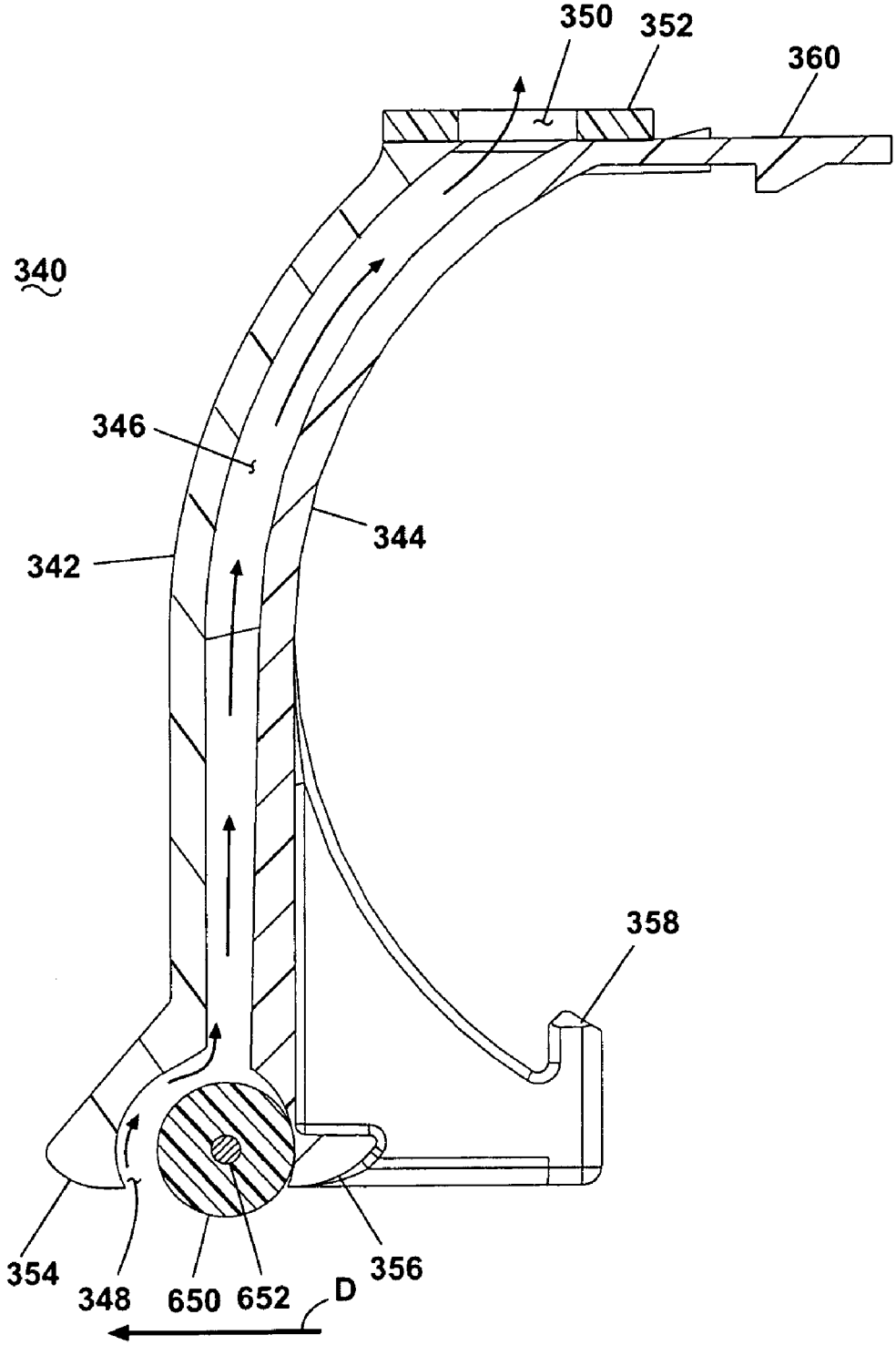
FIG. 35C is a sectional view of the alternative nozzle assembly of FIG. 35B with the squeegee roller shown in a position corresponding to forward movement of the extractor.
Figure 35D:
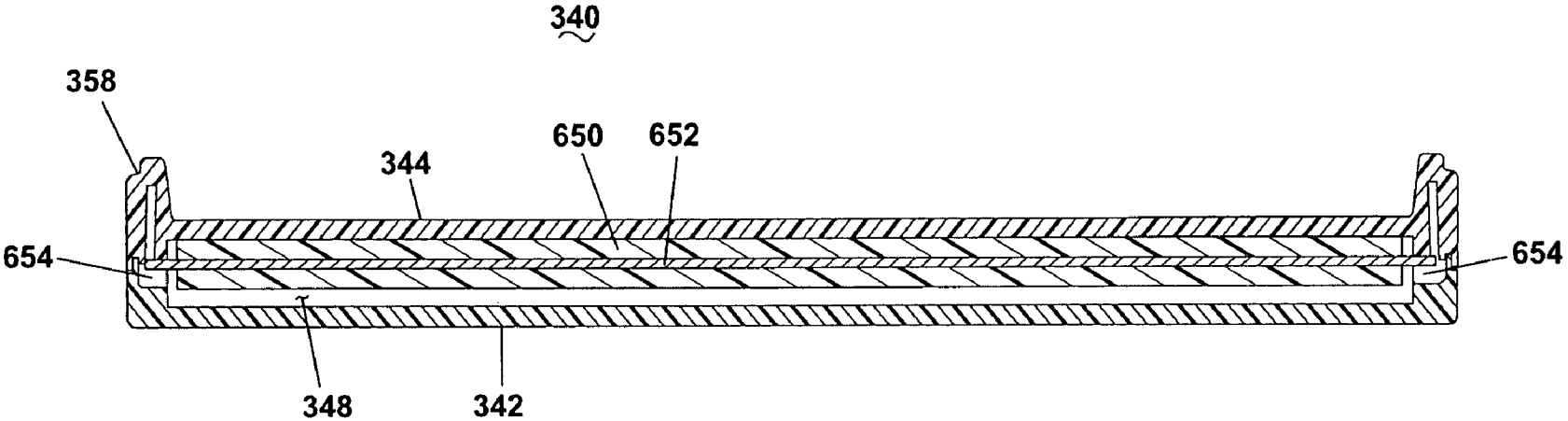
FIG. 35D is a sectional view taken along line an axle of the squeegee roller of FIG. 35C.

Referring now to FIGS. 35B-35D, the squeegee roller 650 can alternatively be configured to slide within the nozzle opening 348 so that the nozzle opening 348 is formed only on the rear side of the squeegee roller 650 when the extractor 10 is moved rearwardly, as indicated by arrow C in FIG. 35B, or only on the front side of the squeegee roller 650 when the extractor 10 is moved forwardly, as indicated by arrow D in FIG. 35C. As shown in FIG. 35D, the axle 652 can be mounted within a track 654 formed in the forward and rearward sections 342, 344 of the nozzle assembly 340. The axle 652 can slide forward and rearward within the track 654 to slide the squeegee roller 650 forward and rearward within the nozzle opening 348.

The agitator assembly 214 has been shown and described as comprising the pair of horizontal axis brushrolls 280. Alternatively, the agitator assembly 214 can comprise other types of commonly known agitators and agitation drive mechanisms, including, but not limited to, vertical axis brushes, scrubbing pads, sponges, clothes, and the like. Furthermore, the agitator assembly 214 can comprise multiple types of agitators. For example, the agitator assembly 214 can comprise one of the horizontal axis brushrolls 280 and a row of vertical axis brushes, such as those disclosed in U.S. Pat. No. 6,009,593, which is incorporated herein by reference in its entirety. The horizontal axis brushroll 280 can be parallel with the row of vertical axis brushes and can be positioned in front of or behind the row of vertical axis brushes. The horizontal axis brushroll 280 and the row of vertical axis brushes can be driven by the same power source, such as the agitator motor 220, or separate power sources. The horizontal axis brushroll 280 and the row of vertical axis brushes can be coupled so that rotation of one induces rotation of the other. Optionally, the row of vertical axis brushes can be configured to oscillate back and forth to ensure that both side of the carpet are cleaned.

The extractor 10 can further comprise a speed sensor that detects the relative speed of the foot assembly 12 relative to the surface to be cleaned and generates a signal representative of the speed and an indicator coupled to the speed sensor to display to the user an indication representative of the signal. An example of the speed sensor and indicator are disclosed in U.S. Pat. No. 6,800,140, which is incorporated herein by reference in its entirety. The indicator communicates to the user whether the speed of the foot assembly 12 is within an optimal speed range for optimal cleaning performance. The optimum speed range for a standard soil level can be preprogrammed into a microprocessor coupled to the speed sensor and the indicator, or the optimum speed range can be determined by other factors, examples of which are provided in the incorporated '140 patent. Optionally, the user can input a soil level, and the microprocessor can be programmed with a plurality of optimum speed ranges corresponding to different soil levels. For example, the soil level can be input by selecting the cleaning mode through the cleaning mode knob 384, and the cleaning mode switch 386 communicates the soil level to the microprocessor. Alternatively, the extractor 10 can comprise a separate selector mounted on the foot assembly 12 or the handle assembly 14 for inputting the soil level.

Figure 36A:
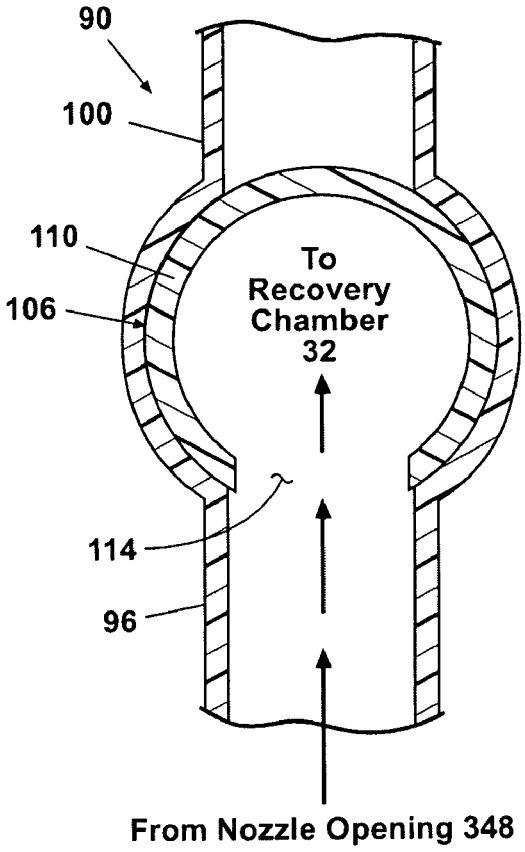
FIG. 36A is a schematic view of the diverter of FIG. 10A, wherein the diverter is shown in the floor cleaning mode.
Figure 36B:
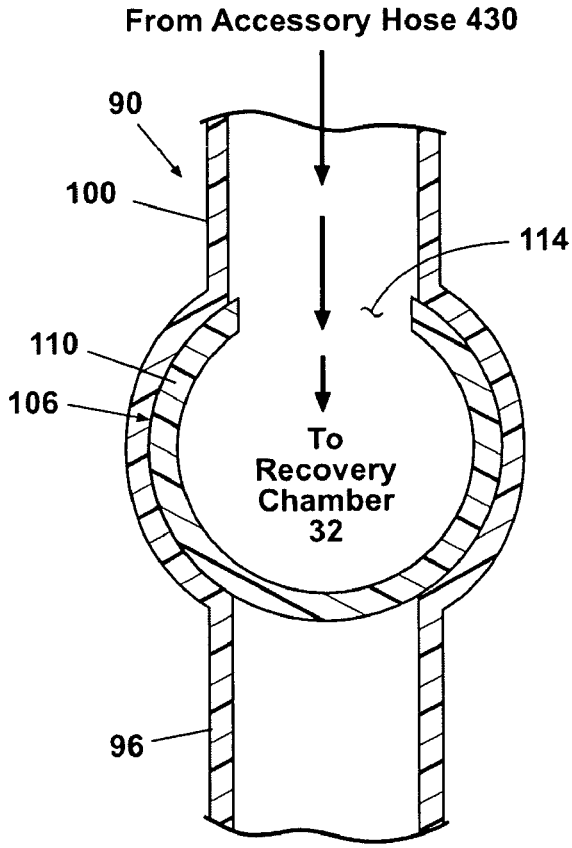
FIG. 36B is a schematic view similar to FIG. 36A, wherein the diverter is shown in the accessory cleaning mode.

Referring now to FIGS. 36A and 36B, the recovery tank inlet conduit 90 has been described as comprising the nozzle conduit section 96 that fluidly couples the nozzle opening 348 to the recovery chamber 32 and the accessory conduit section 100 that fluidly couples the accessory house 430 to the recovery chamber 32, and the diverter valve 106 selectively blocks fluid communication between the recovery chamber 32 and one of the nozzle conduit section 96 and the accessory conduit section 100. As shown schematically in FIG. 36A, the peripheral flange 110 of the diverter valve 106 blocks the accessory conduit section 100 in the floor cleaning mode so that the working air path, as indicated by arrows, extends from the nozzle conduit section 96 and into the recovery chamber 32 (in a direction into the page). Referring to FIG. 36B, the peripheral flange 110 blocks the nozzle conduit section 96 in the accessory cleaning mode so that the working air path, as indicated by arrows, extends from the accessory conduit section 100 and into the recovery chamber 32 (in a direction into the page).

Figure 36C:
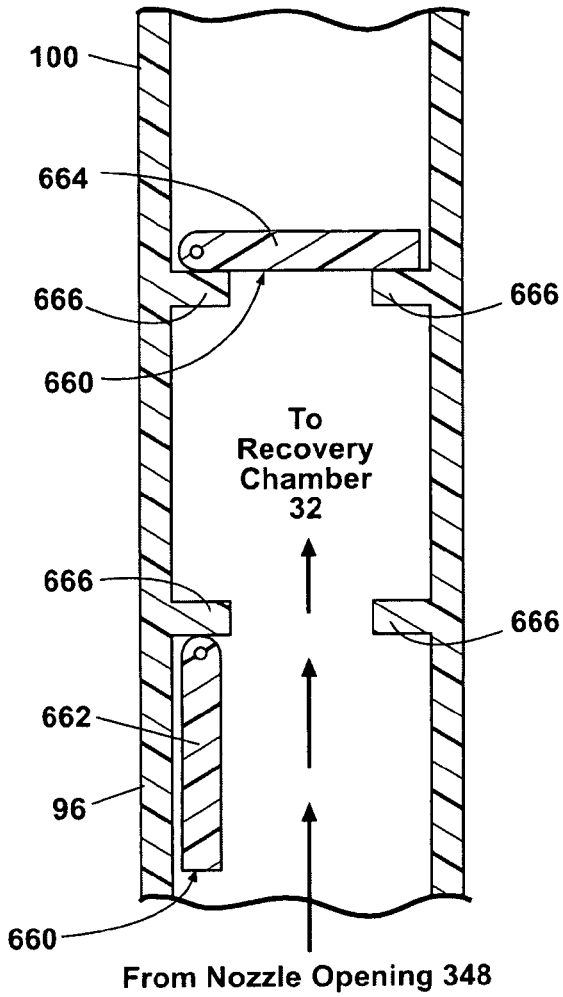
FIG. 36C is a schematic view similar to FIG. 36A of an alternative diverter assembly shown in a floor cleaning mode.
Figure 36D:
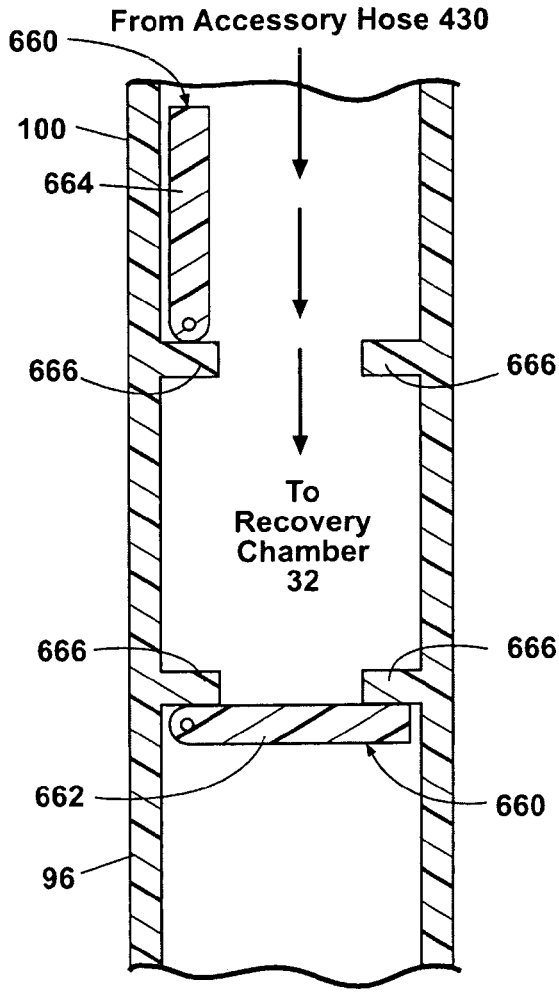
FIG. 36D is a schematic view similar to FIG. 36C, wherein the diverter assembly is shown in an accessory cleaning mode.

An alternative diverter valve assembly 660 is illustrated in FIGS. 36C and 36B. The diverter valve assembly 660 comprises a nozzle door 662 and an accessory door 664 movable mounted within the recovery tank inlet conduit 90. The nozzle door 662 is pivotable between an opened position, as shown in FIG. 36C, to allow fluid communication between the nozzle opening 348 and the recovery chamber 32 and a closed position, as illustrated in FIG. 36D, to block fluid communication between the nozzle opening 348 and the recovery chamber 32. Similarly, the accessory door 664 is pivotable between a closed position, as shown in FIG. 36C, to block fluid communication between the accessory hose 430 and the recovery chamber 32 and an opened position, as illustrated in FIG. 36D, to allow fluid communication between the accessory hose 430 and the recovery chamber 32. When the nozzle door 662 is in the opened position, the accessory door 664 is in the closed position for the floor cleaning mode, as shown in FIG. 36C. Conversely, when the accessory door 664 is in the opened position, the nozzle door 662 is in the closed position for the accessory cleaning mode, as illustrated in FIG. 36B. The nozzle door 662 and the accessory door 664 can be coupled so that the doors 662, 664 move in concert for conversion between the floor and accessory cleaning modes. The doors 662, 664 can be mechanically coupled or electrically coupled, and movement of a single switch, which can be located on the foot assembly 12 or the handle assembly 14, by the user can convert the diverter valve assembly 660 from the floor cleaning mode to the accessory cleaning mode. Advantageously, because the motor and fan assembly 228 are positioned downstream from the recovery chamber 32, the door 662, 664 that is in the closed position is maintained in the closed position by the suction forces generated by the motor and fan assembly 228. The nozzle conduit section 90 can include door stops 666 that the doors 662, 664 abut when in the closed position.

Figure 37A:
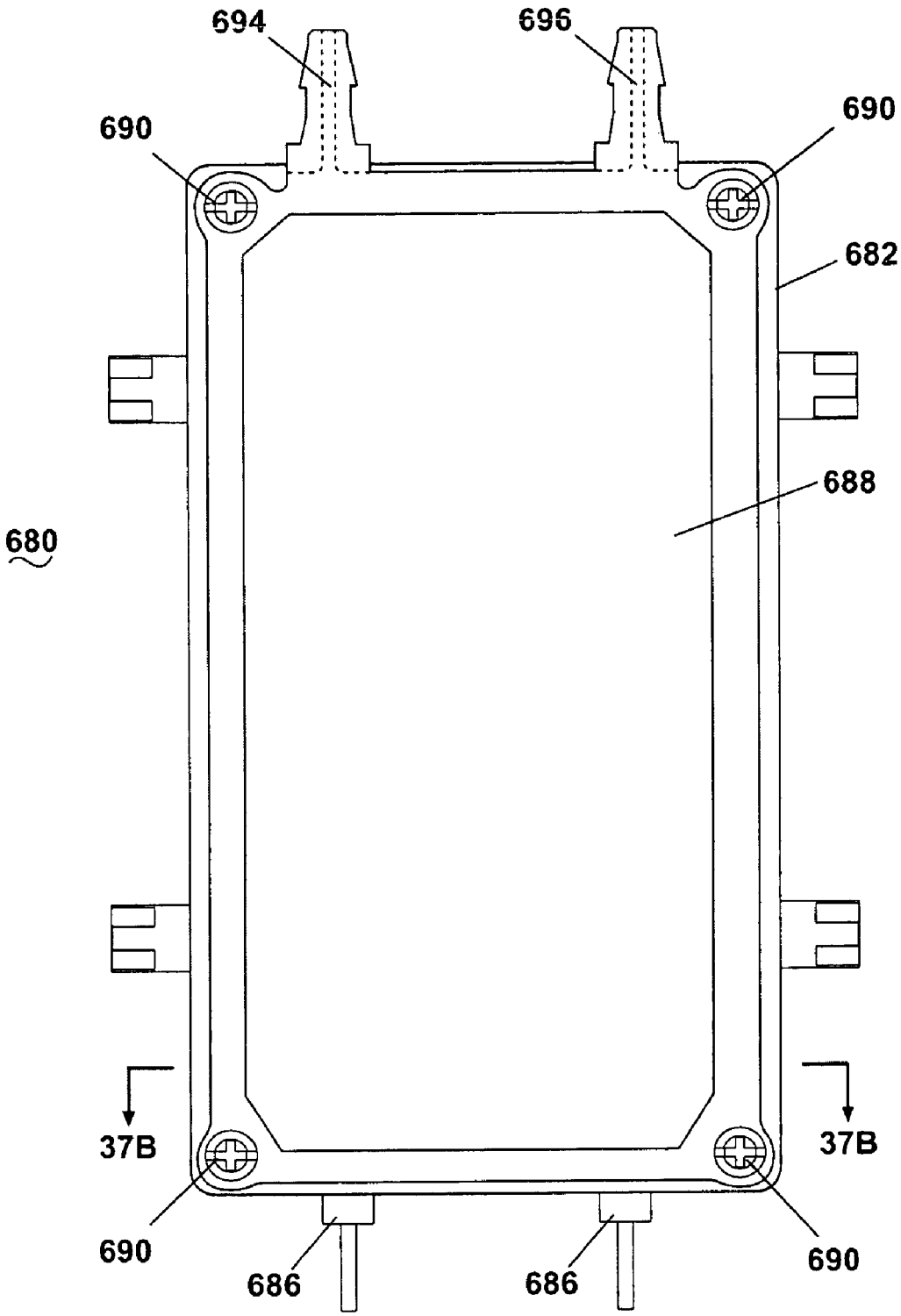
FIG. 37A is a top view of an alternative heater for use with the fluid delivery system of FIG. 24.
Figure 37B:
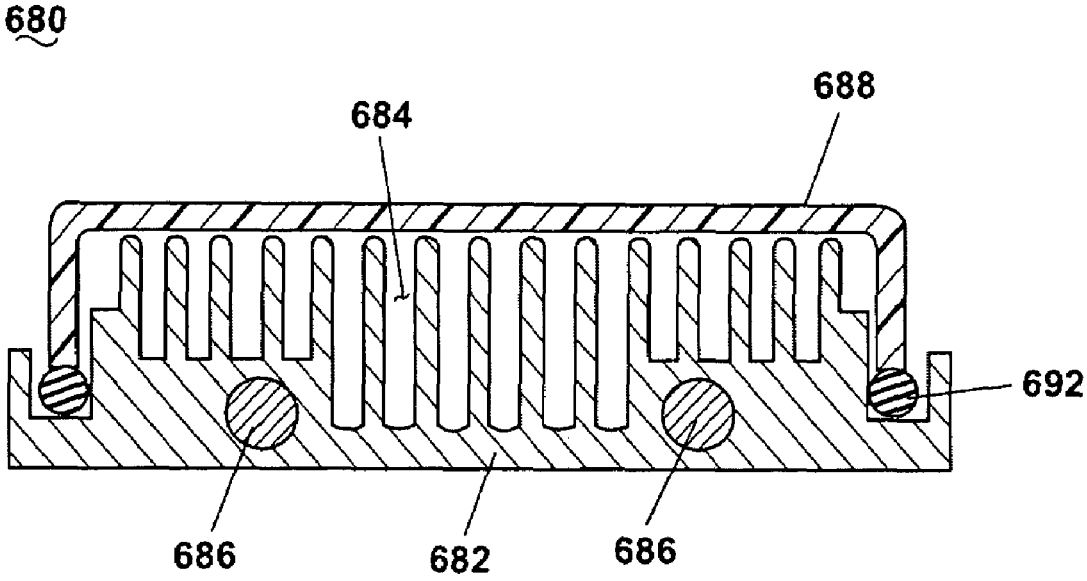
FIG. 37B is a sectional view taken along line 37B-37B of FIG. 37A.

An alternative heater 680 for heating the cleaning fluid is illustrated in FIGS. 37A and 37B. The heater 680 is similar to the heater disclosed in the aforementioned and incorporated U.S. Pat. No. 6,131,237 in that the heater 660 comprises a metallic body 682, such as an aluminum body, that forms a serpentine fluid channel 684 with an open upper end and houses a heating element 686. The heater 680 further comprises a polymeric cover 688 mounted to the body 682 by mechanical fasteners 690, such as screws, with a gasket 692 therebetween. The cover 688 comprises a fluid inlet port 694 and a fluid outlet port 696, which are preferably integrally molded with the cover 688. When the cover 688 is mounted to the body 682, the cover 688 closes the open upper end of the fluid channel 684, and the fluid inlet port 694 and the fluid outlet port 696 provide an inlet and an outlet, respectively, to the fluid channel 684. During operation, the cleaning fluid flows through the fluid inlet port 694 into the fluid channel 684 and exits the fluid channel 684 through the fluid outlet port 696. As the cleaning fluid flows through the fluid channel 684, heat from the heating element 686 conducts through the body 682 and to the cleaning fluid to thereby heat the cleaning fluid.

Figure 38:
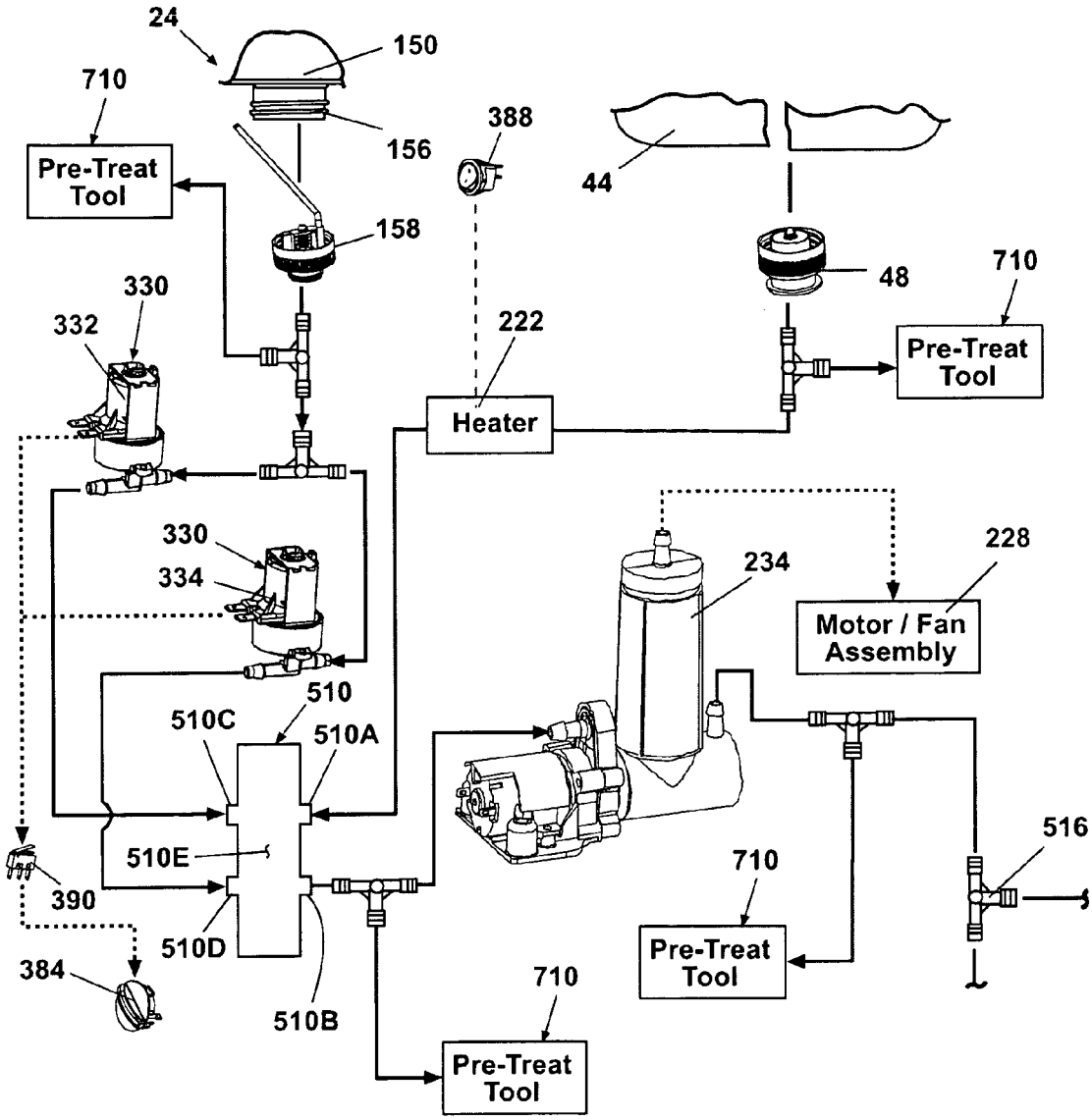
FIG. 38 is a schematic view of a portion of the fluid delivery system shown in FIG. 24 with the addition of a manual pre-treat tool that can be fluidly coupled to the fluid delivery system in any of several locations.

The fluid delivery system can further comprise a manual pre-treat tool 710 mounted to the extractor 10 for manually applying the cleaning fluid to the surface to be cleaned. As shown in FIG. 38, which schematically illustrates a portion of the fluid delivery system shown in FIG. 24, the pre-treat tool 710 can be fluidly connected to the fluid delivery system at a plurality of locations, such as, for example, downstream from the solution supply tank assembly 24 and upstream of the metering valve assembly 330, downstream from the bladder 44 and upstream of the mixing manifold 510, downstream from the mixing manifold 510 and upstream of the pump assembly 234, and downstream of the pump assembly 234 and upstream of the tee 516. When the pre-treat tool 710 is coupled to the fluid delivery system downstream of the pump assembly 234, the cleaning fluid provided to the manual pre-treat tool 710 is pressurized by the pump assembly 234.

Figure 39A:
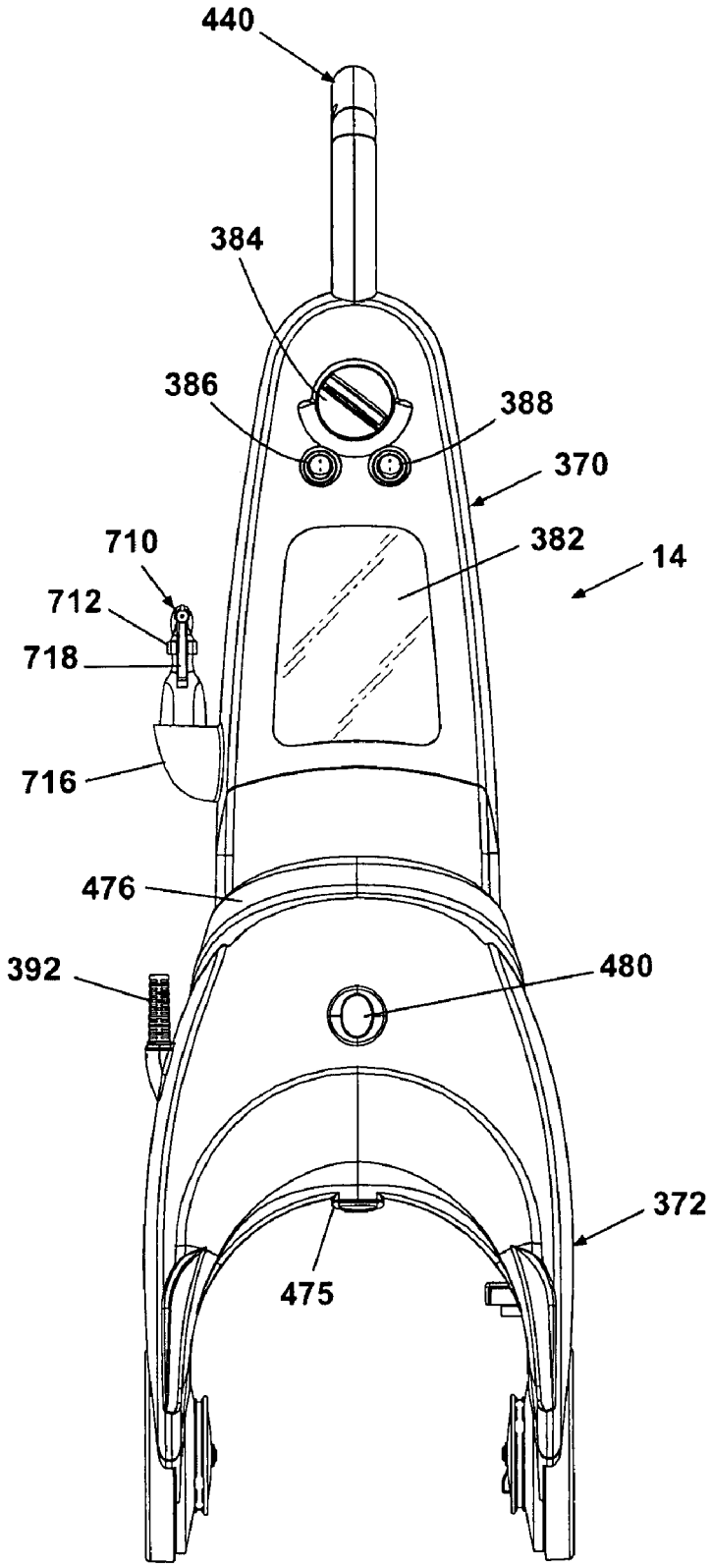
FIG. 39A is a front view of the handle assembly of FIG. 1 with the manual pre-treat tool of FIG. 38A mounted in a pocket on the handle assembly.
Figure 39B:
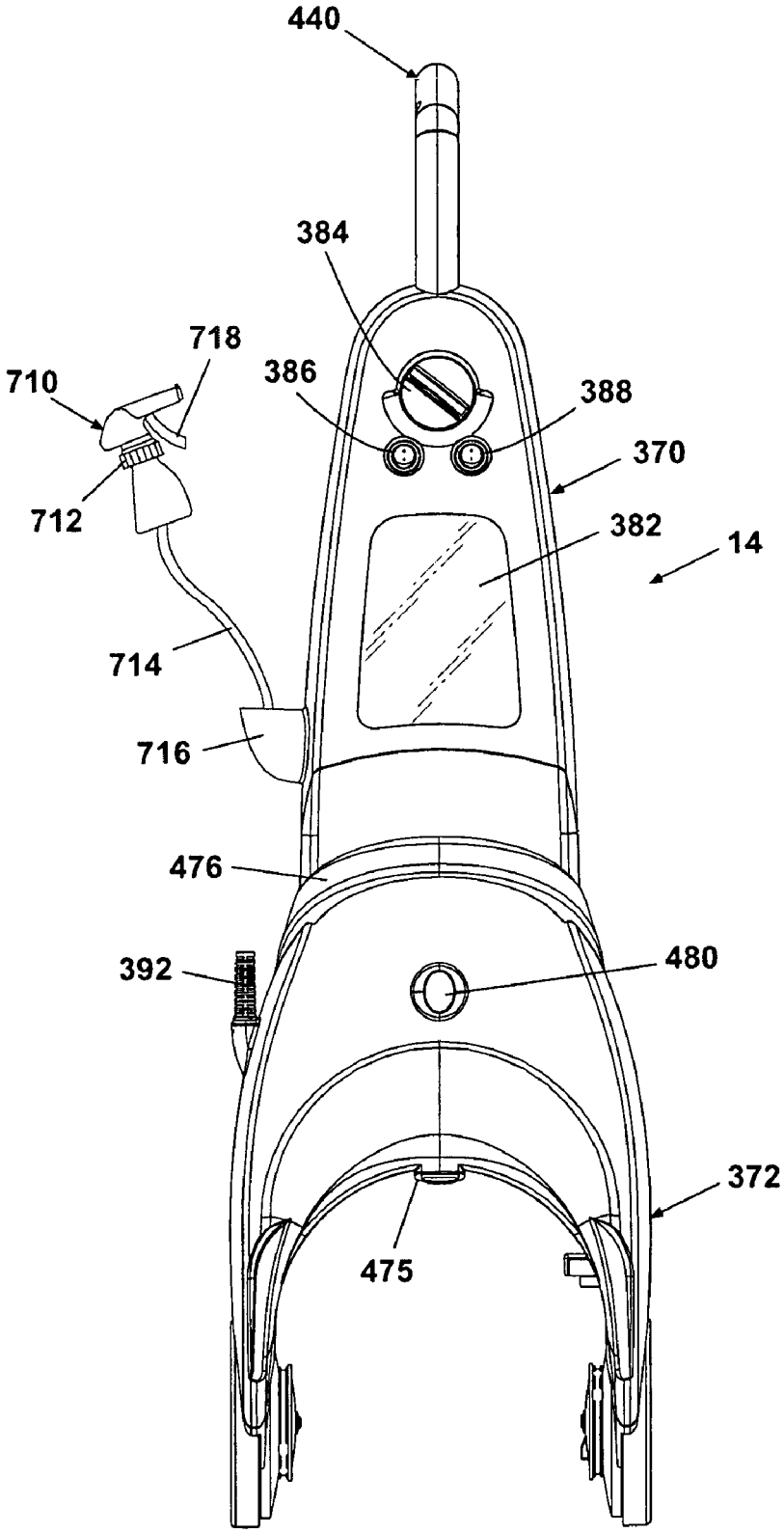
FIG. 39B is a front view similar to FIG. 39A with the manual pre-treat tool removed from the pocket for use.

Referring now to FIGS. 39A and 39B, the pre-treat tool 710 can be mounted to the handle assembly 14 and comprise a hand-held applicator 712 fluidly coupled to the fluid delivery system by a conduit 714. When not in use, the pre-treat tool 710 can be stored in a pocket 716 mounted to the handle assembly 14. The conduit 714 can be folded into the pocket 716 when the pre-treat tool 710 is not in use, or the conduit 714 can be retractable into the handle assembly 14. Optionally, if the cleaning fluid is not provided to the pre-treat tool 710 in a pressurized condition, the applicator 712 can include a manual pump operable by a trigger 718 similar to conventional manual spray pumps for dispensing fluids from bottles. During operation, if the user detects a heavily soiled area, the user can remove the applicator 712 from the pocket 716 and apply the cleaning fluid to the heavily soiled area before using the extractor 10 to clean the heavily soiled area. After the cleaning fluid is applied to the heavily soiled area with the pre-treat tool 710, the user replaces the applicator 712 in the pocket 716.

Figure 40A:
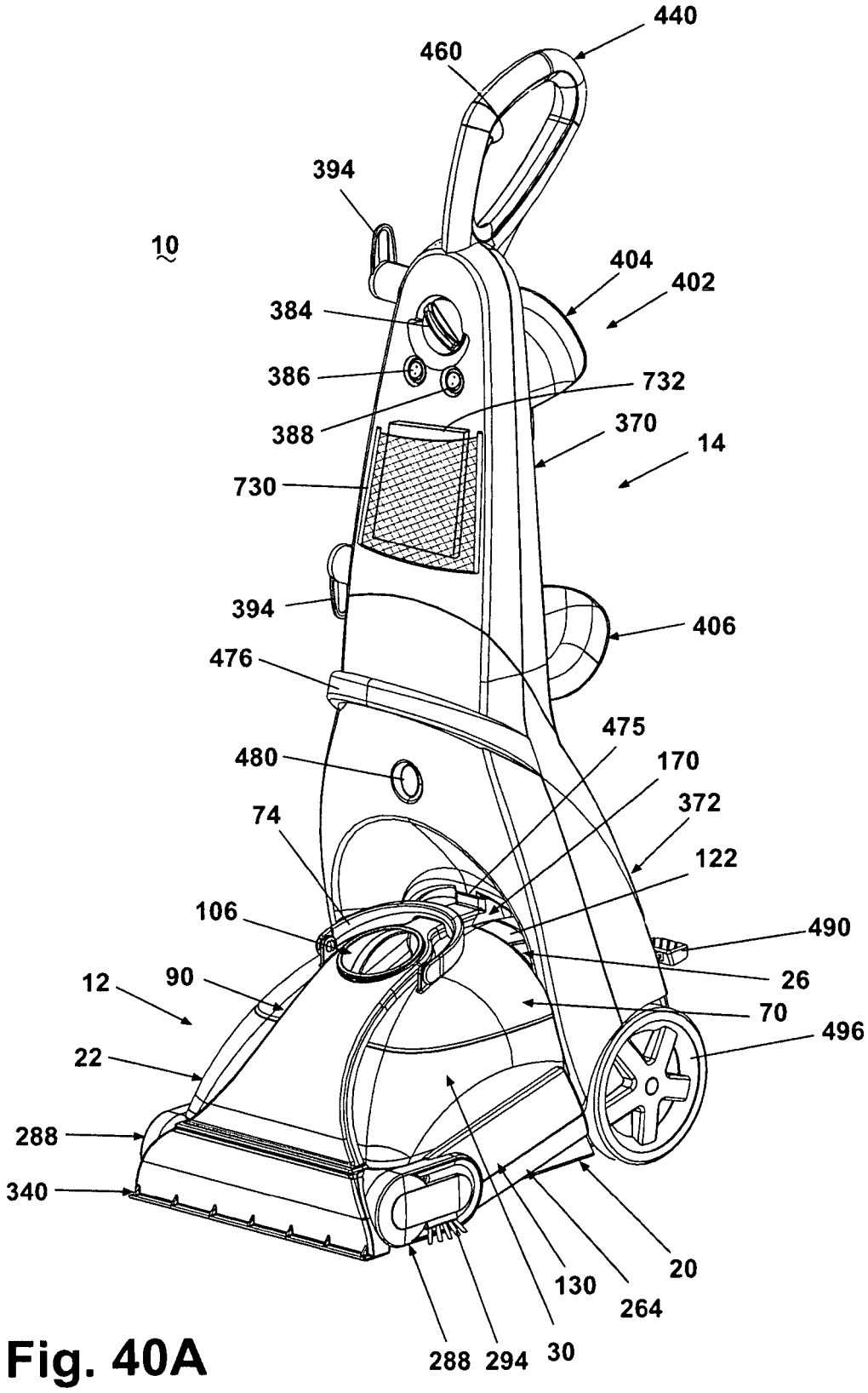
FIG. 40A is a perspective view of the extractor similar to FIG. 1 with the addition of a user's manual storage compartment located on a front side of the handle assembly.
Figure 40B:
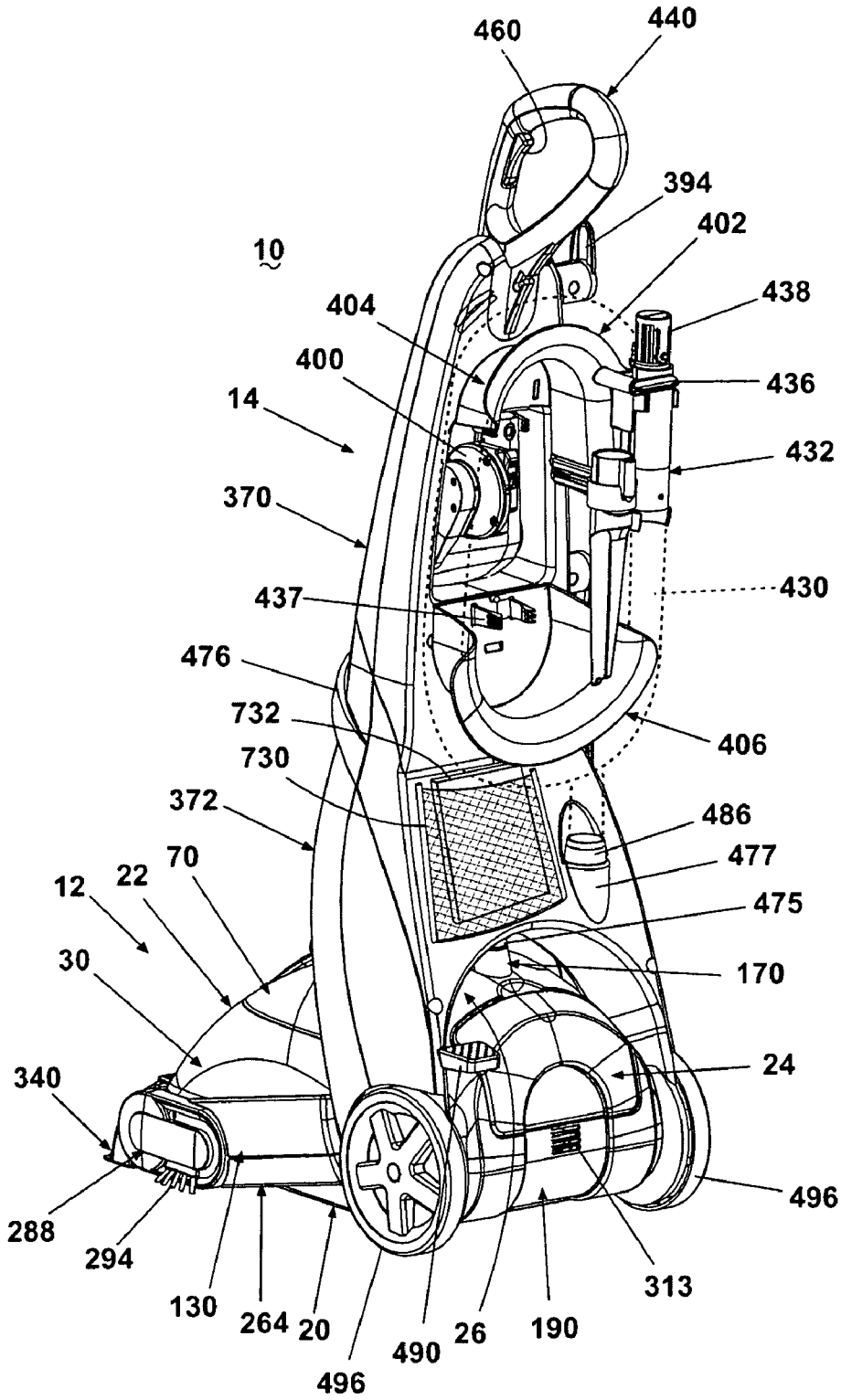
FIG. 40B is a perspective view of the extractor similar to FIG. 3 with the addition of a user's manual storage compartment located on a rear side of the handle assembly.

Referring now to FIGS. 40A and 40B, the extractor 10 can comprise a storage compartment 730 for storing a user's manual 732. The storage compartment 730 can be disposed in any suitable location on the extractor 10 and is shown in FIGS. 40A and 40B as located on the handle assembly 14. In FIG. 40A, the storage compartment 730 is illustrated as being located on a front side of the handle assembly 14, while FIG. 40B shows the storage compartment 730 on a rear side of the handle assembly 14. The storage compartment 730 can be constructed of any suitable materials and is shown in the figures as a mesh bag. Because the user's manual 732 can be stored directly on the extractor 10, the user can readily refer to the user's manual 732 when needed rather than searching for the user's manual 732 in an alternate location in the home.

Figure 41:
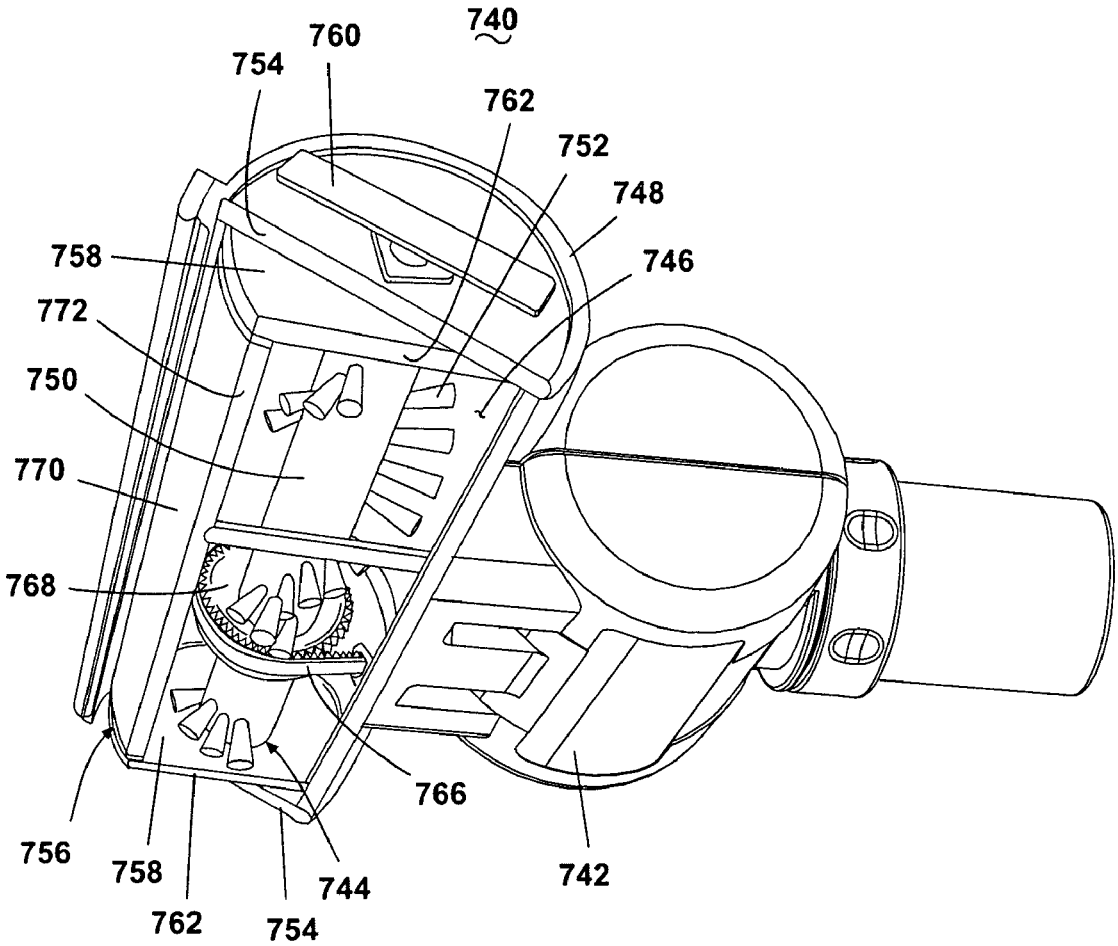
FIG. 41 is bottom perspective view of a power brush accessory tool that can be used with the extractor of FIG. 1.

As stated above, the extractor 10 can be used with any type of accessory, such as the power brush accessory tool 400, in the accessory cleaning mode. An alternative power brush accessory tool 740 is illustrated in FIG. 41 and comprises a main body 742 that houses a motor (not shown) for powering an agitator 744 disposed in an agitator chamber 746 formed by an arcuate, downwardly facing agitator housing 748 that extends forwardly from the main body 742 and terminates at a generally flat, rectangular edge 754 to define at a rear edge thereof a rear portion of a suction nozzle opening. In the illustrated embodiment, the agitator 744 is a horizontal axis brushroll 750 that supports a plurality of radially extending bristles 752 as is well-known in the vacuum cleaner and extractor art. The brushroll 750 is driven by the motor through a well-known belt drive 766 and sprocket 768 on the brushroll 750.

The power brush accessory tool 740 further includes a brush height mechanism comprising a height adjustor 756 rotatably mounted within the agitator chamber 746. The height adjuster 756 comprises a pair of end walls 758 coupled together through a front wall 770 and manually rotatable about an axis coincident with the rotational axis of the agitator 744. The front wall 770 has a flat edge that forms a front portion of the suction nozzle opening. Rotation of the height adjustor 756 is accomplished by rotation of an adjustor knob 760 mounted on one end of the agitator housing 748. Each of the end walls 758 is a generally circular disc having a generally flat bottom edge 762 that rotates with the front wall 770 relative to the rectangular flat edge 754 of the agitator housing 748 when the height adjustor 756 rotates relative to the agitator housing 748 via rotation of the adjustor knob 760. The relative positioning of the rectangular flat edge 754 and the front edge 772 determines a height of the agitator 744 relative to the surface to be cleaned; this concept is more clearly shown in the schematic illustrations of FIGS. 42A and 42B.

Figure 42A:
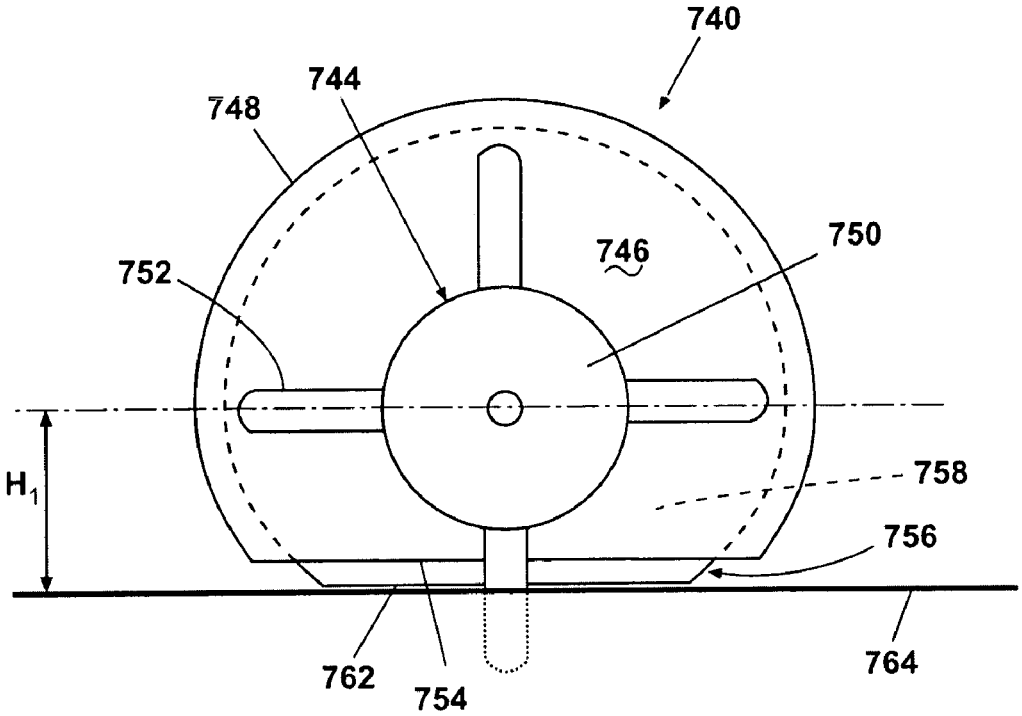
FIG. 42A is a schematic view of an agitator housing and height adjustor of the power brush accessory tool of FIG. 41, wherein the height adjustor is positioned to locate an agitator at a minimum height relative to the surface to be cleaned.
Figure 42B:
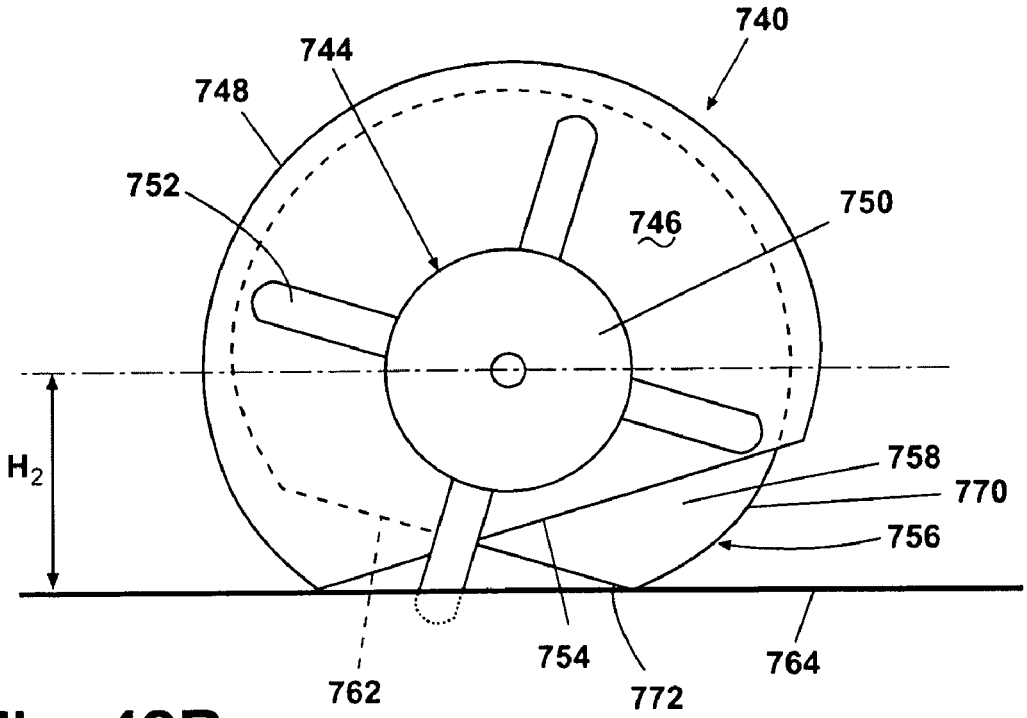
FIG. 42B is a schematic view similar to FIG. 42A, wherein the height adjustor is positioned to raise the agitator to a height greater than the minimum height.

As shown in FIG. 42A, when the height adjustor 756 is positioned so that the flat edges 754, 762 are generally parallel, the power brush accessory tool 740 rests on the flat edge 762 of the height adjustor 756, and the agitator 744 is located at a minimum height $H_1$ relative to the surface to be cleaned, which is identified with reference numeral 764 in FIGS. 42A and 42B. As a result, a maximum surface area of the bristles 752 contacts the surface to be cleaned 764. In the schematic illustration of FIG. 42A, the portion of the bristle 752 shown in dotted lines represents the portion of the bristle 752 that can either flex on top of the surface to be cleaned 764 and/or penetrate carpet fibers when the surface to be cleaned 764 is carpet.

As illustrated in FIG. 42B, when the height adjustor 756 is rotated so that the flat edges 754, 762 are not parallel, the power brush accessory tool 740 rests partially on the height adjustor 756 and partially on the agitator housing 748, which raises the agitator 744 to a height $H_2$ greater than the minimum height $H_1$ relative to the surface to be cleaned 764. Consequently, less surface area of the bristles 752 contacts the surface to be cleaned 764. As with FIG. 42A, the portion of the bristle 752 shown in dotted lines in FIG. 42B represents the portion of the bristle 752 that can either flex on top of the surface to be cleaned 764 and/or penetrate carpet fibers when the surface to be cleaned 764 is carpet.

The height adjustor 756 can be utilized in surface cleaning devices other than the power brush accessory tool 740. For example, the height adjustor 756 can be utilized in foot assemblies of upright vacuum cleaners and other accessory tools. Additionally, the end walls 758 of the height adjustor 756 can have any suitable shape and are not limited to circular discs. For example, the end walls 758 can be triangular or rectangular.

Referring now to FIGS. 43A-43D, the heater indicator 478 shown in FIG. 20 for communicating the operational status of the heater 222 to the user can be replaced with a flow indicator 780 that communicates to the user when the cleaning fluid is flowing through the fluid delivery system to the surface to be cleaned. The flow indicator 780 can be positioned in any suitable location in the fluid delivery system schematically illustrated in FIG. 24 and can indicate when the cleaning fluid is supplied to the spray tips 218, the accessory tool handle 432, or both.

Figure 43A:
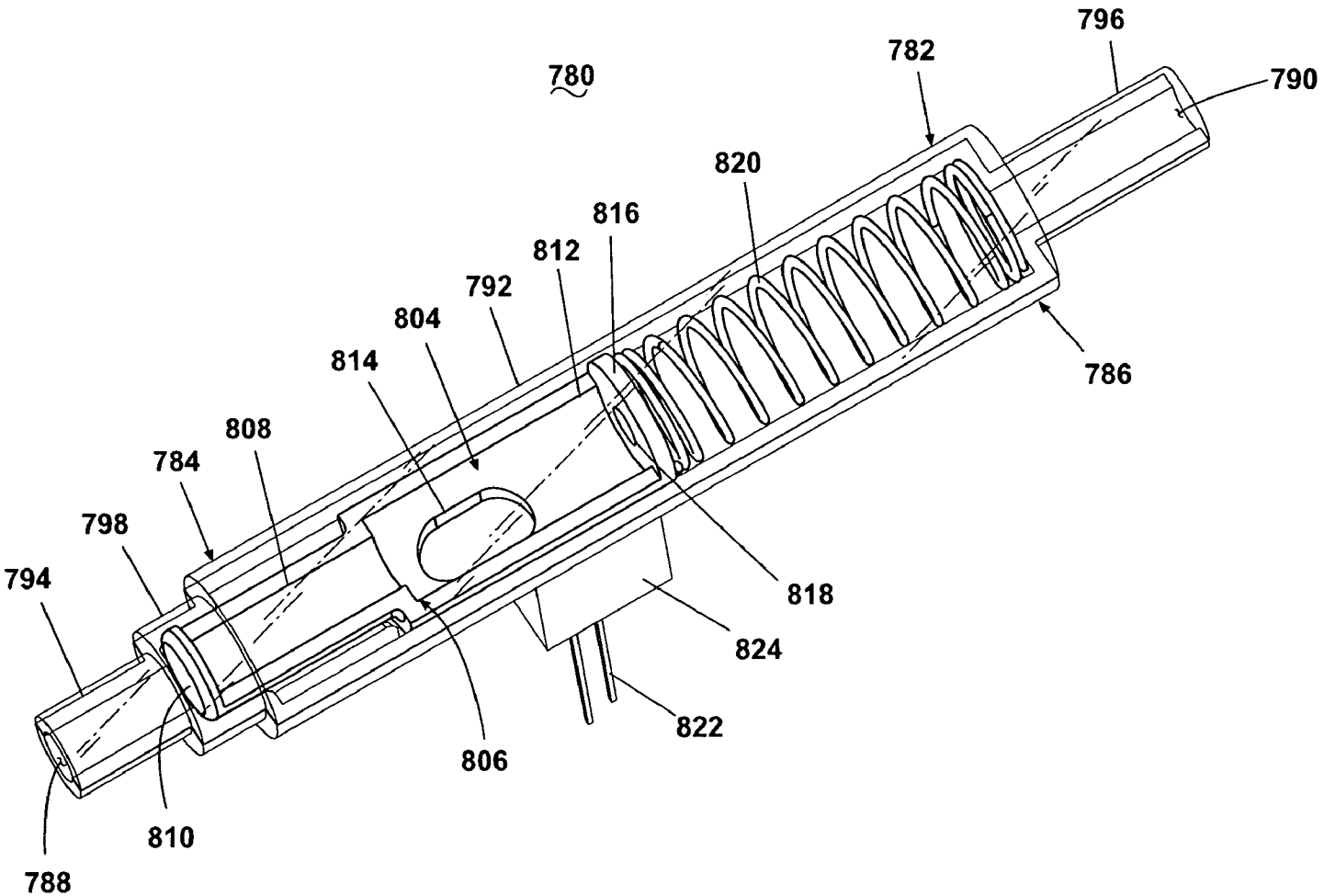
FIG. 43A is a perspective view of a flow indicator for use with the extractor of FIG. 1 and shown in a non-flow condition.
Figure 43B:
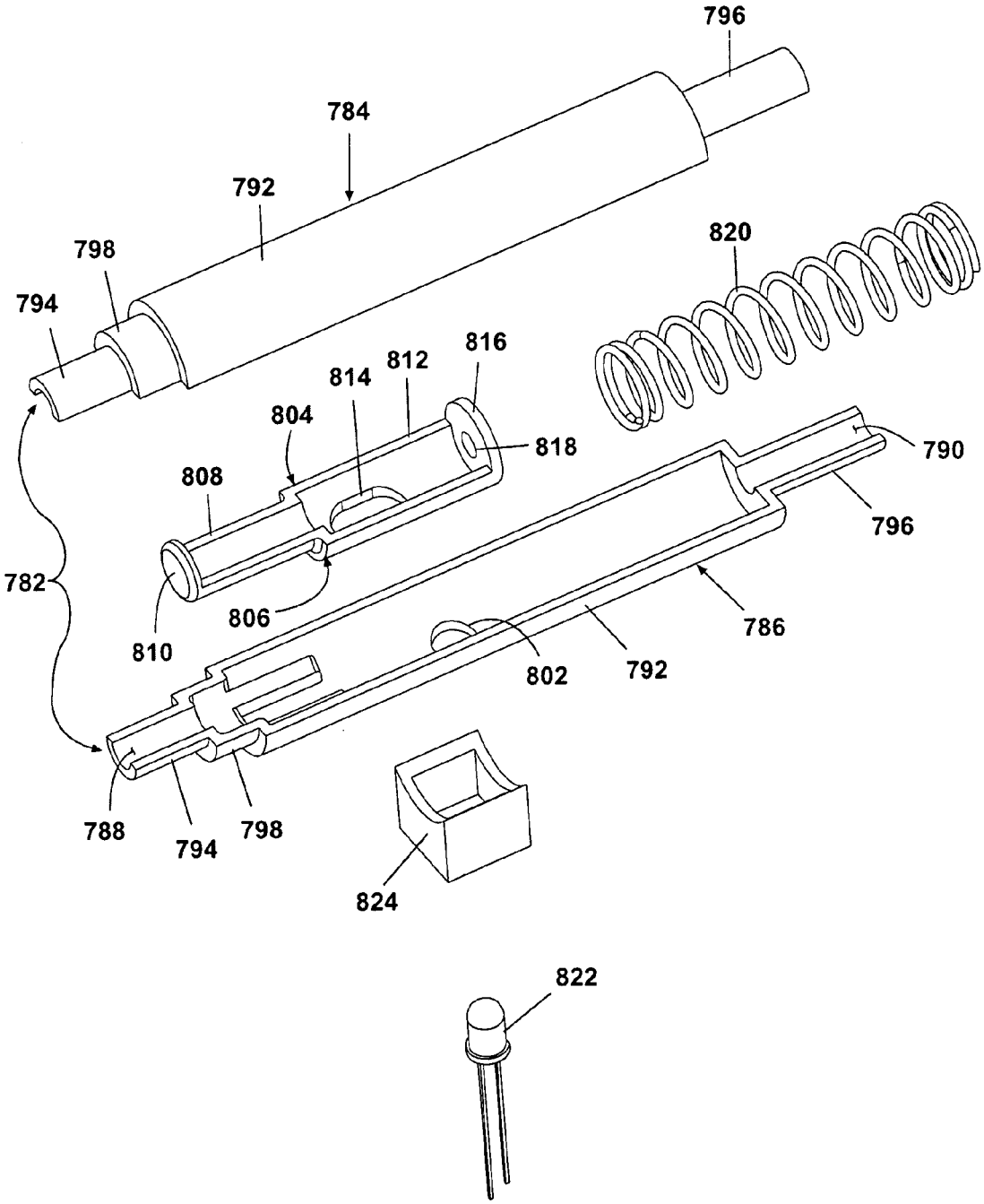
FIG. 43B is an exploded view of the flow indicator of FIG. 43A.
Figure 43C:
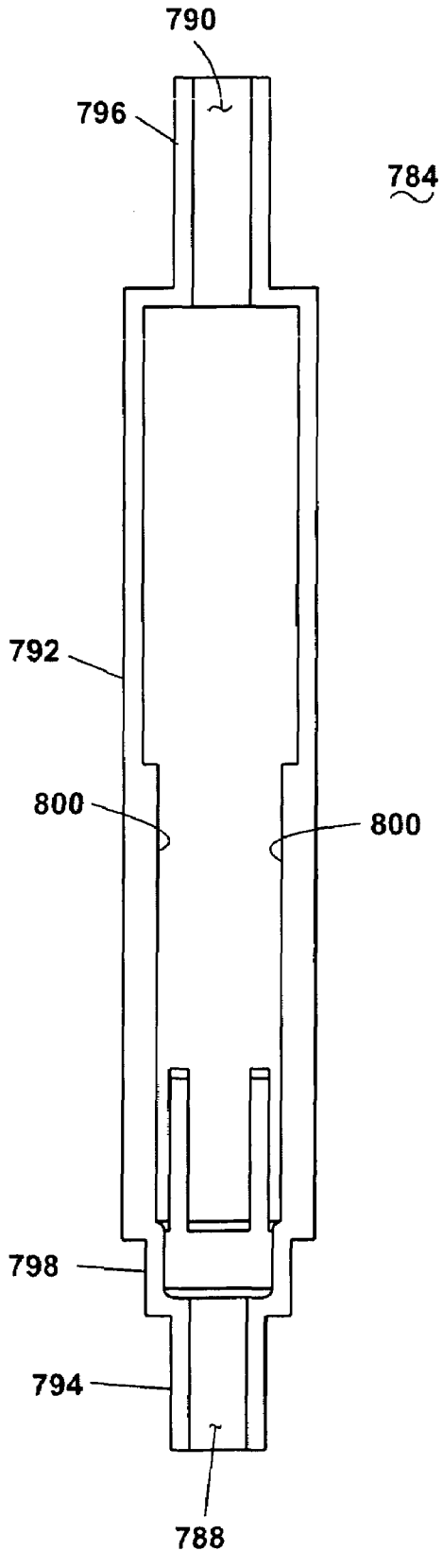
FIG. 43C is a bottom perspective view of an upper housing of the flow indicator of FIG. 43A.

As shown in FIGS. 43A-43C, the flow indicator 780 comprises a generally cylindrical indicator housing 782 formed by an upper housing 784 and a lower housing 786 that mate to form a generally hollow fluid conduit that extends from a fluid inlet 788 to a fluid outlet 790. The indicator housing 782 includes a central section 792 having a relatively large inner diameter, terminal sections 794, 796 that form the fluid inlet 788 and the fluid outlet 790, respectively, and have a relatively small inner diameter, and an intermediate section 798 between the inlet terminal section 794 and the central section 792 and having an inner diameter between those of the central and terminal sections 792, 794, 796. The upper housing 784 is at least partially transparent or translucent and includes a pair of longitudinal ribs 800 disposed in the central section 792 and extending from the intermediate section 798 to about half the distance between the intermediate section 798 and the outlet terminal section 794. The lower housing 786 includes a light aperture 802 formed in the central section 792.

Referring now to FIG. 43B, the flow indicator 780 further comprises a piston 804 slidably mounted in the indicator housing 782. The piston 804 comprises a generally semi-cylindrical body 806 having a smaller diameter portion 808 that terminates at a generally circular piston member 810 and a larger diameter portion 812 having an elongated light opening 814 formed therein and terminating at a generally circular endwall 816 having a central fluid opening 818. The smaller diameter portion 808 is sized for receipt within the intermediate section 798 of the indicator housing 782, and the larger diameter portion 812 is sized for receipt within the central section 792 of the indicator housing 782. A biasing member 820 disposed in the central section 792 between the outlet terminal section 796 and the endwall 816 of the piston 804 biases the piston 804 toward the intermediate section 798 to the position shown in FIG. 43A.

As best seen in FIG. 43B, the flow indicator 780 further comprises an illumination source 822, such as a light emitting diode (LED), mounted within an illumination source housing 824. The illumination source housing 824 is in register with the light aperture 802 in the lower housing 786 so that light from the illumination source 822 can transmit through the light aperture 802.

Figure 43D:
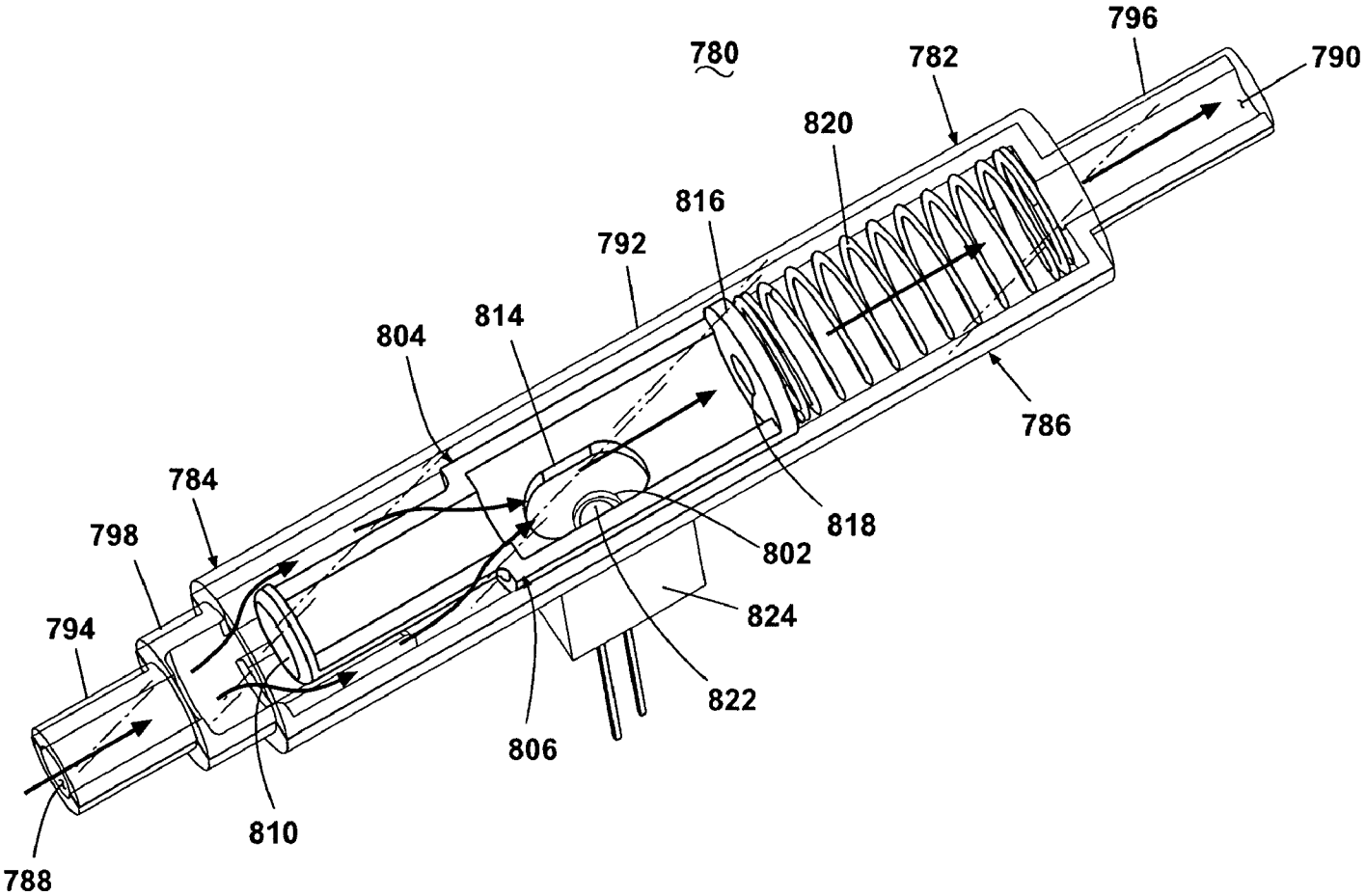
FIG. 43D is a perspective view of the flow indicator of FIG. 43A in a flow condition.

The flow indicator is operable between a non-flow condition illustrated in FIG. 43A and a flow condition shown in FIG. 43D. In the non-flow condition of FIG. 43A, the cleaning fluid does not flow through the conduit between the fluid inlet 788 and the fluid outlet 790, and the biasing member 830 biases the piston 804 into the intermediate section 798 such that the piston member 810 is received within the intermediate section 798. The piston member 810 is sized to prevent fluid flow through the intermediate section 798 and into the central section 792, regardless of its positioning within the intermediate section 798. When the piston 804 is in this position, the light opening 814 is longitudinally offset from the light aperture 802 in the lower housing 786. Thus, light from the illumination source 822, which can always be illuminated, is not viewable through the upper housing 784.

When the cleaning fluid flows into the fluid inlet 788 during operation of the extractor 10, the pressure of the fluid against the piston member 810 pushes the piston 804 against the bias of the biasing member 820 to the flow condition shown in FIG. 43D. Once the piston 804 moves a distance sufficient to remove the piston member 810 from the intermediate section 798 and position the piston member 810 in the central section 792, the cleaning fluid can flow from the inlet terminal section 794 and the intermediate section 798 into the central section 792, as shown by arrows in FIG. 43D. The cleaning fluid flows around the piston member 810 to enter the central section 792, through the fluid opening 818 in the piston endwall 816 to continue flowing through the central section 792, and through the outlet terminal section 796 to exit the flow indicator 780 through the fluid outlet 790. When the piston 804 is in this position, the light opening 814 is in register with the light aperture 802 in the lower housing 786. Thus, light from the illumination source 822 is viewable through the upper housing 784 and thereby communicates to the user that the cleaning fluid is flowing through the fluid delivery system.

Figure 44A:
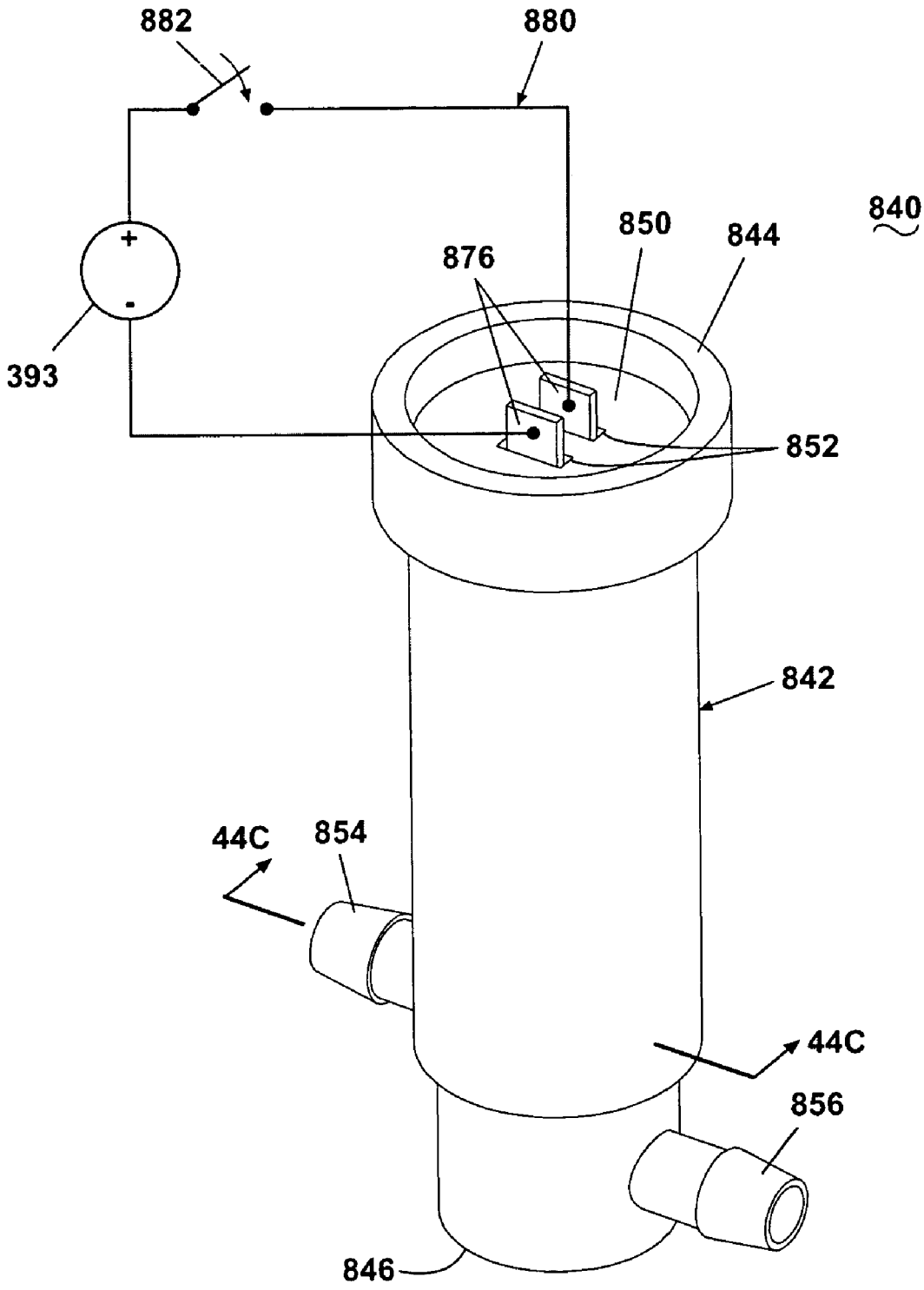
FIG. 44A is a perspective view of an alternative fluid valve for use in the fluid delivery system of FIG. 24.
Figure 44B:
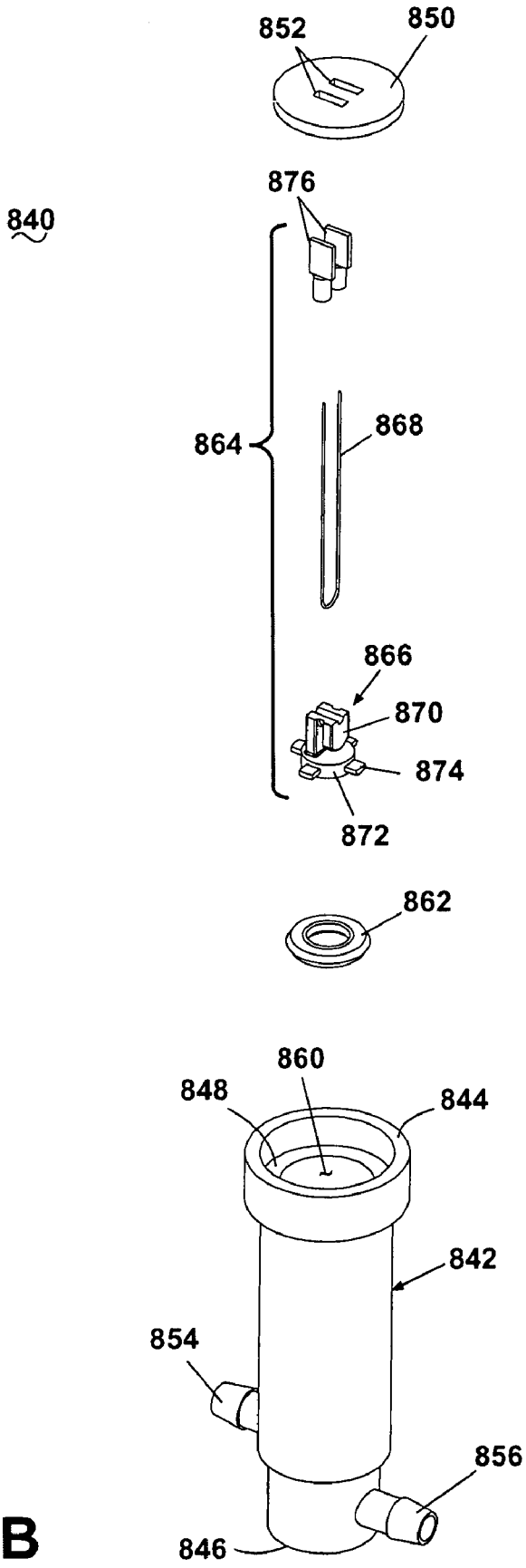
FIG. 44B is an exploded view of the fluid valve of FIG. 44A.
Figure 44D:
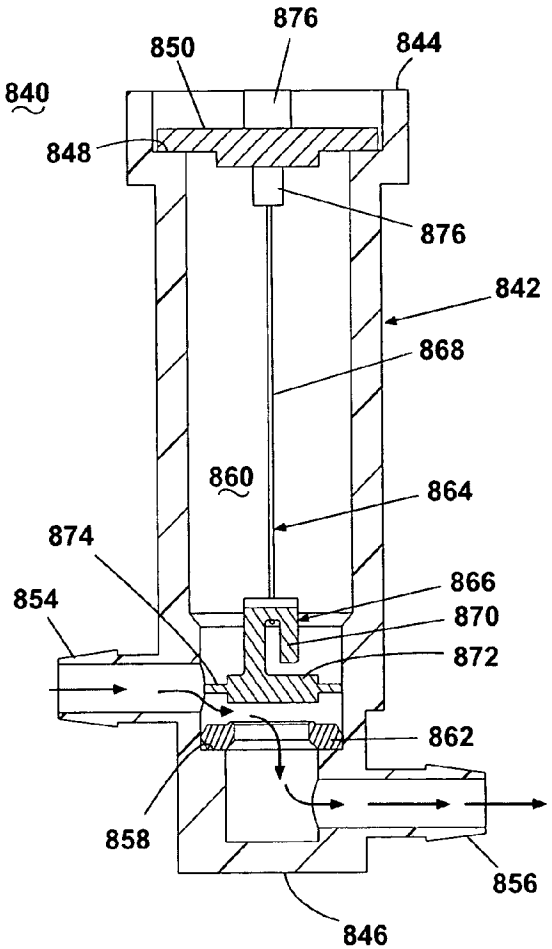
FIG. 44D is a sectional view similar to FIG. 44C, wherein the fluid valve is in an opened condition.
Figure 44C:
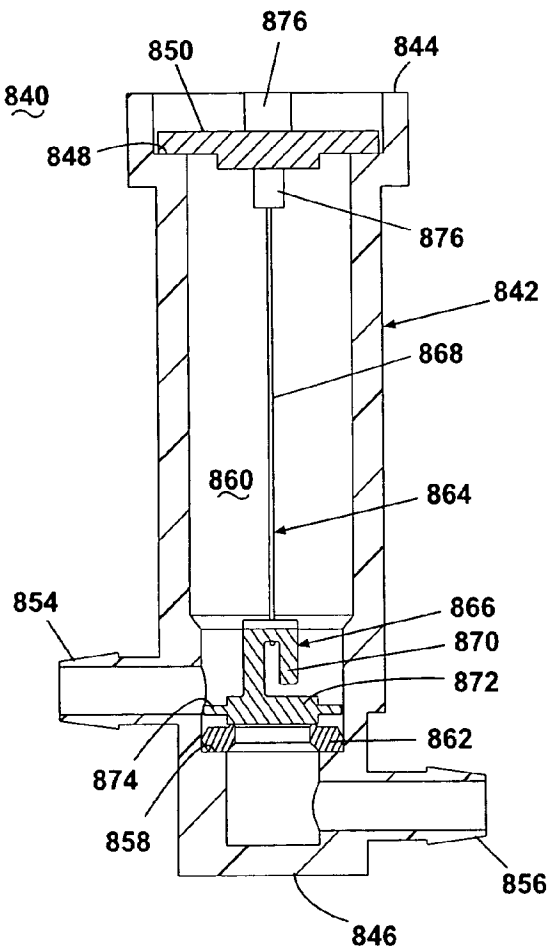
FIG. 44C is a sectional view taken along line 44C-44C of FIG. 44A, wherein the fluid valve is in a closed condition.

FIGS. 44A-44D illustrate a fluid valve 840 that can be utilized in the fluid delivery system of FIG. 24. The fluid valve 840 can replace one or both of the first and second metering valves 332, 334 of the metering valve assembly 330 or the spray tip valve 224. In general, the fluid valve 840 at least partially controls the flow of fluid from the solution supply tank housing 150 to the fluid dispenser, which can be the spray tips 218. As shown in FIGS. 44A and 44B, the fluid valve 840 comprises a generally cylindrical, hollow housing 842 defining an internal chamber 860 and having an open upper end 844 and a closed lower end 846. Near the upper end 844, the housing 842 has an internal upper annular shoulder 848 that supports a disc-like cap 850 having a pair of spaced parallel slits 852. Near the lower end 846, the housing 842 includes a fluid inlet conduit 854 and a fluid outlet conduit 856 extending radially from the housing 842 in diametrically opposite directions. Thus, the housing 842 forms a fluid conduit through the fluid inlet conduit 854, the internal chamber 860, and the fluid outlet conduit 856. As shown in FIG. 44C, the housing 842 further includes an internal lower annular shoulder 858 disposed vertically between the fluid inlet conduit 854 and the fluid outlet conduit 856. The lower annular shoulder 858 supports an annular valve seat 862.

The fluid valve 840 further comprises a valve assembly 864 having a valve member or valve body 866 and a valve actuator in the form of a wire 868 made of a shape memory alloy. The valve body 866 comprises a bracket 870 around which the wire 868 can be wrapped to couple the wire 868 to the valve body 866. The bracket 870 extends upward from a valve disc 872 having a plurality of radially extending arms 874. The wire 868 is generally U-shaped and is coupled to a pair of electrical contacts 876 at its ends. The wire 868 can be made of any suitable shape memory alloy, examples of which include nickel-titanium, which is commonly referred to as Nitinol, copper-aluminum-nickel, copper-zinc-aluminum, iron-manganese-silicon, gold-cadmium, and brass alloys. Shape memory alloys undergo a solid state phase change at a transition temperature, and volumetric changes accompany the solid state phase change.

When the fluid valve 840 is assembled, as shown in FIGS. 44A and 44C, the electrical contacts 876 of the wire 868 are received by the slits 852 of the cap 850 to suspend the wire 868 from the cap 850 in the internal chamber 860. The valve body 866 is suspended from the wire 868, and the wire 868 wraps around the bracket 870 of the valve body 866 in a taut or spring loaded fashion so that there is no slack in the wire 868. The wire 868 is coupled to an electrical circuit 880 having the power source 393 and a switch 882. As illustrated in FIG. 44C, the valve body 866 sits on the valve seat 862 with the valve disc 872 contacting the valve seat 862 to block fluid flow through the internal chamber 860 from the fluid inlet conduit 854 to the fluid outlet conduit 856. When the valve body 866 is in the position in FIG. 44C, the fluid valve 840 is in a closed condition.

To move the fluid valve 840 to an opened condition, as shown in FIG. 44D, the switch 882 closes to apply electrical current to the electrical contacts 876 and thereby heat the wire 868 above the solid state phase change transition temperature. As the temperature of the wire 868 goes through the transition temperature, the wire 868 changes phase and thereby undergoes a volumetric change. As a result, the wire 868 shrinks and lifts the valve body 866 upward within the internal chamber 860. The valve disc 872 raises from the valve seat 862, and the cleaning fluid can flow from the fluid inlet conduit 852, into the internal chamber 860, around the valve disc 872 between the arms 874, through the valve seat 862, and into the fluid outlet conduit 854.

To close the fluid valve 840, the switch 882 opens to remove the electrical current from the wire 868, and the wire 868 cools to below the transition temperature. As a result, the wire 868 expands and returns to the configuration of FIG. 44C to lower the valve body 866 into contact with the valve seat 862 and thereby close the fluid valve 840. The cooling of the wire 868 can be facilitated by the cleaning fluid in the internal chamber 860. Alternatively, air can be fed into the internal chamber 860 to facilitate fast cooling of the wire 868.

Various features of the fluid valve 840 can be modified to adjust the time required for opening and closing the fluid valve 840. According to one embodiment of the invention, the fluid valve 840 opens in about one second and closes in about one second. Examples of modifications include, but are not limited to, looping the wire 868 around the bracket 870 more than once to increase the force applied to the valve body 866 or to utilize multiple small wires rather than a single wire.

The various features of the extractor 10 described here are not limited for use in an upright extractor. Rather, the features can be employed for any suitable surface cleaning apparatus, including, but not limited to, hand-held extractors, canister extractors, upright and canister vacuum cleaners, shampooing machines, mops, bare floor cleaners, and the like.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention which is defined in the appended claims.

What is claimed is:

1. A surface cleaning apparatus comprising:

a housing;

a fluid delivery system mounted to the housing and including a fluid supply tank for holding a supply of cleaning fluid, a fluid dispenser for applying cleaning fluid from the fluid supply chamber to the surface to be cleaned, and a fluid conduit between the fluid supply tank and the fluid dispenser;

a fluid recovery system mounted to the housing and comprising a suction nozzle and a vacuum source in fluid communication with the suction nozzle to draw fluid from the surface to be cleaned through the suction nozzle; and a dispensing valve in the fluid conduit for controlling the flow of the cleaning fluid from the fluid supply tank to the fluid dispenser;

an actuator that includes a shape memory alloy part is coupled to the dispensing valve to control the flow of fluid from the fluid supply tank to the fluid dispenser; and an electrical circuit that includes the shape memory alloy part and a switch that controls the flow of current through the electrical circuit for selectively actuating the dispensing valve.

2. The surface cleaning apparatus according to claim 1 wherein the shape memory alloy part comprises a shape memory alloy wire.

3. The surface cleaning apparatus according to claim 2 wherein the dispensing valve comprises a valve housing having a fluid inlet, a fluid outlet and a valve member movable relative to a valve seat to control the flow of fluid between the inlet and the outlet.

4. The surface cleaning apparatus according to claim 3 wherein the valve member is suspended from the shape memory alloy wire whereby contraction of the wire when the switch is closed lifts the valve member from the valve seat.

5. The surface cleaning apparatus according to claim 4 wherein the valve housing forms an internal chamber that receives the shape memory alloy wire and holds the cleaning fluid to facilitate a temperature decrease of the shape memory alloy wire for reversing the contraction of the shape memory alloy wire when the switch is open.

6. The surface cleaning apparatus according to claim 4 wherein the shape memory alloy part is made of a nickel-titanium alloy.

7. The surface cleaning apparatus according to claim 1 wherein the shape memory alloy part is made of a nickel-titanium alloy.

* * * * *